US009963906B2

(12) United States Patent
Roatis et al.

(10) Patent No.: US 9,963,906 B2
(45) Date of Patent: May 8, 2018

(54) LOCK

(71) Applicants: Calin Roatis, Long Grove, IL (US); William Denison, North Barrington, IL (US)

(72) Inventors: Calin Roatis, Long Grove, IL (US); William Denison, North Barrington, IL (US)

(73) Assignee: TriTeq Lock and Security LLC, Elk Grove Village, IL (US)

( * ) Notice: Subject to any disclaimer, the term of this patent is extended or adjusted under 35 U.S.C. 154(b) by 66 days.

(21) Appl. No.: 14/728,996

(22) Filed: Jun. 2, 2015

(65) Prior Publication Data

US 2015/0376916 A1 Dec. 31, 2015

Related U.S. Application Data

(63) Continuation-in-part of application No. PCT/US2014/038016, filed on May 14, 2014.
(Continued)

(51) Int. Cl.
*E05B 37/00* (2006.01)
*E05B 3/08* (2006.01)
(Continued)

(52) U.S. Cl.
CPC ..... *E05B 3/08* (2013.01); *E05B 1/003* (2013.01); *E05B 15/0053* (2013.01);
(Continued)

(58) Field of Classification Search
CPC ..... E05B 1/00; E05B 1/0007; E05B 1/003; E05B 3/00; E05B 3/003; E05B 3/08;
(Continued)

(56) References Cited

U.S. PATENT DOCUMENTS 7,318,331 B2 * 1/2008 Miao ..... E05B 37/16 70/214
7,444,844 B1 * 11/2008 Lee ..... E05B 37/0034 70/21

(Continued)

FOREIGN PATENT DOCUMENTS

GB 2429032 A 2/2007
WO 2009109972 A1 9/2009

*Primary Examiner* — Christopher J Boswell

(74) *Attorney, Agent, or Firm* — The Watson I.P. Group, PLC; Jovan N. Jovanovic; Vladan M. Vasiljevic

(57) ABSTRACT

A lock, attachable to a coupling in a bushing coupled to an outside structure, includes a housing, an actuatable lock assembly and a latching assembly. The actuatable lock assembly is rotatable relative to the housing assembly in a closed orientation and an open orientation, and, has a spindle member having a knob attachment portion and a coupling attachment portion. Here, the spindle member and a knob are configured to rotate relative to the housing assembly. The coupling attachment portion is extendable into a central bore and attachable to a coupling. Upon attachment, relative rotation of the spindle member and the coupling is substantially precluded. The latching assembly is positionable in one of a locked position and an unlocked position. The latching assembly is positioned within the cavity of the housing assembly and includes a motor to direct the actuatable lock assembly from a closed orientation to the open orientation.

25 Claims, 61 Drawing Sheets

Related U.S. Application Data

(60) Provisional application No. 61/823,685, filed on May 15, 2013.

(51) Int. Cl.

| | |
|---|---|
| ***E05B 47/00*** | (2006.01) |
| ***E05B 1/00*** | (2006.01) |
| ***E05B 47/06*** | (2006.01) |
| ***E05B 63/00*** | (2006.01) |
| ***E05C 3/04*** | (2006.01) |
| ***E05B 15/00*** | (2006.01) |
| ***E05C 3/12*** | (2006.01) |
| ***G07C 9/00*** | (2006.01) |

(52) U.S. Cl.
CPC ..... *E05B 37/00* (2013.01); *E05B 47/0001* (2013.01); *E05B 47/0012* (2013.01); *E05B 47/0657* (2013.01); *E05B 47/0673* (2013.01); *E05B 63/0056* (2013.01); *E05C 3/042* (2013.01); *E05C 3/12* (2013.01); *G07C 9/00126* (2013.01); *E05B 2047/0024* (2013.01); *E05B 2047/0054* (2013.01); *E05B 2047/0058* (2013.01); *Y10T 70/7062* (2015.04)

(58) Field of Classification Search
CPC ..... E05B 37/00; E05B 37/0031; E05B 47/00; E05B 47/0001
See application file for complete search history.

(56) References Cited

U.S. PATENT DOCUMENTS

| | | | | |
|---|---|---|---|---|
| 8,161,781 | B2 * | 4/2012 | Gokcebay | E05B 47/0657 70/278.1 |
| 8,495,898 | B2 * | 7/2013 | Gokcebay | G07C 9/00666 70/214 |
| 8,616,031 | B2 * | 12/2013 | Ullrich | E05B 47/0012 70/278.7 |
| 9,208,628 | B2 * | 12/2015 | Gokcebay | E05C 3/042 |
| 9,222,284 | B2 * | 12/2015 | Gokcebay | E05C 3/042 |
| 9,273,492 | B2 * | 3/2016 | Gokcebay | E05B 47/06 |
| 9,536,359 | B1 * | 1/2017 | Gokcebay | E05B 47/06 |
| 2007/0277571 | A1 * | 12/2007 | Gokcebay | G07C 9/00666 70/278.1 |

* cited by examiner

LOCK

CROSS-REFERENCE TO RELATED APPLICATION

The present application is a continuation-in-part of PCT Patent Application No. PCT/US2014/038016 filed May 14, 2014, entitled "Lock" the entire specification of which is hereby incorporated by reference, which claims priority from U.S. Provisional Patent Application Ser. No. 61/823,685, filed May 15, 2013, entitled "Hybrid-Electronic Core Lock", the entire specification of which is hereby incorporated by reference.

BACKGROUND OF THE DISCLOSURE

1. Field of the Disclosure

The disclosure relates in general to locks, and more particularly, to a core lock that is configured to provide electronic locking and unlocking of a lock. While not limited thereto, such a lock is well suited for use in association with furniture and cabinets, including as a retrofit to existing furniture and cabinets. Of course, the lock is not limited to such use or to such a field of use, and the foregoing is solely for purposes of example.

2. Background Art

Many cabinets, desks, and other storage applications utilize locks that include a shell mounted on the door or cabinet, and an insertable and removable lock core that plugs into the shell. The shell not only houses the core, but also attaches to a driver for accomplishing the locking and unlocking function when rotated. The lock core acts to lock the driver in place when there is no key inserted in the lock core due to lock core tumblers that protrude into the shell to restrict the lock core and driver from rotation.

When the correct key is inserted in the lock core, the protruding tumblers move with respect to the cuts in the key blade and no longer protrude into the shell and no longer restrict rotation of the lock core. As the lock core is turned by the user rotating the key, drive serves to drive a cam or locking bar to the unlocked position.

Such systems are ubiquitous, however, there are nevertheless drawbacks. For example, such systems typically have a vast number of different tumbler configurations, and corresponding keys associated with each such different tumbler configuration. As a result, a supplier must include a relatively large supply of spare locks, tumblers and keys to match those that are out in the field. Additionally, the removal and replacement of such locks (necessitated by the changing of the duty of a piece of furniture, dismissal of an employee, loss of a set of keys, etcetera) is very time consuming and labor intensive.

SUMMARY OF THE DISCLOSURE

In an aspect of the disclosure, the disclosure is directed to a lock coupled to a selectively movable member having an exposed outside surface and an inside surface opposing the outside surface. The inside surface defines a portion of a volume to which the lock is providing selective access. Such a configuration may comprise, but not be limited to, a desk drawer, a cabinet, an armoire, or the like. The lock includes a housing, an actuatable lock assembly and a latching assembly. The housing assembly defines a cavity. The housing assembly is positioned on an exposed outside surface of the selectively movable member. The actuatable lock assembly is associated with the housing and is rotatable relative to the housing assembly in at least a closed orientation and an open orientation. The actuatable lock assembly further includes a bushing, a knob, a coupling and a spindle member. The bushing extends through a bore in a selectively movable member. The bushing defines a central bore, and has an end wall with a latch opening extending therethrough. The knob is rotatably positionable relative to the housing assembly and overlying the bushing. The coupling has a body positionable within the central bore with a second end extending through the latch opening. The coupling is configured to be rotatable within the central bore about an axis defined by the second end extending through the latch opening. The coupling has a spindle attachment portion positioned within the central bore. The spindle member has a knob attachment portion and a coupling attachment portion. The knob attachment portion is attachable to the knob, so as to rotate therewith. The coupling attachment portion extends into the central bore and is attachable to the spindle attachment portion of the coupling. Upon attachment, relative rotation of the spindle member and the coupling is substantially precluded. The latching assembly is positionable in one of a locked position and an unlocked position. The latching assembly is positioned within the cavity of the housing assembly. The latching assembly further includes a motor. Upon actuation thereof, the motor is configured to position the latching assembly in one of the locked position and the unlocked position. Positioning in the unlocked position allows direction of the actuatable lock assembly from a closed orientation to the open orientation. Positioning in the locked position precludes direction of the actuatable lock assembly into the open orientation.

In some configurations, upon attachment of the spindle attachment portion of the coupling and the coupling attachment portion of the spindle member, relative axial movement is substantially precluded therebetween.

In some configurations, an electronic control assembly is electrically coupled to the motor and positioned within the housing assembly. The electronic control assembly is configured to control the same. An input device is positioned on a top of the housing assembly. The input device allows a user to provide an authorizing signal to the electronic control assembly to direct the motor to initiate rotation thereof.

In some configurations, the input device comprises a keypad.

In some configurations, the knob is positionable on a surface of the housing assembly, with the spindle member extending through an opening therein.

In some configurations, the coupling attachment portion includes a body and a coupling member latching portion. The body further includes a retention coupling portion and an internal cavity portion. The retention coupling portion defines a transverse slot having a base, a first upstanding wall and a second upstanding wall positioned in a spaced apart orientation extending from the base. A first inward flange extends from the first upstanding wall spaced apart from the base. A second inward flange extends from the second upstanding wall spaced apart from the base. An internal cavity portion defines an upper opening in the base spaced apart from the first upstanding wall and the second upstanding wall. A coupling member latching portion is slidably movable through the upper opening from within the internal cavity so as to be within the transverse slot.

In such a configuration, the spindle attachment portion of the coupling further comprises a first leg and a second leg. The first leg has a retaining flange at a distal end thereof. The second leg has a retaining flange at a distal end thereof. The first and second legs are spaced apart so as to define a slot therebetween. The distal end of the first leg and the distal end of the second leg are positionable into the transverse slot in a first orientation and directable against the coupling member latching portion directing the coupling member latching portion out of the transverse slot through the upper opening. Upon rotation of the spindle member relative to the coupling through a predetermined relative rotation, the retaining flange of the first leg becomes captured between the base and the first inward flange. The retaining flange of the second leg becomes captured between the base and the second inward flange. The coupling member latching portion is slidably positionable within the slot therebetween. Relative rotation of the spindle member relative to the coupling is substantially precluded.

In some configurations, a biasing member is positioned between the body of the coupling attachment portion and the coupling member latching portion. The biasing member biasing the coupling member latching portion to extend into the transverse slot.

In some configurations, the biasing member comprises a spring positionable within the internal cavity.

In some configurations, the coupling member latching portion includes an upper end configured to extend through the upper opening, a first lower leg and a second lower leg extending therefrom. The first lower leg including a first outward flange and the second lower leg including a second outward flange. The outward flanges interfacing with opposing lower ledges defined in the internal cavity portion to preclude removal of the coupling member latching portion through the upper opening.

In some configurations, a biasing member is positioned between the body of the coupling member attachment portion and the coupling member latching portion. The biasing member biasing the first outward flange against one of the opposing lower ledges and the second outward flange against the other of the opposing lower ledges, to, in turn, direct a portion of the upper end to extend through the upper opening.

In some configurations, the biasing member comprises a spring positioned within the internal cavity portion and between the first lower leg and the second lower leg, and positioned against the upper end thereof.

In some configurations, the coupling attachment portion includes a body and a coupling member latching portion. The body further includes a retention coupling portion and a coupling member latching portion. The retention coupling portion defines a transverse slot having a base, a first upstanding wall and a second upstanding wall positioned in a spaced apart orientation extending from the base. The coupling member latching portion further includes a first flexible gripper arm that extends along the body and the first upstanding wall, and has an inward flange positioned to extend inwardly beyond the first upstanding wall so as to overlie the base. The first flexible gripper arm is elastically movable in an outward direction so as to direct the inward flange beyond the first upstanding wall. Further, a second flexible gripper arm extends along the body and the second upstanding wall, and has an inward flange positioned to extend inwardly beyond the second upstanding wall so as to overlie the base. The second flexible gripper arm is elastically movable in an outward direction so as to direct the inward flange beyond the second upstanding wall. The spindle attachment portion of the coupling further comprises a first leg and a second leg. The first leg has a retaining flange at a distal end thereof. The second leg has a retaining flange at a distal end thereof. The distal end of the first leg and the distal end of the second leg are directable into the first and second flexible gripper arms, elastically moving the first and second flexible gripper arms outwardly, so as to position the retaining flange of the first leg and the retaining flange of the second leg beyond the first and second gripper arms and into the transverse slot. The returned first and second flexible gripper arms sandwich the first and second legs therebetween, to, in turn, substantially preclude relative rotation of the spindle member relative to the coupling.

In some configurations, the first and second flexible gripper arms and the transverse slot captures the first and second leg so as to substantially preclude relative axial movement therebetween.

In some configurations, a latch flange is coupled to the second end outside of the central bore.

In some configurations, the latching assembly further comprises a latch, a blocker and a cam. The latch is movable relative to the housing. The latch has a proximal end and a distal end. The distal end is configured to interface with the actuatable lock assembly. Movement of the actuatable lock assembly between the closed orientation and the open orientation imparts movement of the latch relative to the housing. The blocker is slidably movable between a locked position and an unlocked position. In the locked position, the blocker precludes movement of the latch to thereby preclude the direction of the actuatable lock assembly from a closed orientation to an open orientation. In the unlocked position, the blocker is slidably moved relative to the latch so as to allow the latch to move relative to the blocker, to, in turn, allow the actuatable lock assembly to move between the closed orientation and the open orientation, the blocker having a cam profile disposed thereon.

The cam is rotatably mounted within the cavity of the housing assembly. The cam has a first follower configured to intermittently coact with the cam profile of the blocker, to, in turn, move the blocker to allow the latch to move between a locked position to the unlocked position. The motor is coupled to the cam, and whereupon actuation of the motor caused rotation of the cam, and, in turn, movement of the latch between the locked and unlocked position.

In some configurations, upon actuation of the motor, from either the locked or the unlocked position, the cam rotates through an initial arcuate distance prior to imparting a force upon the blocker to slidably move the same into the other of the locked or unlocked position.

In some configurations, the initial arcuate distance comprises approximately half of a revolution.

In some configurations, the arcuate distance of rotation of the cam between the locked position and the unlocked position comprises approximately a revolution and a half.

In some configurations, the blocker further includes a second cam profile disposed thereon. The first and second cam profiles being substantially parallel to each other defining a longitudinal channel therebetween. The cam further includes a body and a second follower. The first follower extends from a first side of the body and a second follower extends from a second side of the body. The cam follower interfaces with the cam profile and the second cam follower interfaces with the second cam profile, with the body of the cam positioned at least partially within the longitudinal channel.

In some configurations, the cam profile includes a first slot, a second slot and a third slot. A first ridge is defined between the first slot and the second slot. A second ridge is defined between the second slot and the third slot. The width of the second slot is at least as wide as the follower, such that when the follower engages the second slot, further rotation slidably moves the blocker.

In another aspect of the disclosure, the disclosure is directed to a lock that is attachable to a coupling with a first end positioned within a central bore of a bushing that is attachable to an outside structure, and a second end extending out of the bushing and having a locking flange. That is, the lock is attachable to an existing coupling that is attached to a bushing, both of which may be positioned in an operational configuration. The lock comprises a housing, an actuatable lock assembly and a latching assembly. The housing assembly defines a cavity. The housing assembly is positionable on an outside structure. The actuatable lock assembly is associated with the housing. The actuatable lock assembly is rotatable relative to the housing assembly in at least a closed orientation and an open orientation. The actuatable lock assembly further comprises a spindle member having a knob attachment portion and a coupling attachment portion. A knob is coupled to the knob attachment portion. The spindle member and the knob are configured to rotate relative to the housing assembly. The coupling attachment portion is extendable into a central bore and attachable to a coupling positioned therein. Upon attachment, relative rotation of the spindle member and the coupling is substantially precluded.

The latching assembly is positionable in one of a locked position and an unlocked position. The latching assembly is positioned within the cavity of the housing assembly. The latching assembly further includes a motor, which upon actuation thereof, is configured to position the latching assembly in one of the locked position and the unlocked position. Positioning in the unlocked position allows rotation of the knob, and, in turn, direction of the actuatable lock assembly from a closed orientation to the open orientation. Positioning in the locked position precludes direction of the actuatable lock assembly into the open orientation.

In some configurations, the coupling attachment portion further includes a body and a coupling member latching portion. The body further includes a retention coupling portion and an internal cavity portion. The retention coupling portion defines a transverse slot having a base, a first upstanding wall and a second upstanding wall positioned in a spaced apart orientation extending from the base. A first inward flange extends from the first upstanding wall spaced apart from the base. A second inward flange extends from the second upstanding wall spaced apart from the base. The internal cavity portion defines an upper opening in the base spaced apart from the first upstanding wall and the second upstanding wall. The coupling member latching portion is slidably movable through the upper opening from within the internal cavity so as to be within the transverse slot. A portion of a coupling is retained between the base and the first and second inward flanges, and substantially precluded from rotation at least partially by the coupling member latching portion extending beyond the base.

In some configurations, the coupling attachment portion includes a body and a coupling member latching portion. The body further includes a retention coupling portion that defines a transverse slot having a base, a first upstanding wall and a second upstanding wall positioned in a spaced apart orientation extending from the base. The coupling member latching portion further includes a first flexible gripper arm extending along the body and the first upstanding wall, and has an inward flange positioned to extend inwardly beyond the first upstanding wall so as to overlie the base. The first flexible gripper arm is elastically movable in an outward direction so as to direct the inward flange beyond the first upstanding wall. A second flexible gripper arm extends along the body and the second upstanding wall, and has an inward flange positioned to extend inwardly beyond the second upstanding wall so as to overlie the base, the second flexible gripper arm being elastically movable in an outward direction so as to direct the inward flange beyond the second upstanding wall. The first and second flexible gripper arms sandwich a portion of a coupling member therebetween, to, in turn, substantially preclude relative rotation of the spindle member relative to a coupling.

BRIEF DESCRIPTION OF THE DRAWINGS

The disclosure will now be described with reference to the drawings wherein.

DETAILED DESCRIPTION OF THE DISCLOSURE

Figure 1A:
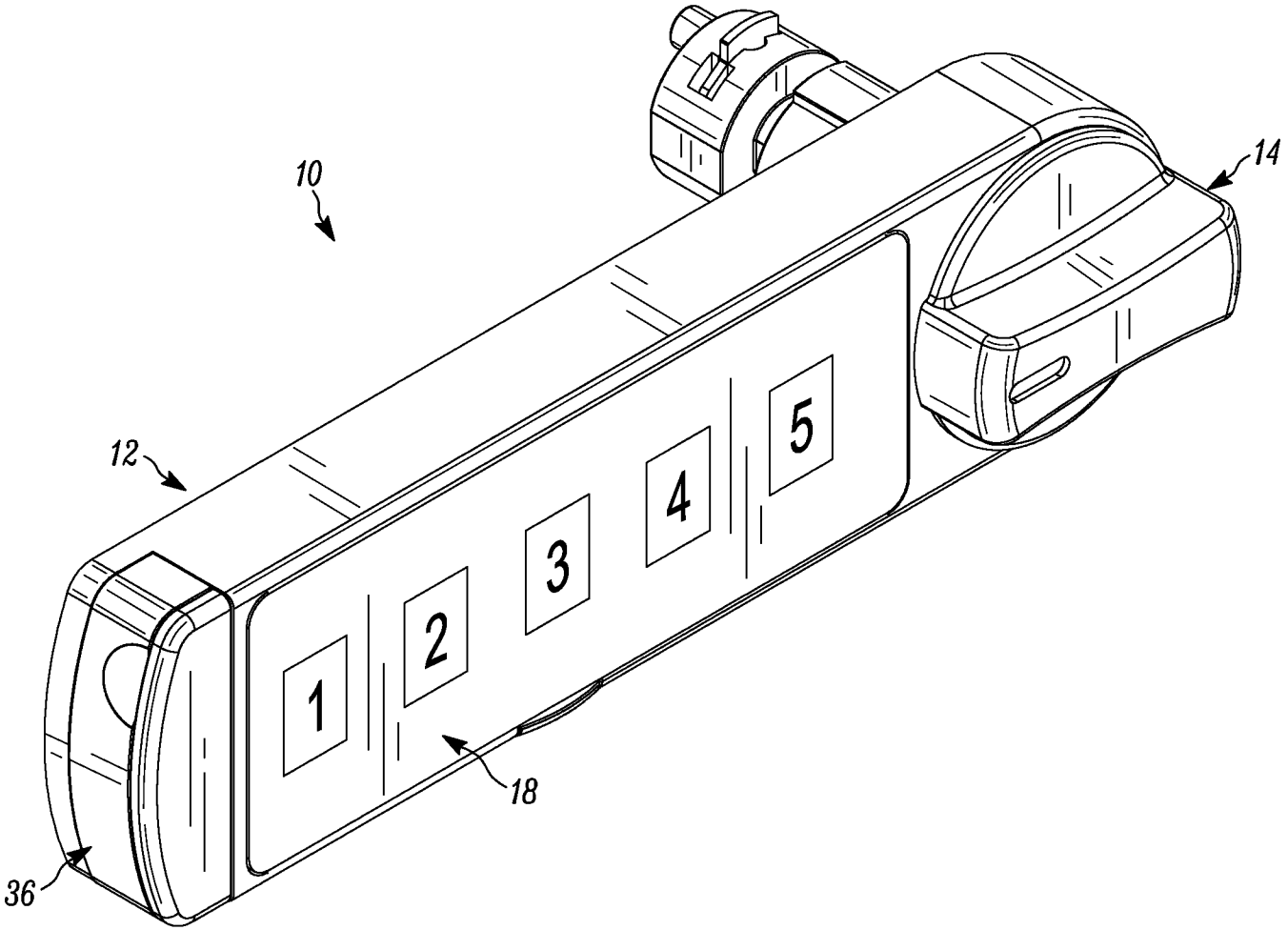
FIG. 1A of the drawings is a front perspective view of the lock of the present disclosure.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 1B:
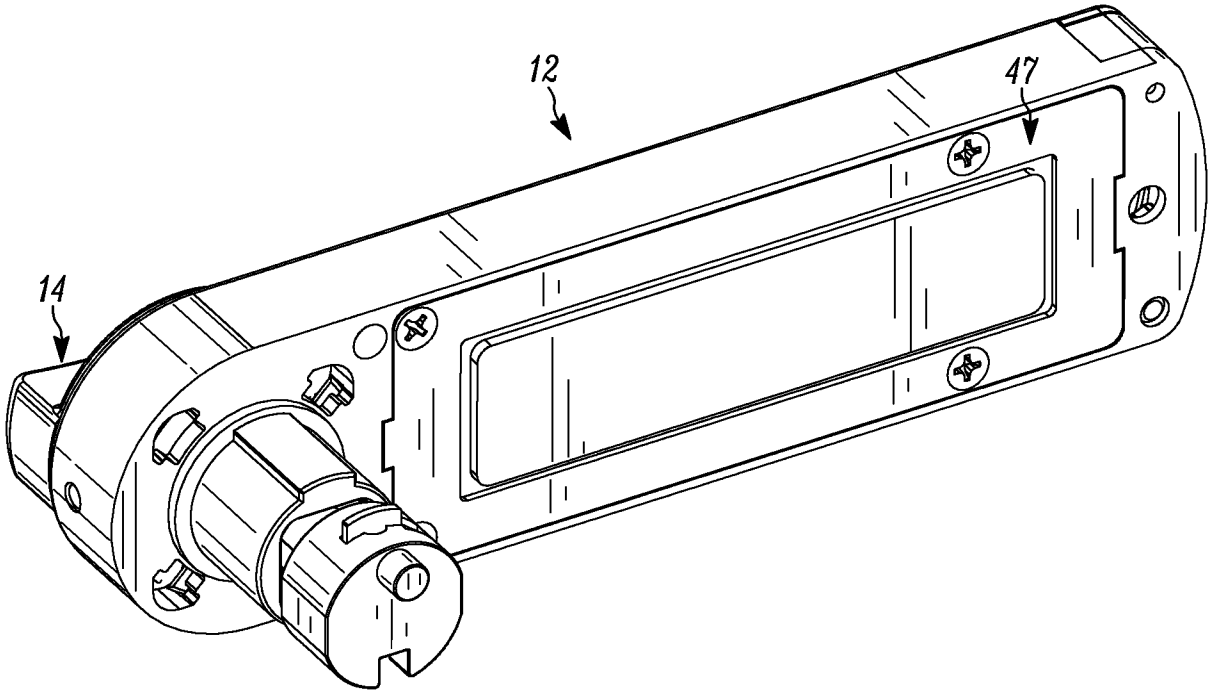
FIG. 1B of the drawings is a back perspective view of the lock of the present disclosure.

Referring now to the drawings and in particular to FIGS. 1 and 1A, the lock of the present invention is shown generally at 10. The lock 10 may be utilized in a number of different environments and in association with a number of different installations, including but not limited to, doors, drawers, cabinets, pantries, desks, etc. One particular use of the lock is in the office furniture application (i.e., desks, credenzas, cabinets, wardrobes, etc), wherein it is contemplated that the lock can be a drop in replacement for the commonly installed office furniture locks. Of course, the disclosure is not limited to use in association with such applications.

Figure 2:
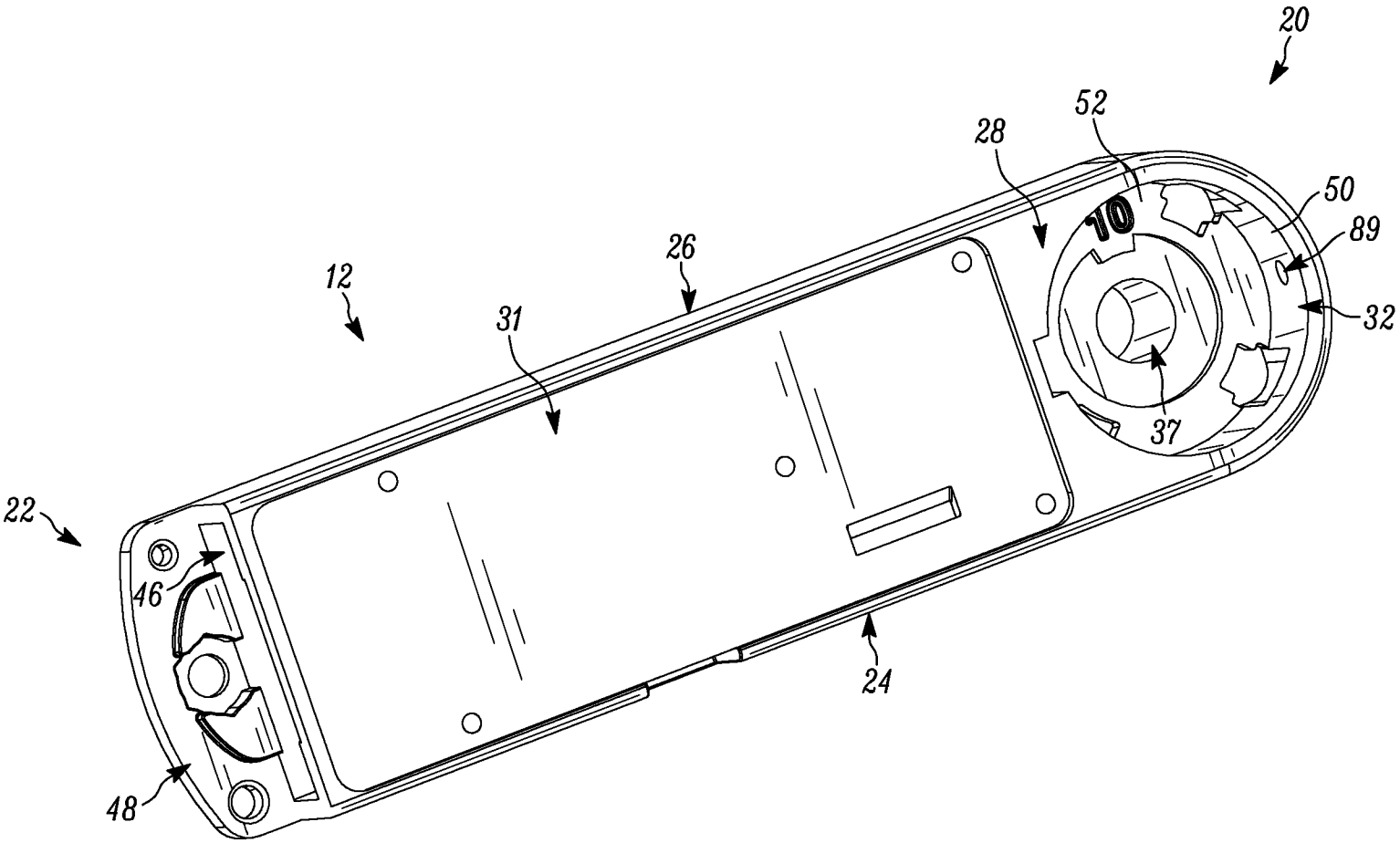
FIG. 2 of the drawings is a front perspective view of components of the housing assembly of the present disclosure.
Figure 3:
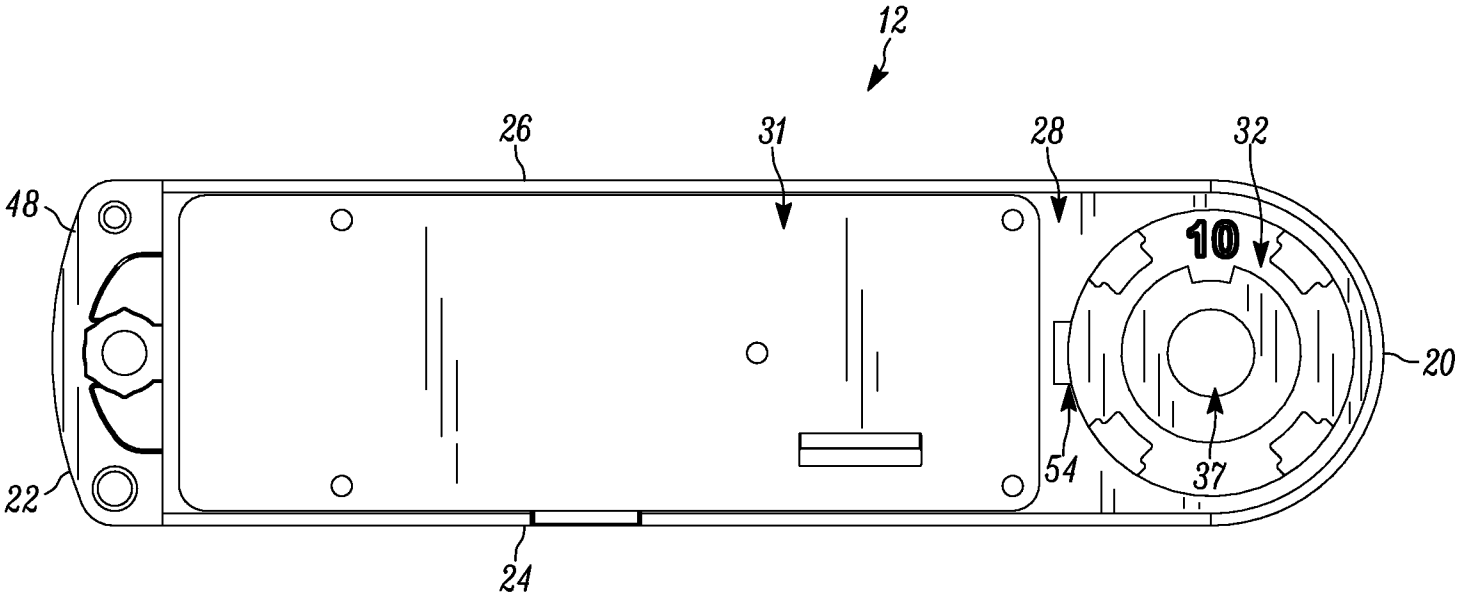
FIG. 3 of the drawings is a top plan view of components of the housing assembly of the present disclosure.
Figure 4:
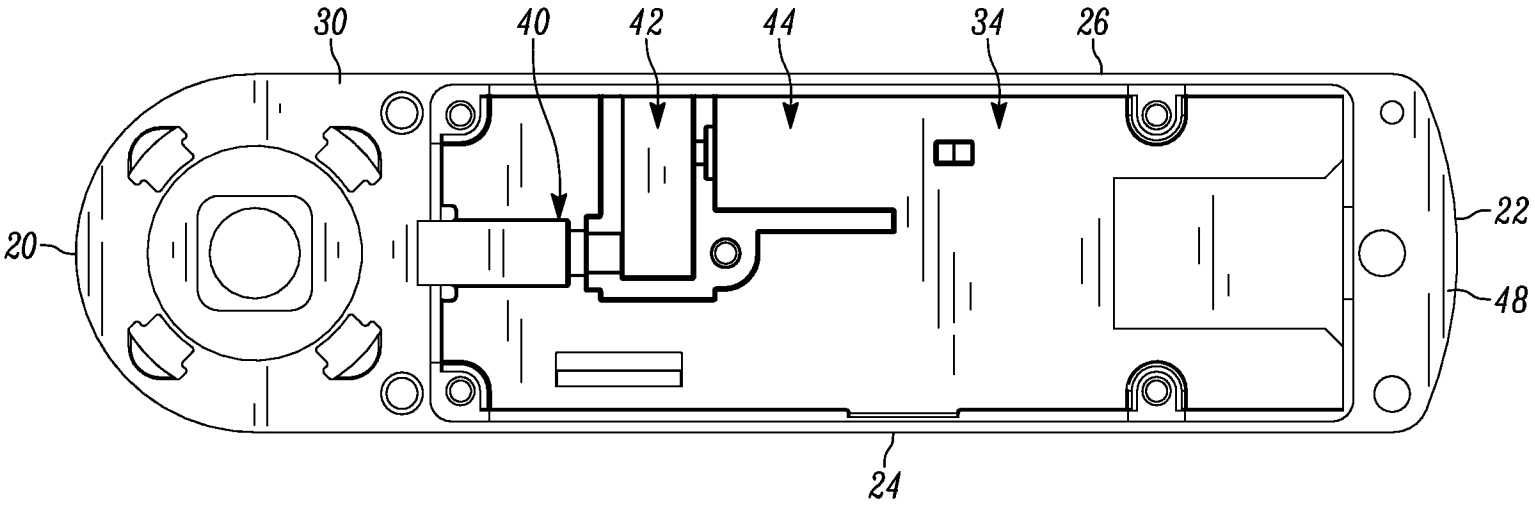
FIG. 4 of the drawings is a bottom plan view of components of the housing assembly of the present disclosure.

Referring again to FIGS. 1A and 1B, the lock 10 is shown as including housing assembly 12, actuatable lock assembly 14, latching assembly 16 (FIG. 12A) and electronic control assembly 18. With reference to FIGS. 2, 3 and 4, the housing assembly 12 comprises a body with first end 20, second end 22, first side 24 and second side 26, top 28 and bottom 30. The housing assembly is shown as comprising a single cast member, although other configurations are contemplated. The single cast member may comprise a metal or alloy thereof, or may comprise a composite or polymer material.

As set forth above, it is contemplated that the lock of the present embodiment be suitable for use in association with furniture. Traditionally, the portion of the furniture that includes a lock has generally a dimension (either a length or a width, typically) that is only slightly larger than the lock body and necessary opening therefore. Generally, such a dimension is on the order of one inch or the like. Thus, it is preferred that the lock have a housing assembly that is one inch or less in width (or length when mounted in another direction) so as to be mountable on such a surface without a portion thereof overhanging the surface. As such, the lock of the present disclosure is sized so as to fit into most of the cabinets and furniture presently manufactured, without requiring any changes or redesign of the cabinet or furniture. Additionally, such a design allows for the retrofitting of existing cabinets and furniture. It will be understood that the lock is not limited to use in association with cabinets or furniture, and that such use is merely utilized for purposes of illustration. It is further contemplated, that to achieve the one inch dimension, the diameter of the cavity 32 is 0.93 inches, the diameter of the knob is 0.97 inches, with the thickness of the housing assembly being 0.39 inches and the thickness including the knob is 0.70 inches. Additionally, it is contemplated that the motor is 0.61 inches in length and 0.32 inches in width. Furthermore, it is contemplated that the battery have a diameter of 0.79 inches and a thickness of 0.13 inches.

The top 28 includes a recessed portion 31 which is configured to receive a keypad or other input device thereon. In one embodiment, the input device may comprise a number pad having a plurality of discrete numbers thereon. The number pad may include an outer perimeter and a thickness that is well suited for fitting into the recessed portion. In the embodiment shown, the recessed portion extends over much of the top 28 between the first side and the second side. The recessed portion may include an opening which provides for the passage of wiring or other electrical connectors that provides electrical communication between the input device and the rest of the electronic control assembly.

At or near the first end 20 of the housing assembly 12, the actuatable lock region 32 is positioned. The actuatable lock region 32 comprises an annular cavity having a base 50 and an upstand wall 52. The base 50 includes a central opening 37 and may include other structures and openings therearound. The central opening 37 is configured for the passage of the portions of the actuatable lock assembly 14 and to link structures thereof on either side of the base 50. For example, in the embodiment shown, four generally round chamfered openings (configured to receive fasteners) are disposed about the central opening in a generally uniformly spaced apart orientation. Additionally, four slot like openings are positioned in the space therebetween.

The upstanding wall 52 is a generally annular wall having a latch opening 54 extending therein providing communication between the cavity of the actuatable lock region with the main body cavity 34. In addition, wall surface variations or indentations may be presented to match with the four slot like openings that are defined in the base. These may comprise detents that cooperate with spring loaded balls or the like incorporated into the knob 70 (FIGS. 10 and 11) to form local positions of stable equilibrium wherein the knob can rest in such a position. It is contemplated that with the four different locations between two and four positions are defined (depending on the rotation of the knob). In other embodiments, a fewer or greater number of detents may be disposed on the upstanding wall 52 to cooperate with spring loaded balls incorporated into the knob. In still other embodiments, structures other than spring loaded balls, such as biasing leaves may be utilized.

In the embodiment shown, the upstanding wall extends from the base 50 to the top 28, and is generally perpendicular to the top 28 as well as the base 50 of the actuatable lock region 32. Additionally, the second end 22 of the housing assembly 12 may have a configuration that generally matches the upstand wall 52.

Referring now to FIG. 4, extending across much of the housing assembly is the main body cavity 34 which opens toward the bottom 30. In the embodiment shown, the main body cavity is on the opposite side of the top from the recessed region 31. The main body cavity 34 includes a latch channel 40, a blocker channel 42, a motor retaining region 44 and a battery opening 46 (FIG. 2). The latch channel 40 extends away from the latch opening 54 of the upstand wall 52 and intersects with the blocker channel 42. The latch opening is generally tangent to the upstand wall 52 and extends longitudinally along the main body cavity, with the blocker channel 42 being substantially perpendicular thereto. Of course, other angular relationships are contemplated between the components and it is not necessarily that the components are tangent and perpendicular to each other, or that they align with the outer configuration of the housing assembly, including oblique relationships. The motor retaining region 44 is positioned adjacent to the blocker channel, and is configured to receive and maintain the motor in the proper orientation. A cover 47 can be provided to extend over the main body cavity 34, and may be secured thereto through a plurality of fasteners. The cover or the housing can be coupled to an outside surface through fasteners at either end thereof, and/or through an adhesive (such as double stick tape) that can be applied to the cover 47.

The battery opening 46 is positioned at the second end 22 of the housing assembly and provides ingress to the main body cavity 34. In the embodiment shown, the opening generally has a rectangular cross-sectional configuration that substantially matches the cross-sectional configuration of the main body opening. A flange may extend from the battery opening at the bottom 30 of the housing assembly. The flange includes a plurality of openings that are configured for the receipt of pins or fasteners and the like.

Figure 5:
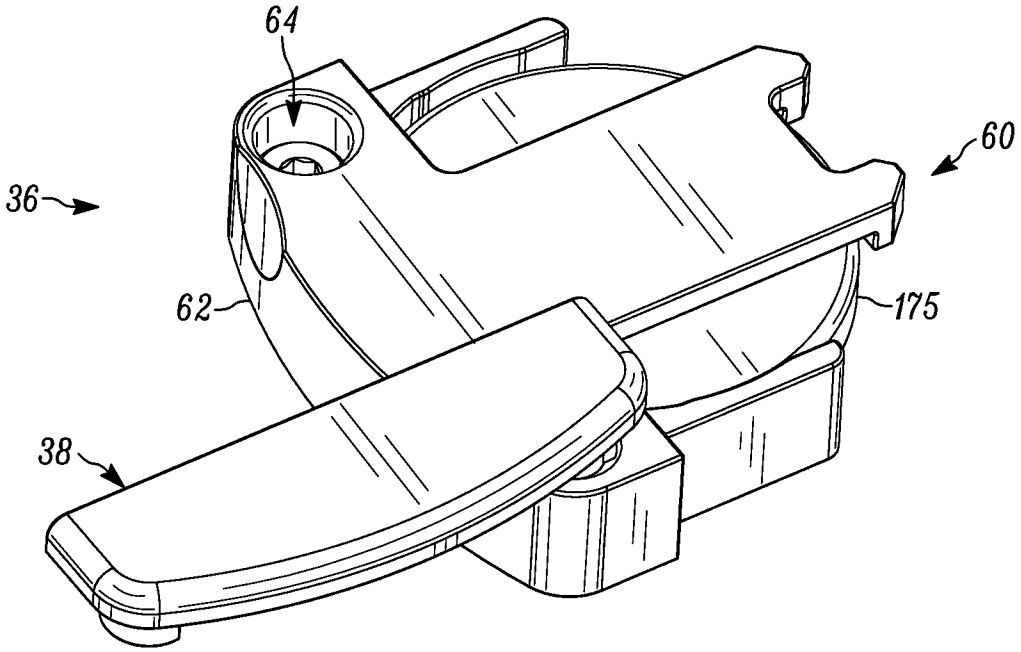
FIG. 5 of the drawings is a top perspective view of the battery housing of the housing assembly of the present disclosure, showing, in particular, the cap in an open position providing access to a fastener which secures the battery housing to the housing assembly at the flange.
Figure 6:
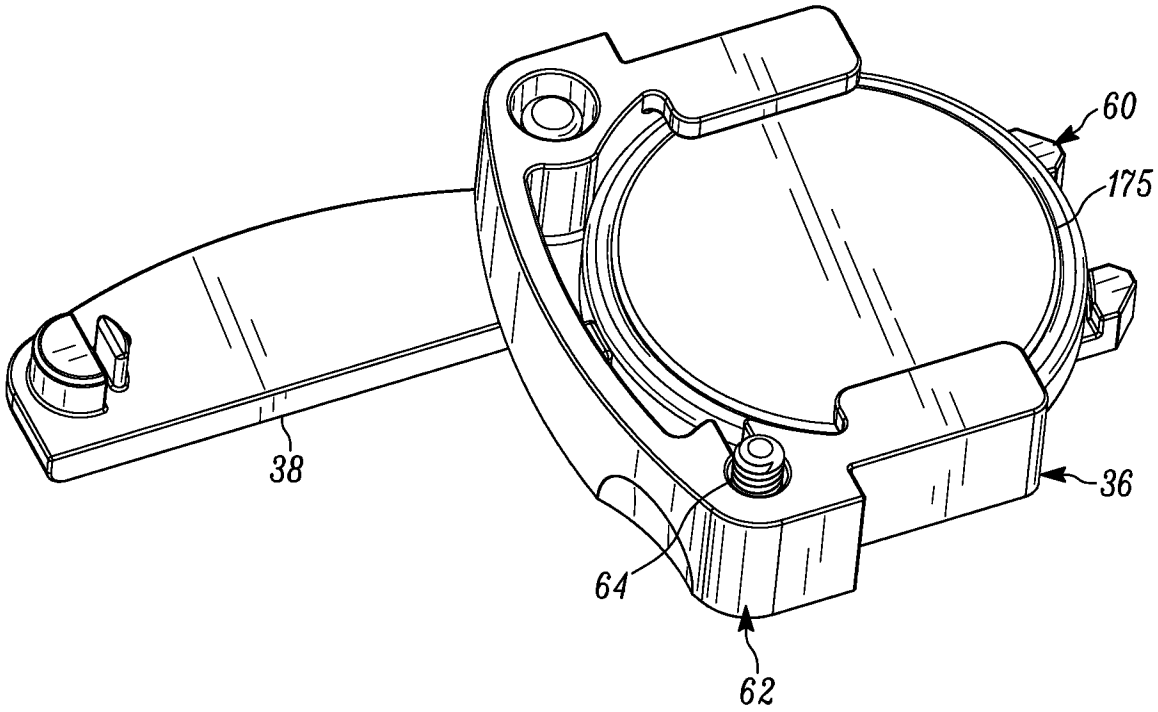
FIG. 6 of the drawings is a bottom perspective view of the battery housing of the housing assembly of the present disclosure, showing, in particular, the cap in an open position providing access to a fastener which secures the battery housing to the housing assembly at the flange.

With reference to FIGS. 5 and 6, the housing assembly 12 further includes a battery housing 36 and an outer cap 38. The battery housing 36 is configured to receive a battery (generally a 3V lithium battery, such as a CR2032 or the like) and to allow for the proper positioning thereof in operation, as well as removal from the housing assembly for purposes of battery replacement. More particularly, the battery housing includes battery cradle 60 and outer region 62. The battery cradle 60 is configured to retain the battery in a stable orientation for coupling to leads that are in electrical communication with electronic control assembly.

The outer region 62 includes a body configuration that fits over the flange and substantially matches the shape of the housing assembly 12 at the first end 20 thereof. The outer region includes an opening which corresponds to one of the openings on the flange 48 so as to allow coupling of the two components with a fastener such as a screw or nut. The removable cap 38 may be positioned over the top of the outer region so as to cover the fastener. In this manner, one must first remove the removable cap to have access to the fastener for disconnecting of the battery housing 36 and, in turn, the battery, from the housing assembly 12, toward removal thereof.

The configuration of the battery housing has a number of functions and advantages. In particular, the battery housing grips and holds the battery, aligns the battery as the battery is inserted into the lock enclosure and insures that the battery makes a proper and secure connection to the contacts of the electronic control assembly. The battery housing additionally helps secure the battery position into the enclosure as it is seated into the enclosure. The battery housing provides means for gripping and withdrawing the battery from the lock enclosure when the changing of the battery is necessary. Advantageously, with the battery housing shown, such a replacement can be achieved without the use of a tool (i.e., tweezers and the like). Furthermore, the battery housing allows for a surface for securing the battery into the lock enclosure with a fastener, and the cap provides a cover for the fastener.

Figure 7:
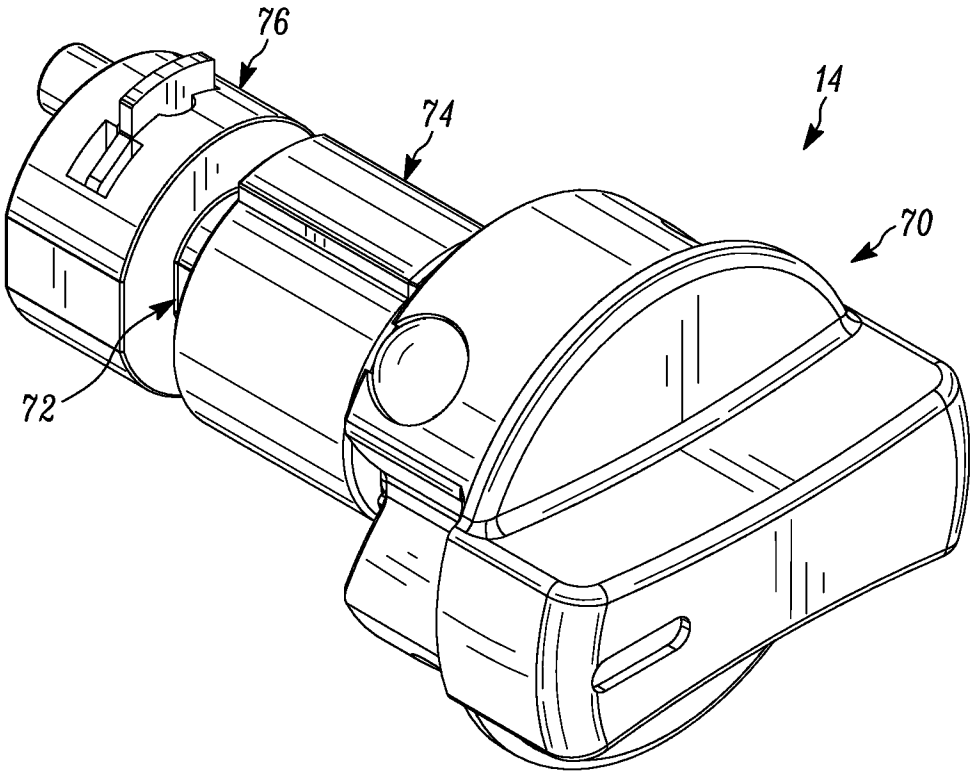
FIG. 7 of the drawings is a perspective view of the actuatable lock assembly of the present disclosure.
Figure 8:
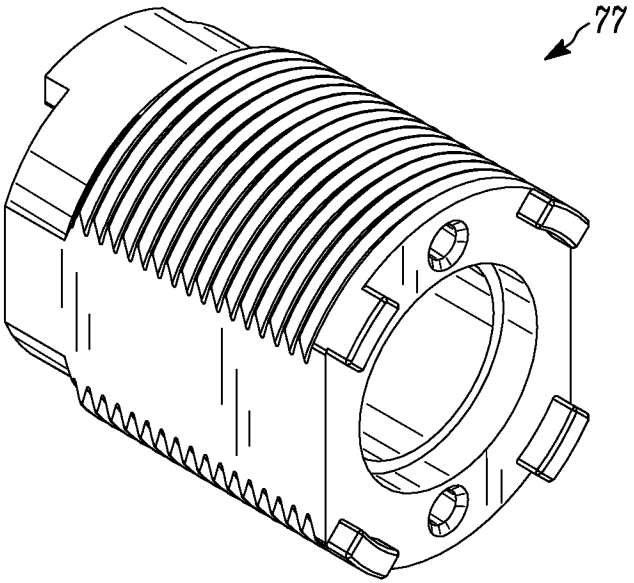
FIG. 8 of the drawings is a perspective view of an existing furniture lock bushing that may be installed on furniture, or other structures which incorporate a lock.

Referring now to FIG. 7 and FIG. 8, the actuatable lock assembly includes knob 70, lock driver 72 and lock spacer 74. These components are coupled to furniture bushing 77. It will be understood that furniture bushing 77 may comprise existing components of an existing furniture lock that has been mounted to the furniture. Advantageously, the present disclosure is directed to an actuatable lock assembly that is configured to fit within the existing furniture bushing 77. Of course, in other embodiments, lock flange and furniture bushing 77 may be provided with the lock. In addition, other configurations that do not utilize the bushing are contemplated.

Figure 9:
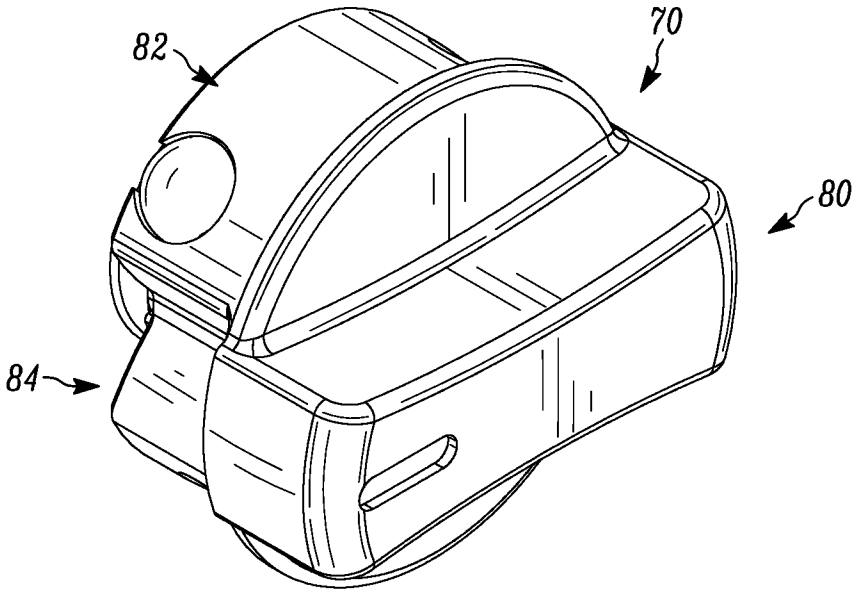
FIG. 9 of the drawings is a front perspective view of the knob of the actuatable lock assembly of the present disclosure.
Figure 10:
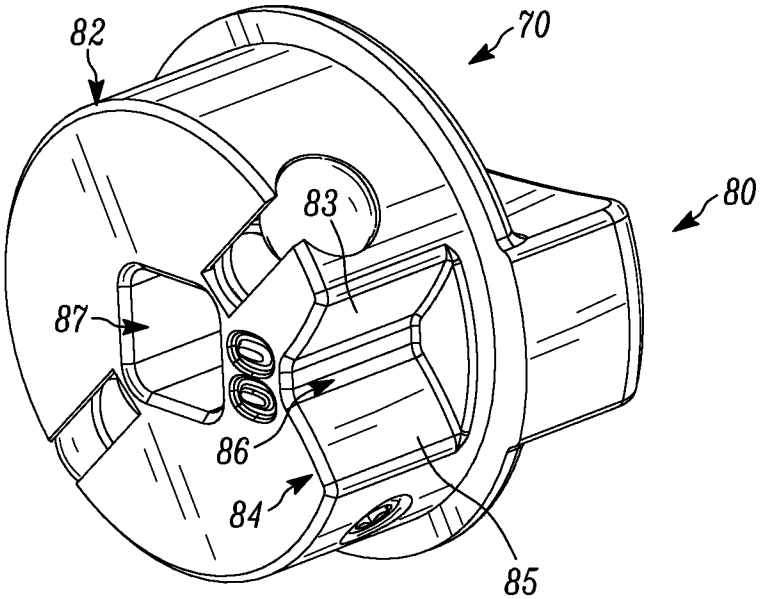
FIG. 10 of the drawings is a back perspective view of the knob of the actuatable lock assembly of the present disclosure.
Figure 11:
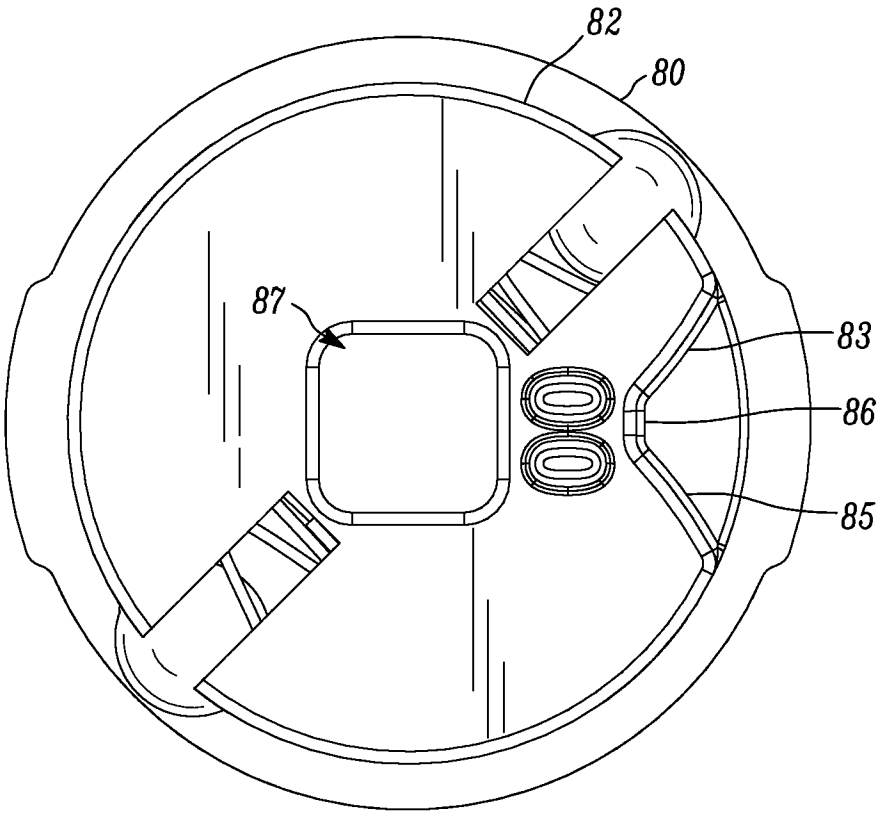
FIG. 11 of the drawings is a bottom plan view of the knob of the actuatable lock assembly of the present disclosure.

Referring now to FIG. 9 through 11, the knob 70 comprises a substantially cylindrical element having an outside surface 80 and dependent skirt 82. As will be explained below the knob 70 is positioned within the cavity defined by the actuatable lock region 32 of the housing assembly 12. The outside surface 80 is configured to facilitate the grasping and rotating thereof by a user, while the knob is in the cavity of the actuatable lock region. In the embodiment shown, the outside surface includes thumb turn regions which are configured to be grasped by the fingers of a user. Of course, a number of different surface configurations are contemplated to accommodate a particular design or a particular application. In another embodiment, in place of a knob, a detachable and reattachable tool can be utilized that plugs into the lock driver when needed. In other embodiments, in place of rotating, the knob can translate in an up and down or right and left configuration. In still other embodiments, the knob may comprise a movement inward and outward (wherein the knob may be biased into an outward position). In each of these embodiments, the movement of the knob (i.e., rotating, translating, moving inward and outward) can be selectively permitted by the positioning of the blocker into the unlocked position.

The dependent skirt 82 extends annularly around the knob 70 below the outside surface 80. The dependent skirt 82 includes axial notch 84 which extends radially inward from the surface of the dependent skirt. The axial notch, as will be explained, is sized so as to receive the distal end of the latch of the latching assembly. The axial notch 84 is defined by two inwardly sloped surfaces, namely, first surface 83 and second surface 85, which meet at vertex 86. In the embodiment shown, the two sloped surfaces are angled relative to each other, defining an angle therebetween. While a number of variations are contemplated, at the dependent skirt, the axial notch defines an approximately 48° arc along the dependent skirt. The vertex 86, in the embodiment shown, comprises a line that is parallel to the axis of rotation of the knob 70 within the cavity of the housing assembly. The surfaces 83, 85 are generally convex surfaces that are configured to shape matingly engage with the distal end of the latch, so that when the knob is turned, the surfaces 83 and/or 85 urge the latch out of the axial notch.

Figure 10B:
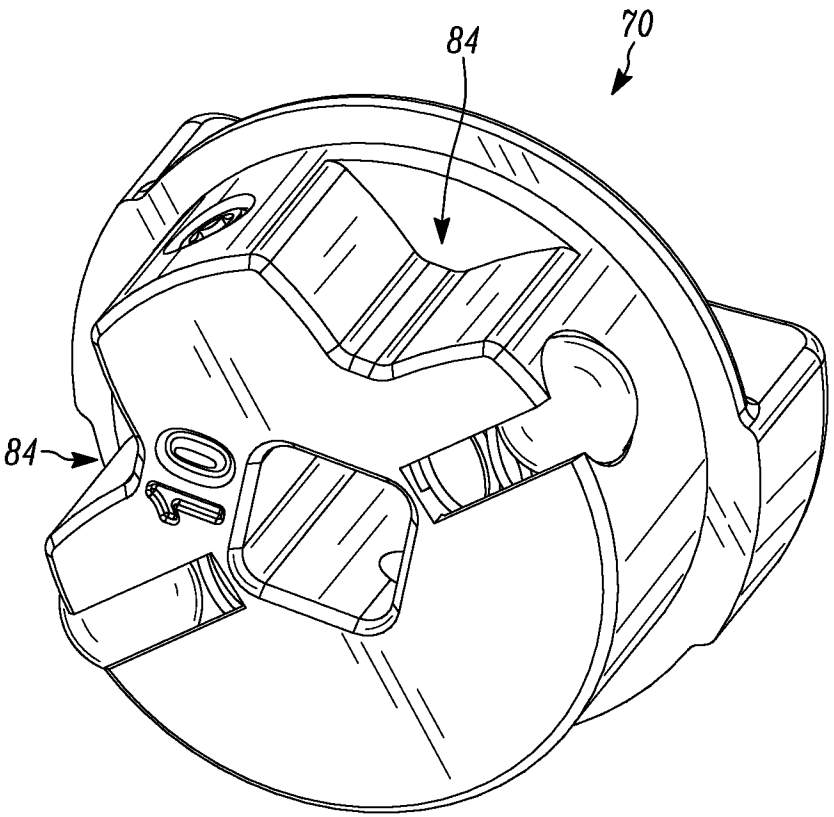
FIG. 10B of the drawings is a back perspective view of an alternate configuration of the knob of the actuatable lock assembly of the present disclosure, showing, in particular, a plurality of axial notches that are spaced apart from each other.

Of course, other configurations are contemplated for the axial notch, which may be paired with a latch having a particular configuration for the distal end thereof. Additionally, it will be understood that even with a configuration like that which is shown in the preferred embodiment, the angle and the length of the axial notch can be varied to achieve a different imparting of force against the distal end of the latch. It will be understood that the knob can be, depending on the embodiment, rotated clockwise or counterclockwise differing degrees of rotation to complete the operation. For example, it may be desirable to have the knob turn 90° or 180° in either the clockwise or counterclockwise direction to achieve the desired operation, however other degrees of rotation are likewise contemplated. Additionally, it is contemplated that the knob includes a plurality of axial notches, such as, for example, two axial notches that are spaced apart (i.e., 90° from each other). In such an embodiment, the blocker can operate in either position of the knob. In one example, such as for a locker application, when the door is unlocked and the knob is moved to the open position, the latch can enter the second axial notch and then the blocker can be moved to a locked configuration. As such, the lock is essentially locked in the unlocked configuration. This provides locking ability in more than one configuration of the knob (and, the associated actuatable lock assembly). One example of such a knob 70 is shown in FIG. 10B, with the axial notch 84 and the second axial notch 84' being shown on the knob 70. Of course, a greater number of axial notches, including, but not limited to three and four axial notches, is likewise contemplated.

The knob 70 may be coupled to the lock driver 72 (FIG. 7) through an interference fit, coupled with a set screw. In particular, the knob 70 includes an axially centered cavity 87 which is configured to engagingly receive the first end of the lock driver. In the embodiment shown, the cavity has a square cross-sectional configuration, such that when the correspondingly shaped first end of the lock driver is inserted, the two structures rotate together. A set screw, or pair of set screws can be extended through the dependent skirt 82 and into the cavity to engage the lock driver and to lock the lock driver in the installed position. Advantageously, access to the set screw is provided by way of a corresponding opening 89 (FIG. 2) on the second end of the housing assembly. It will be understood that the opening of the housing assembly lines up with each one of the set screws on the dependent skirt 82 of the knob 70 when the knob is in a position other than the locked position (that is, the opening can be moved along the second end as long as when locked, the set screw does not match up with the opening). When in the locked position, each of the set screw is offset relative to the opening such that the set screw remains inaccessible. It will further be understood that the set screws provide a means by which to change the effective length of the lock driver. That is, the opening in the knob for receiving the lock driver allows for the lock driver to be inserted and retained by the set screws, at different depths within the opening. As a result, the single structure can accommodate variations in the overall lock depth caused by the application or design.

Figure 7A:
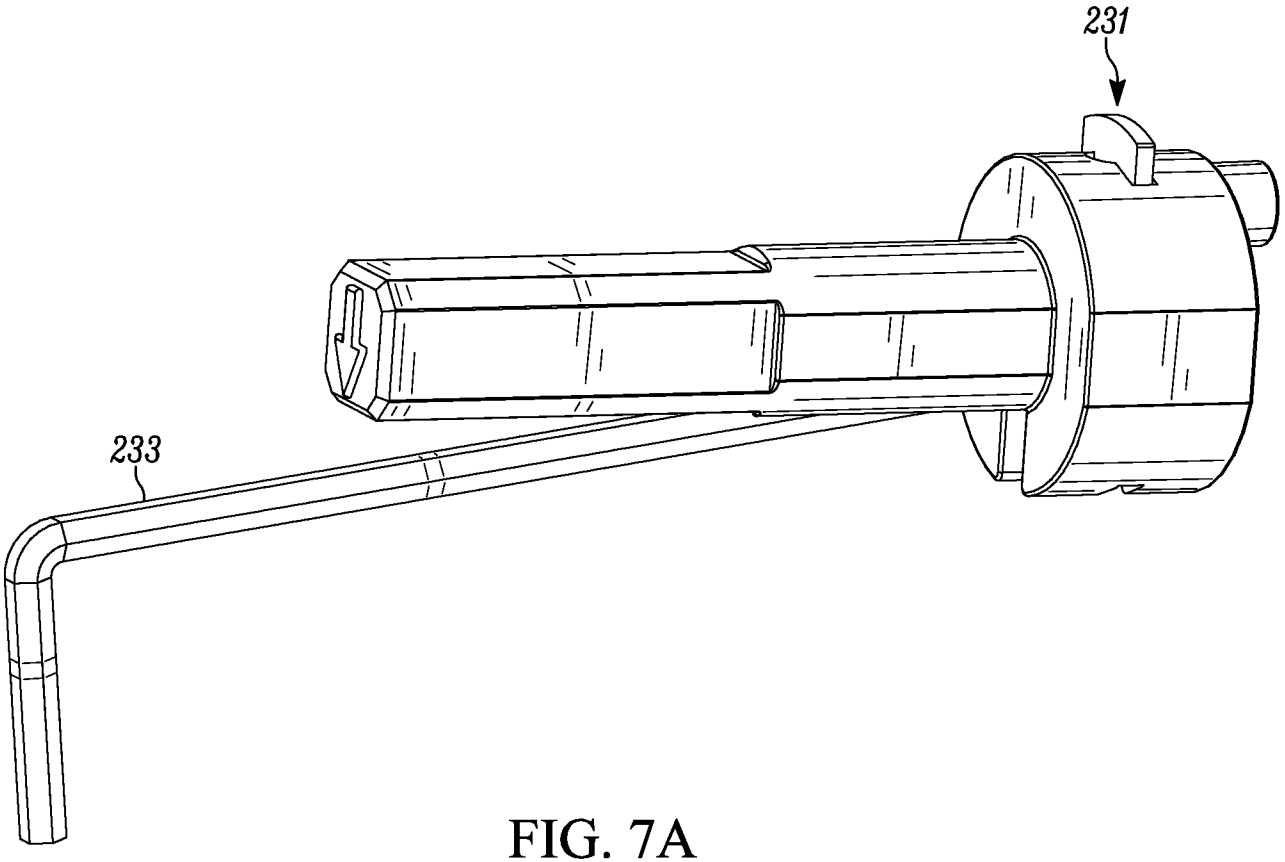
FIG. 7A of the drawings is a perspective view of the lock driver, showing, in particular, the insertion of the attachment tool which can be used to move the master tumbler to allow for insertion into the bushing.
Figure 7B:
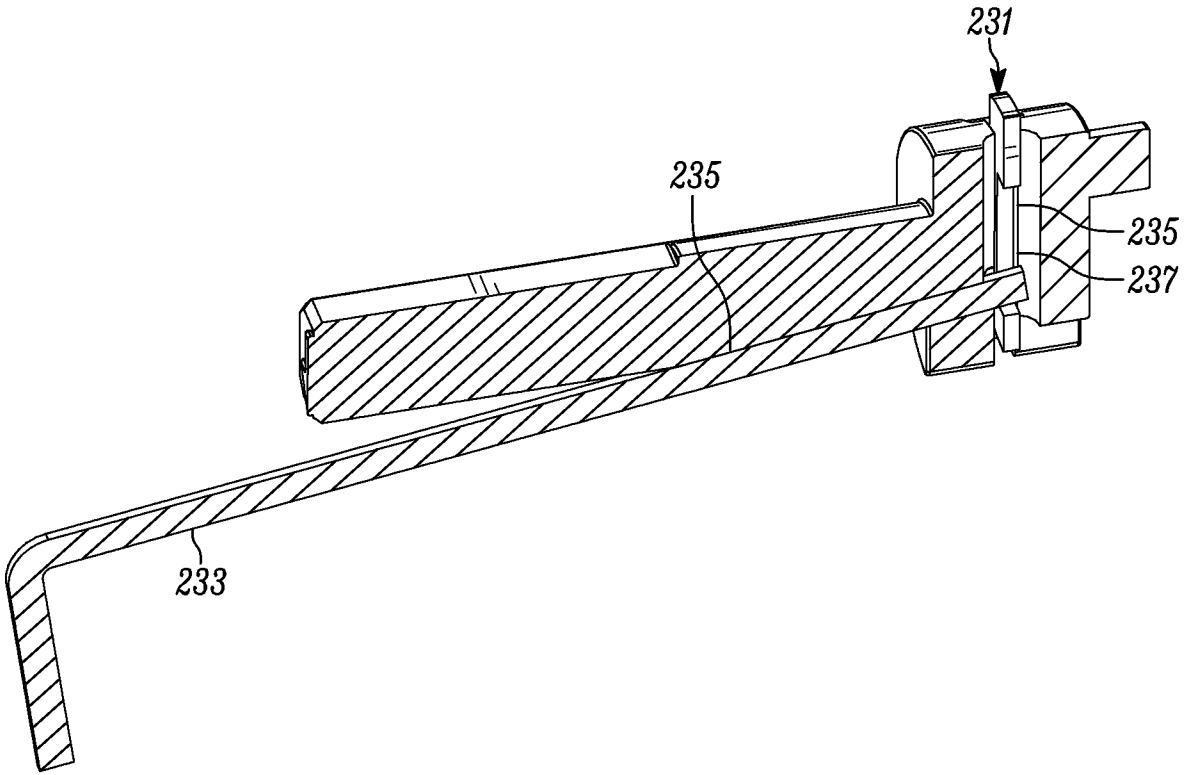
FIG. 7B of the drawings is a cross-sectional view of the lock driver, showing, in particular, the insertion of the attachment tool which can be used to move the master tumbler to allow for insertion into the bushing.

The lock driver 72 is shown in greater detail in FIGS. 7A and 7B as comprising master tumbler 231 which is slidably mounted in a channel that extends perpendicular to the axis of rotation of the lock driver in operation. A tool 233 is configured to be directable through a slot 235 in the lock driver so as to extend through opening 237 in the master tumbler 231. The master tumbler 231 is biased by a spring (or other biasing member) so as to have an end stick out beyond the lock driver 72. As such, when the lock driver 72 is inserted into the bushing, the tool can be utilized to overcome the biasing member and to pull the master tumbler into the lock driver 72. Once in the driver, the lock driver can be inserted into the bushing. Once inserted, the tool 233 can be removed, and the spring will return the master tumbler to an orientation that extends out of the lock driver and interfaces with an axial channel in the bushing, which maintains the lock driver in engagement with the bushing so that it can rotate about its axis without being able to move axially. The tool can be reinserted to move the master tumbler so as to have the end thereof exit the axial channel of the bushing, so as to remove the lock driver from the bushing. In other embodiments, the lock driver 72 can be manipulated or tilted for installation purposes.

The lock spacer 74 is positionable along the lock driver and couples to the furniture bushing 77 while allowing adjustment to compensate for slight variations in the depth of the furniture bushing. The lock spacer includes a tumbler flange which is configured to engage the furniture bushing to allow relative rotative movement while precluding axial movement of the lock relative to the furniture bushing. More particularly, the spacer flange serves to fit into the grooves in the bushing that will interlock into the flange and into the grooves in the housing. With such a configuration, in the event that someone applies a force to the external housing, the force will be transferred from the housing to the spacer and to the furniture bushing, but not to the lock driver, therefore maintaining the security of the lock. This is due to the free rotation of the spacer around the driver. Additionally, the spacer precludes radial movement.

Figure 12A:
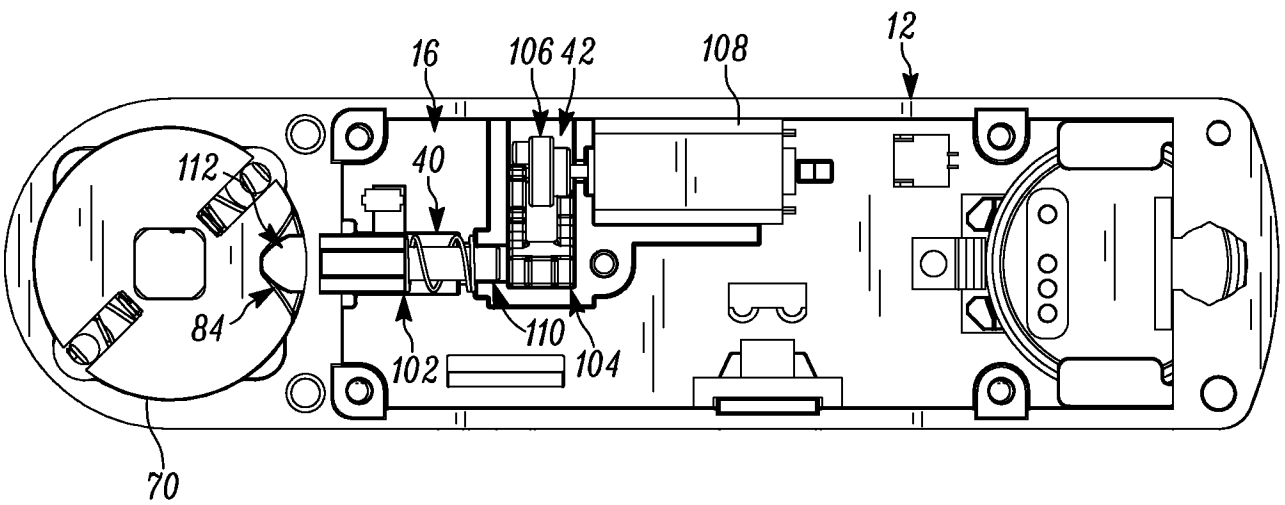
FIG. 12A of the drawings is cross-sectional view of the lock showing, in particular, the latching assembly as mounted within the housing assembly and interfacing with the knob of the actuatable lock assembly of the present disclosure, showing the lock in a locked position.
Figure 12B:
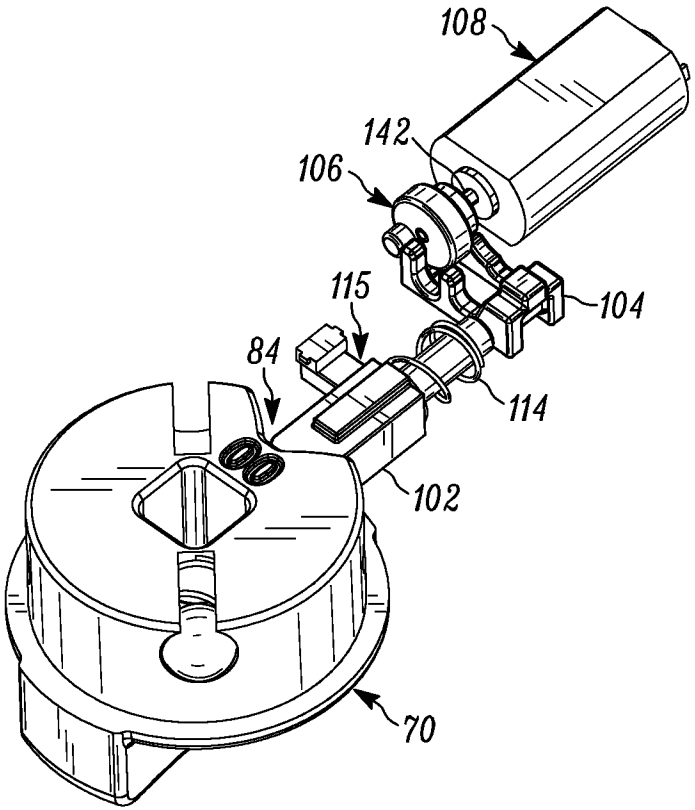
FIG. 12B of the drawings is a perspective view of components of the latching assembly and the knob of the actuatable lock assembly in the locked position.
Figure 13A:
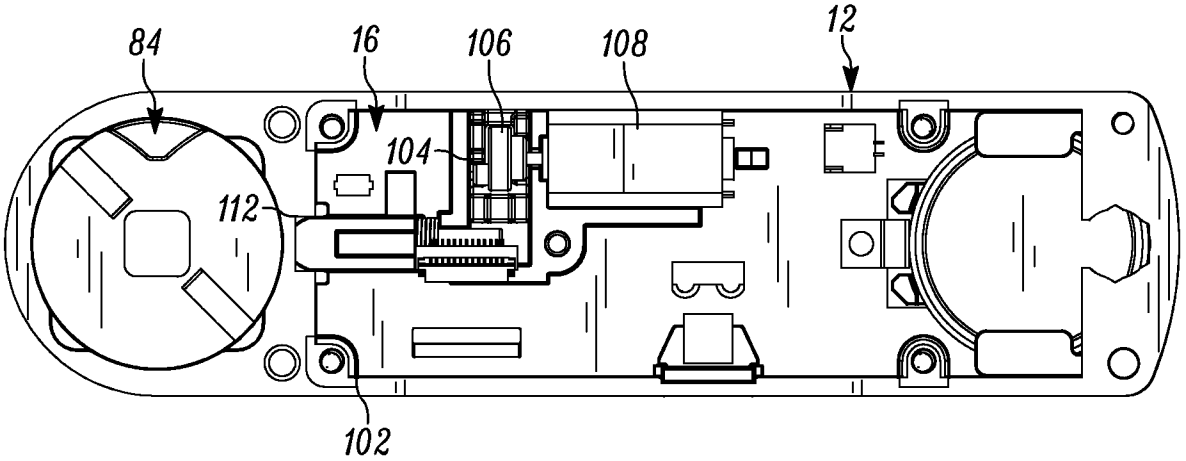
FIG. 13A of the drawings is a cross-sectional view of the lock showing, in particular, the latching assembly as mounted within the housing assembly and interfacing with the knob of the actuatable lock assembly of the present disclosure, showing the lock in an unlocked position.
Figure 13B:
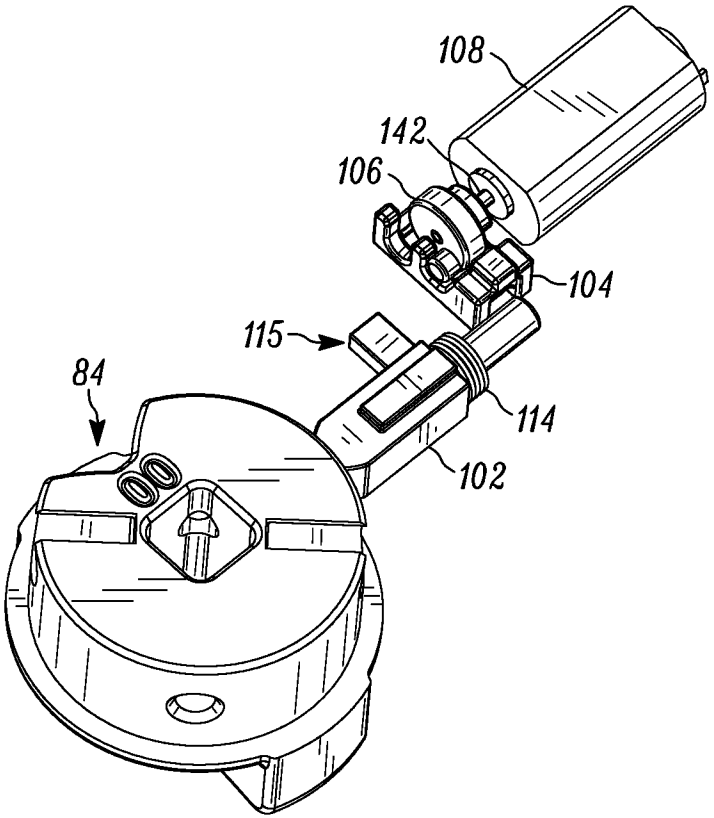
FIG. 13B of the drawings is a perspective view of components of the latching assembly and the knob of the actuatable lock assembly in the unlocked position.
Figure 14:
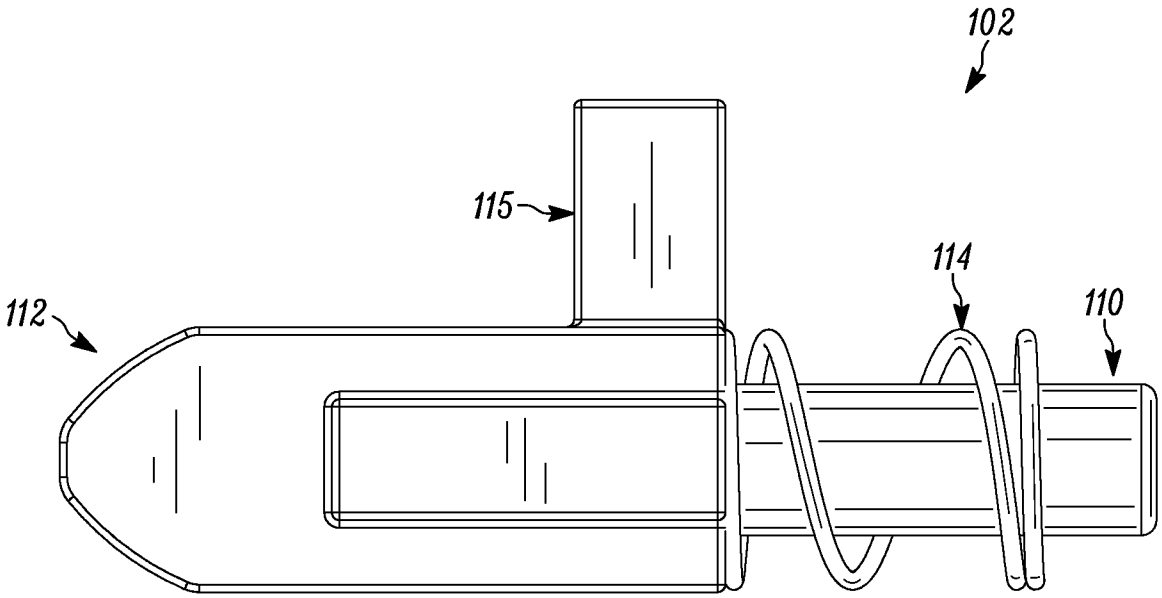
FIG. 14 of the drawings is a side elevational view of the latch of the present disclosure, shown with the biasing member extending around a portion thereof.

Referring now to FIGS. 12A, 12B, 13A and 13B, the latching assembly 16 is shown as comprising latch 102, blocker 104, cam 106 and motor 108. It will be understood that FIGS. 12A and 12B show the blocker in the locked position, and, the FIGS. 13A and 13B show the blocker in the unlocked position. The latch 102 includes proximal end 110 and distal end 112. The latch 102 is positioned within the latch channel 40 and is slidably movable therewithin. In the locked position, which is shown in FIGS. 12A and 12B, and as will be explained, the distal end 112 of the latch 102 extends into the axial notch 84 of the knob 70. The proximal end 110 is configured to interface with the blocker 104. With further reference to FIG. 14 a biasing member, in the form of a compression spring 114 extends between the latch and the housing assembly so as to bias the distal end of the latch toward and into the knob 70. Additionally, a flag or flange 115 extends transversely from the latch. As will be explained, the flag 115 interfaces with a position sensor and provides to the position sensor the orientation and position of the latch. In other embodiments, other mechanism may be utilized for monitoring the position of the latch and/or knob, such as, for example, detecting directly the position of the knob.

Figure 15:
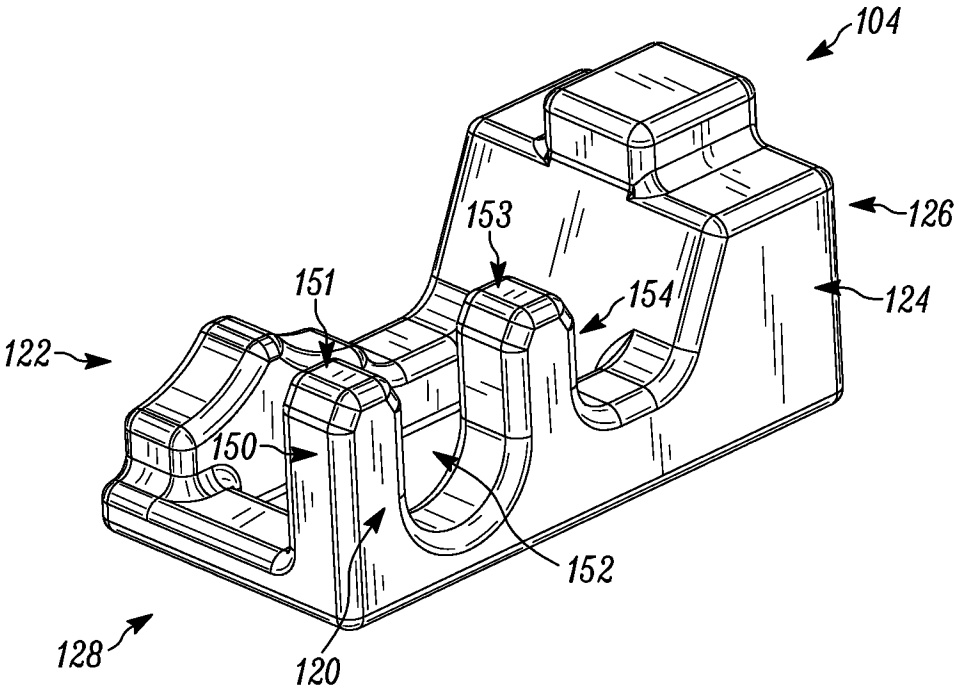
FIG. 15 of the drawings comprises a front perspective view of the blocker of the present disclosure.
Figure 16:
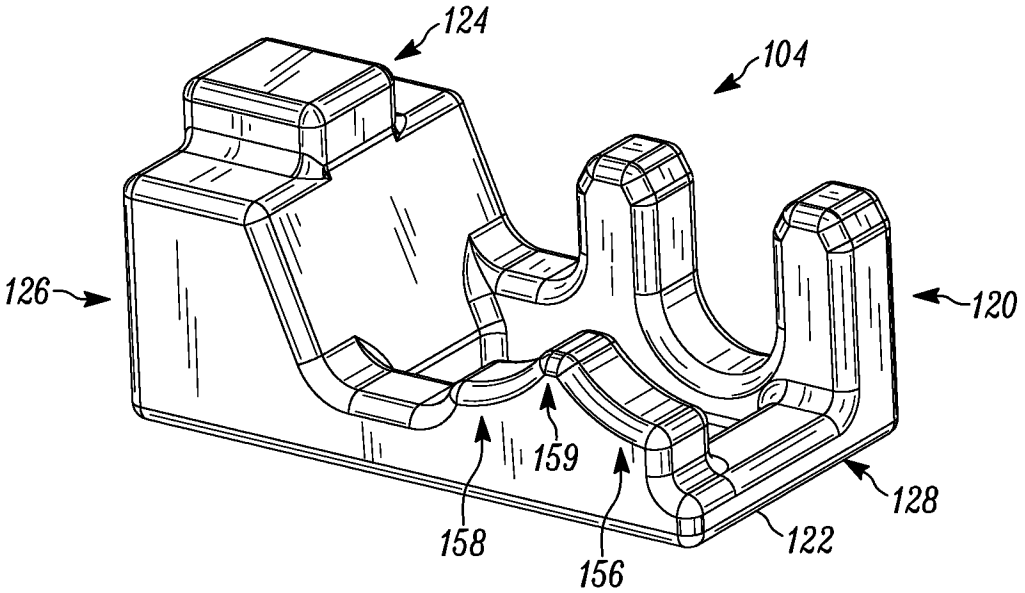
FIG. 16 of the drawings comprises a back perspective view of the blocker of the present disclosure.

With reference to FIGS. 15 and 16, the blocker 104 is shown as comprising first cam profile 120, second cam profile 122, latch engagement body 124. The latch engagement body 124 is positioned at a second end 128 of the blocker 104. The first cam profile 120 extends between the first end 126 and the latch engagement body 124. Similarly the second cam profile 122 extends between the first end 126 and the latch engagement body 124 in a generally parallel and spaced apart orientation from the first cam profile. The spaced apart orientation of the two cam profiles defines a longitudinal channel therebetween. It will be understood that the cam body rotatably extends through the longitudinal channel as the followers thereof interact with the first and second cam profiles.

The first cam profile 120 includes first slot 150, second slot 152, and third slot 154. A first ridge 151 is defined between the first slot 150 and the second slot 152. A second ridge 153 is defined between the second slot 152 and the third slot 154. In the embodiment shown, the first slot 150 is formed on the outside of the first ridge 151, however, provides a single sided slot function. The second cam profile 122 includes first ramp 156, second ramp 158 and peak 159 positioned therebetween.

In the embodiment shown, the blocker comprises a metal member, such as zinc or the like. Of course, other materials are contemplated. It will be understood that the blocker is the component that precludes latch movement in the event that the knob is attempted to be rotated in the locked position so as to defeat the lock. As such, the latch engagement body 124 may comprise a solid member that provides the necessary strength to overcome the forces that may be exerted against the knob and, in turn, the latch.

Figure 17:
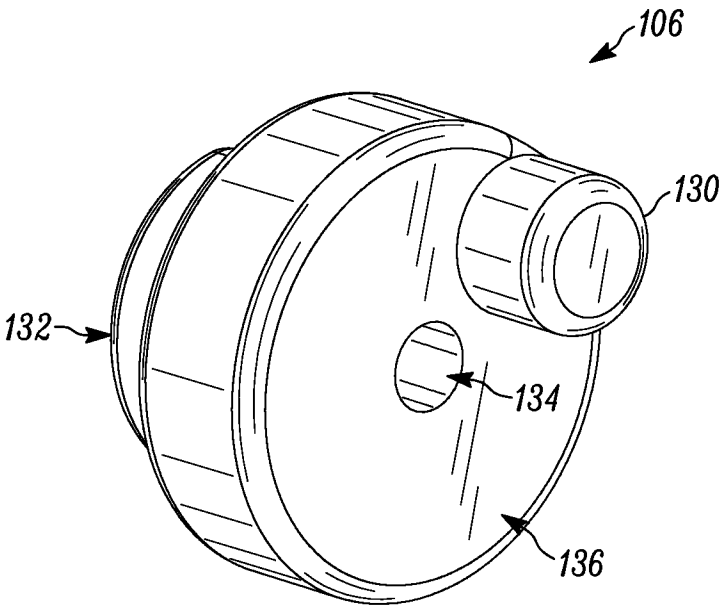
FIG. 17 of the drawings comprises a front perspective view of the cam of the present disclosure.
Figure 18:
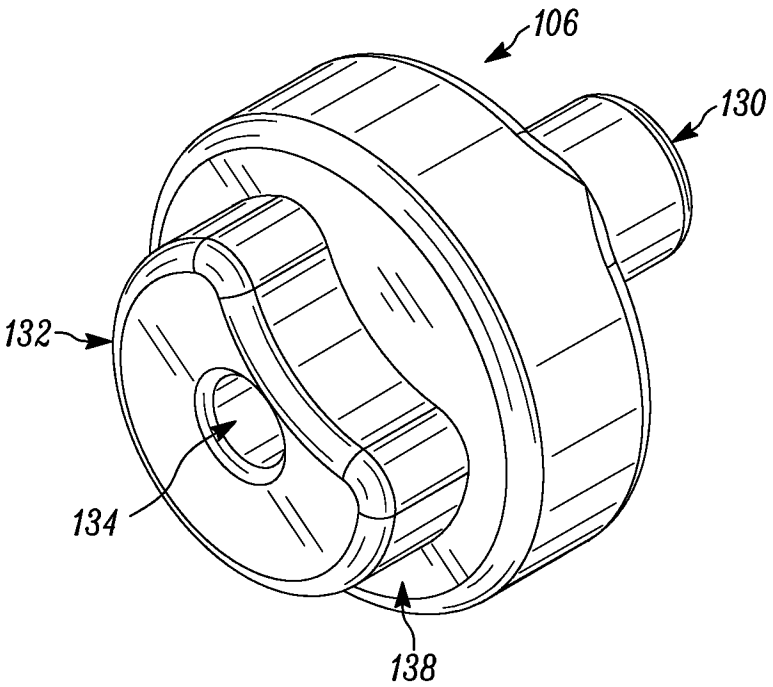
FIG. 18 of the drawings comprises a back perspective view of the cam of the present disclosure.

With reference to FIGS. 17 and 18, the cam 106 includes a body having a first side 136 and a second side 138, and, an axis of rotation 134. The first side includes first follower 130 and the second side includes second follower 132. With reference to FIGS. 12B and 13B, the cam is rotatably coupled to the motor 108 about axle 142. It will be understood that the motor is positioned within the motor retaining region with the axle extending into the blocker channel. With continued reference to FIGS. 12A, 12B, 13A and 13B, the cam 106 is positioned so that the body is within the longitudinal channel between the first and second cam profiles, the first follower 130 is configured to interface with the first cam profile 120 and the second follower 132 is configured to interface with the second cam profile 122. As can be seen in FIGS. 19A through 19E, sequentially, and as will be explained below in greater detail, as the motor rotates the cam 106, the cam 106 intermittently connects the first follower with the first cam profile, to, in turn, translate the blocker within the blocker channel.

It is contemplated that other cam profiles and other cam follower configurations may be utilized to achieve the intermittent interaction therebetween, to, translate the blocker along the blocker channel between a blocking position and a released position. It is further contemplated that the position of the two cam profiles can be swapped. Additionally, the blocker may have a alternate configurations for the first cam profile or the second cam profile. For example, additional slots may be presented, and corresponding ridges to increase the stroke of the blocker movement through additional rotation and interaction with the cam, if necessary.

Figure 20:
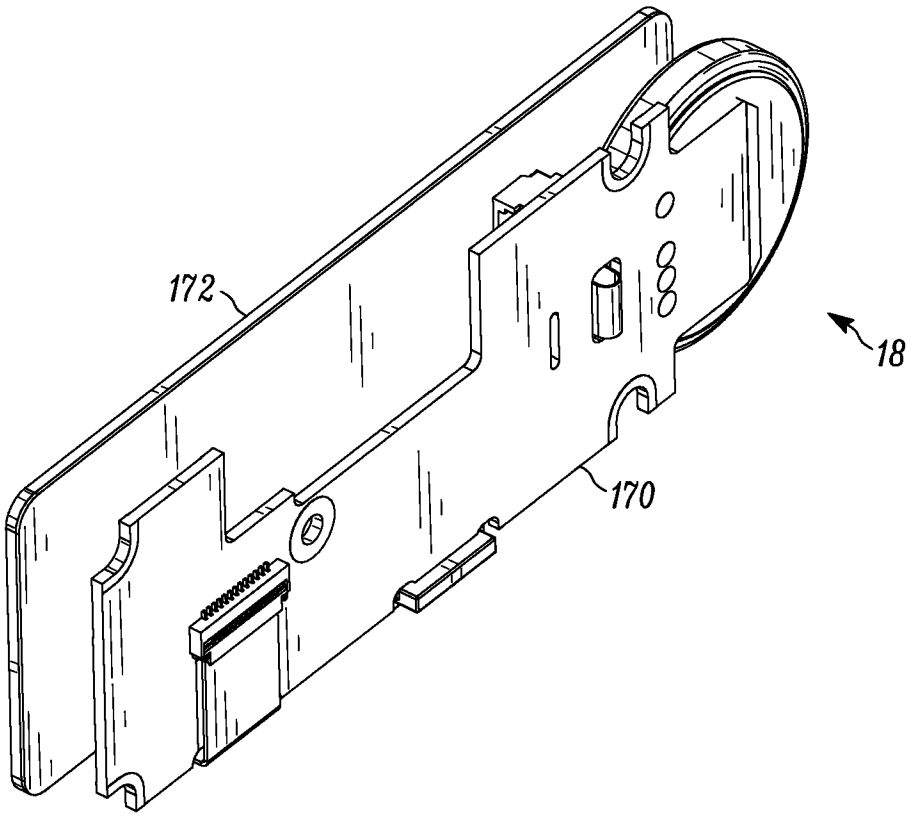
FIG. 20 of the drawings comprises a front perspective view of the electronic control assembly of the present disclosure.
Figure 21:
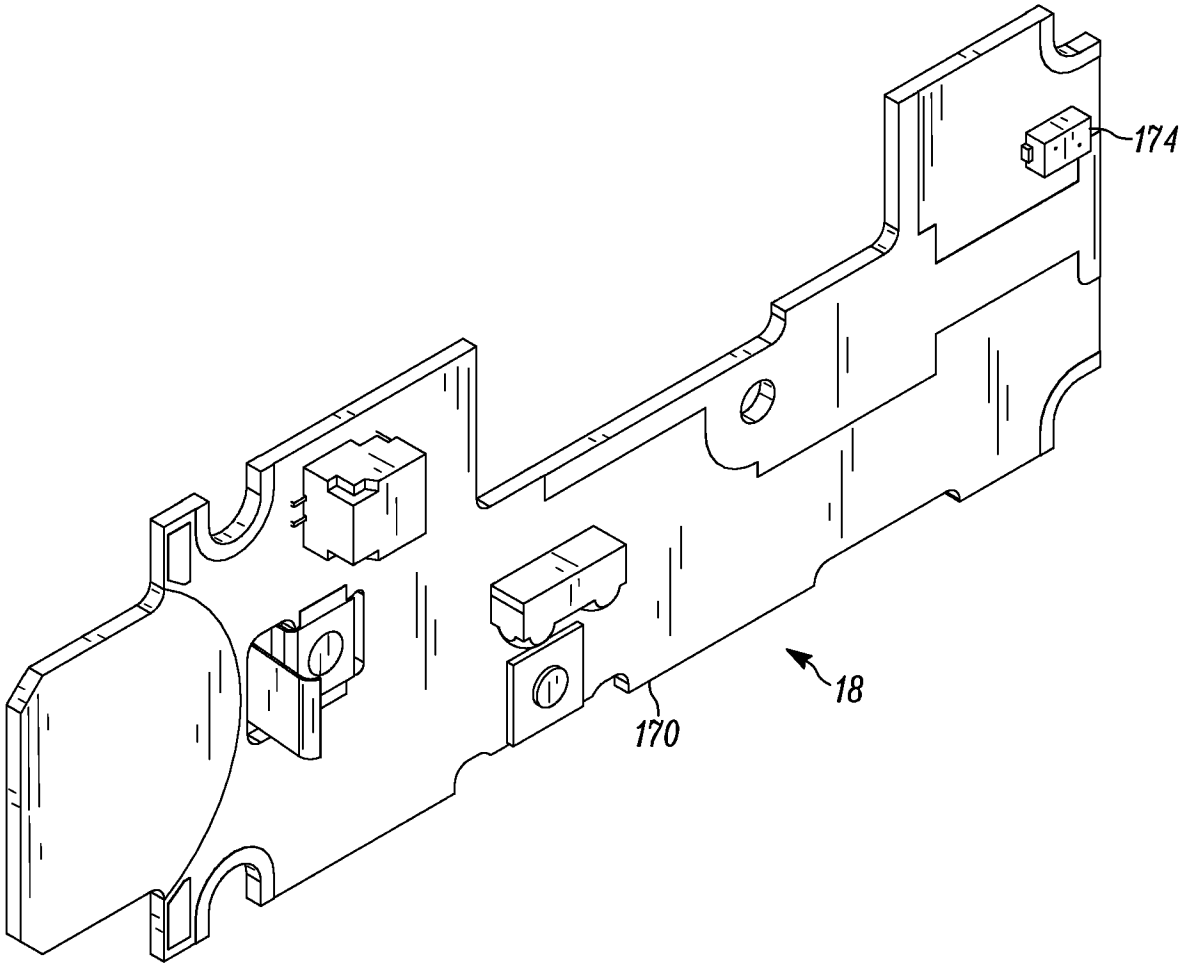
FIG. 21 of the drawings comprises a front perspective view of the PC board of the control assembly of the present disclosure.
Figure 22C:
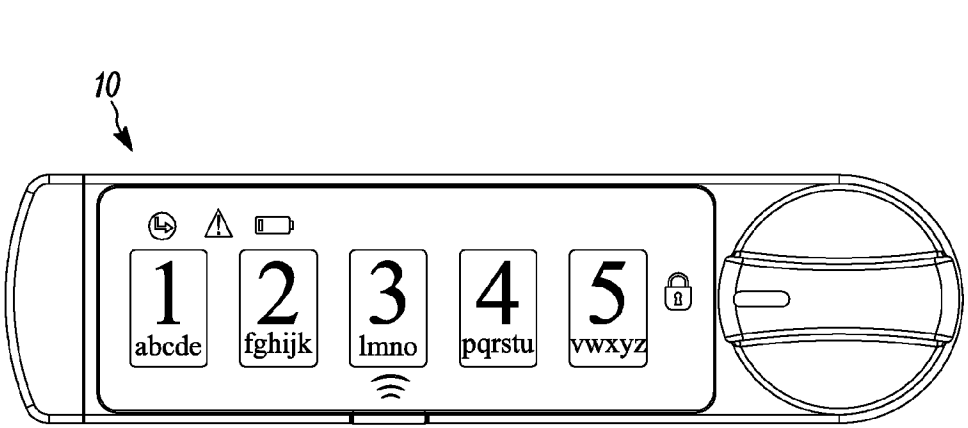
FIG. 22A through 22D of the drawings are top plan views of the lock of the present disclosure in four different orientations, a vertically upward orientation, a vertically downward orientation, a horizontal orientation in a first direction and a horizontal orientation in a second direction.
Figure 22D:
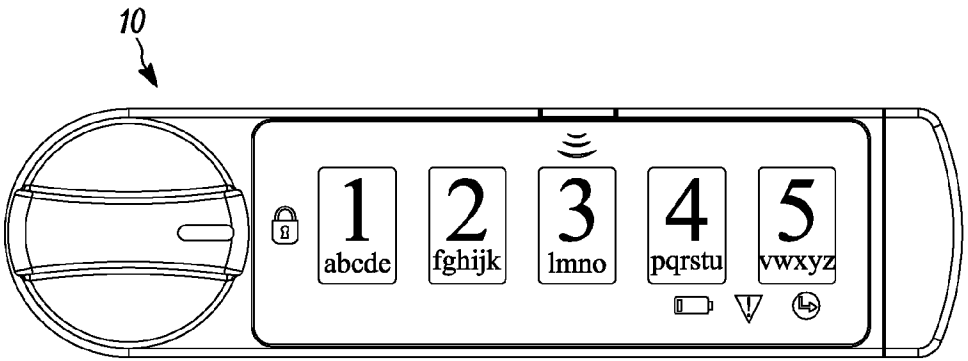
Figure 22B:
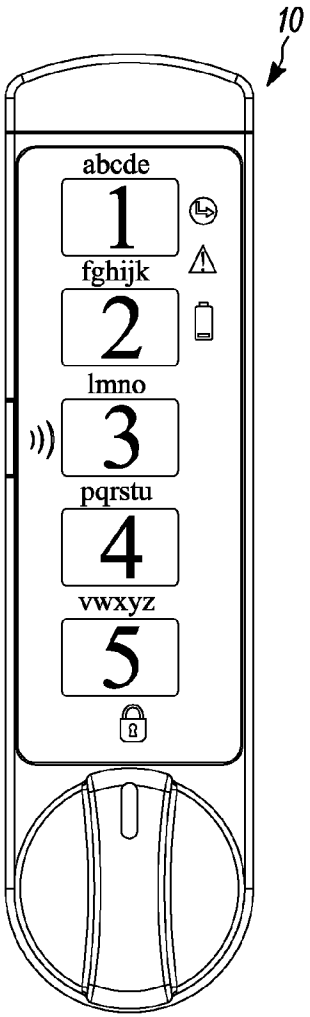
Figure 22A:
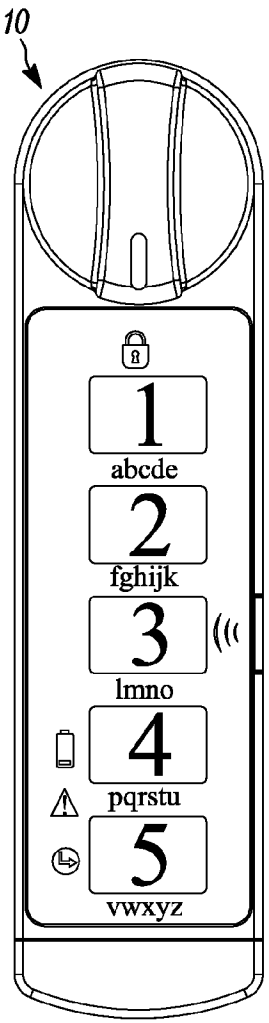

Referring now to FIGS. 20 and 21, the electronic control assembly 18 includes electronic PC board 170, input device 172, and latch position sensor 174. The PC board 170 includes the logic necessary to understand and process the signals coming from the input device 172 and the latch position sensor 174, so as to appropriately direct the actuation and direction of the motor 108. The configuration and design of such PC boards to achieve the desired functions set forth below are known to those of skill in the art. The input device 172 may comprise a keypad having a plurality of keys (in the embodiment shown, a total of five sequentially numbered keys). The input device 172 further includes a receiver for receipt of wireless signals (i.e., IR, RF, Bluetooth, zigbee, among others). More specifically, the keypad comprises an outer surface that has a thin-film metallic and polyester or polycarbonate surface configuration to resist damage and wear over the course of millions of cycles, and to provide resistance to solvents and chemicals, as well as to deter static charges (due to the relatively high dielectric strength). The combination of metallic and polyester properties on the outer surface can be provided by application of a metallic silver mirror ink on a polyester film to provide a low gloss look, textured surface with resistance to impact, scratching, scuffing, dents, ultraviolet light, and fingerprinting. Since the metallic surface is relatively thin (i.e., 150-200 micron) it may be applied by a printing process, and thus the keypad and the lock would be light-weight. The application of the metallic ink can be in a brushed or grain look running north-south or east-west. Below the outer surface a plurality of metallic conductive domes and conductive pads are provided to create the switch function.

The latch position sensor 174 is positioned in an orientation that is in a close relationship with position flange 115 (FIG. 12B) such that the sensor can determine the orientation and position of the latch relative to the housing assembly (and, as such, the knob). It is contemplated that the sensor is positioned on the PC board. The PC board is configured to reside within the main body cavity of the housing assembly.

It will further be understood that a position sensor can be configured to sense the position of the latch, which in turn, provides indirect feedback to detect at least two positions of the knob. Alternatively, a sensor can also detect one or more flags directly on the knob to detect at least two positions on the knob. The position sensor, it is contemplated may be of the optical type. To prolong the life of the battery, it is contemplated that the sensor intermittently detects the position and a change in position (i.e., a few milli-seconds every 1-2 second period). Of course, the sensor can be configured for a different intermittent interval, or may be configured for a continuous or generally continuous sensing.

In operation of the preferred embodiment, the lock is disposed in an operational environment, such as, for example, a desk. The housing assembly may be coupled to the furniture through any number of different means. It is contemplated that a double stick tape may be utilized on the cover 47 or fasteners may be extended through the furniture (or other structure in a different use) and into a corresponding bore of the housing assembly. In other embodiments, both double stick tape and threaded fasteners may be utilized. In addition, other means by which to couple the lock are contemplated. It will further be understood that the housing assembly can be mounted in any number of different orientations relative to the furniture bushing. For example, and as is shown in FIGS. 22A through 22D, the housing assembly may extend to the right or left, or vertically upward or downwardly. Other orientations (i.e., angular) are likewise contemplated.

Initially, with reference to FIGS. 12A and 12B, portions of the lock are shown in the locked configuration. In such a configuration, the blocker is in the blocking position, at the locked end of the blocker channel. The latch 102 is positioned within the latch channel with the distal end 112 of the latch 102 biased by the biasing member 114 into the axial notch 84 of the knob 70. The latch is precluded from slidable movement within the latch channel 40, as the blocker is positioned so as to extend through the latch channel and limiting the slidable movement of the latch within the latch channel. In some embodiments, the proximal end 110 of the latch 102 abuts the latch engagement body 124. In other embodiments, the biasing member 114 maintains a small separation between the latch and the blocker. Regardless of the interface, the blocker precludes the movement of the latch so that the distal end of the latch remains within the axial notch 84.

Figure 19A:
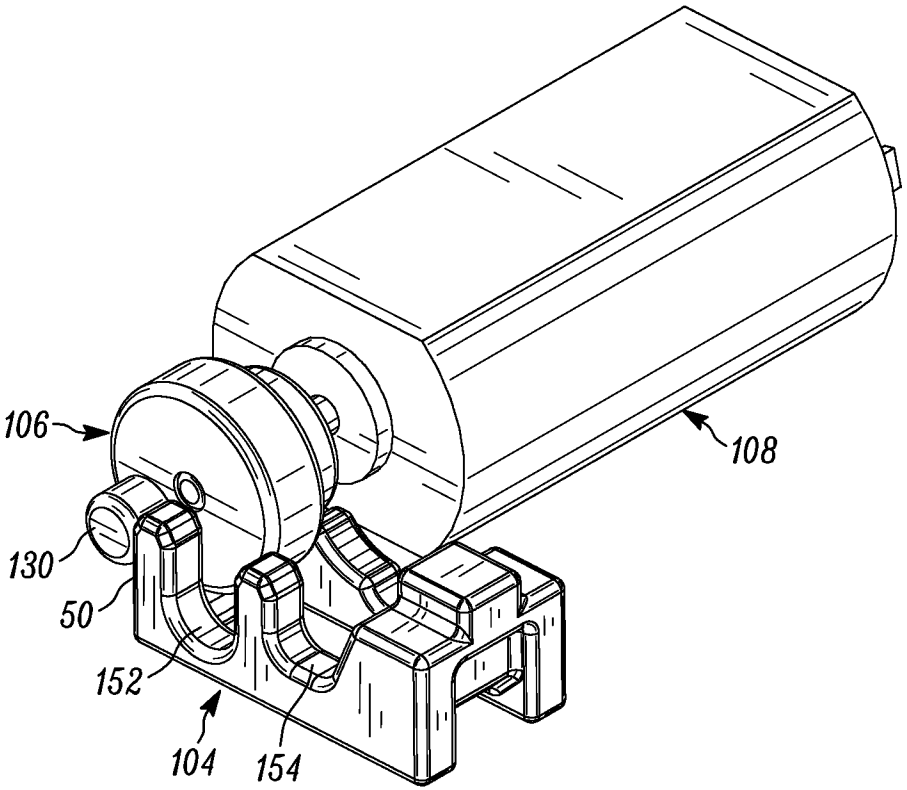
FIGS. 19A through 19E comprise sequential perspective views of the blocker, the cam and the motor as the cam and blocker move from the locked position to the unlocked position.

Additionally, in the locked configuration, the cam 106 is rotated such that the first follower 130 engages the first cam profile at the first slot 150. At the same time, the second follower engages the first ramp 156. Such a configuration is also shown at FIG. 19A with respect to the motor, cam and blocker. As will be explained below, the sequence of moving the blocker from a locked position to an unlocked position is achieved through rotation of the cam through approximately one and one half revolutions (although variations are contemplated which require lesser or greater revolutions of the cam and the motor.

To unlock the lock so that the locking flange 76 can be rotated, the user must direct the PC board to initiate an unlocking procedure. In one embodiment, a particular code or combination of keys is depressed in a particular combination to provide the necessary authorization to the electronic control assembly. In other embodiments, a wireless signal may be sent to the PC board via the input device 172. Regardless of the method of communicating the proper combination or code for initiating the unlocking procedure, once the procedure is initiated, the position of the latch is determined through sensor 174, and the motor is actuated.

Figure 19B:
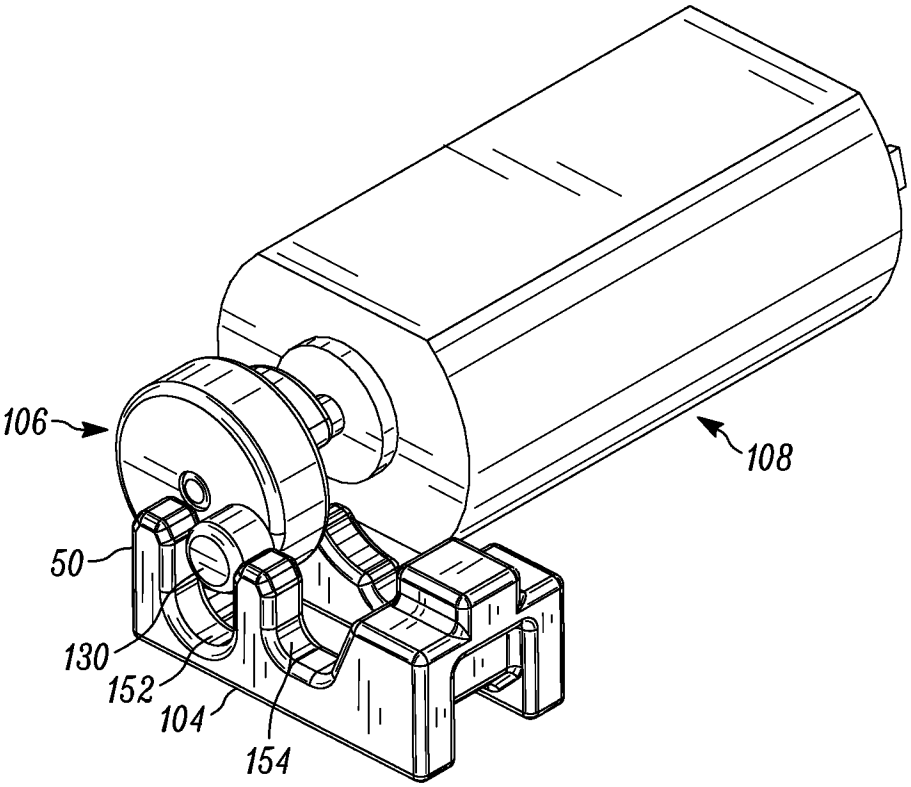
Figure 19C:
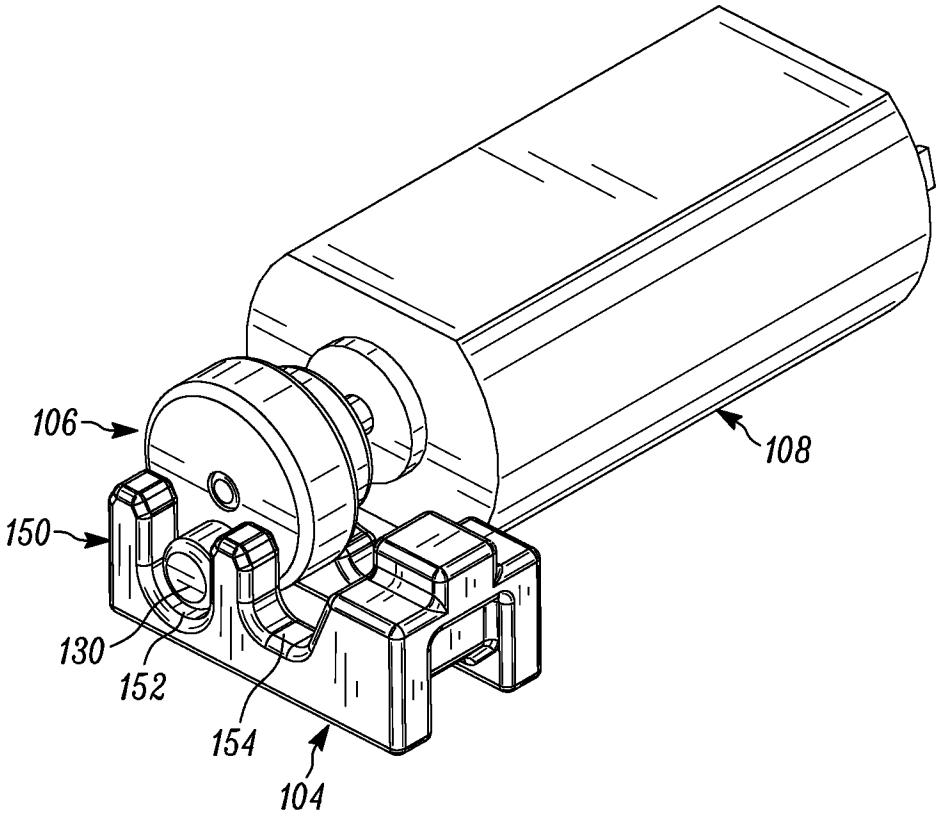
Figure 19D:
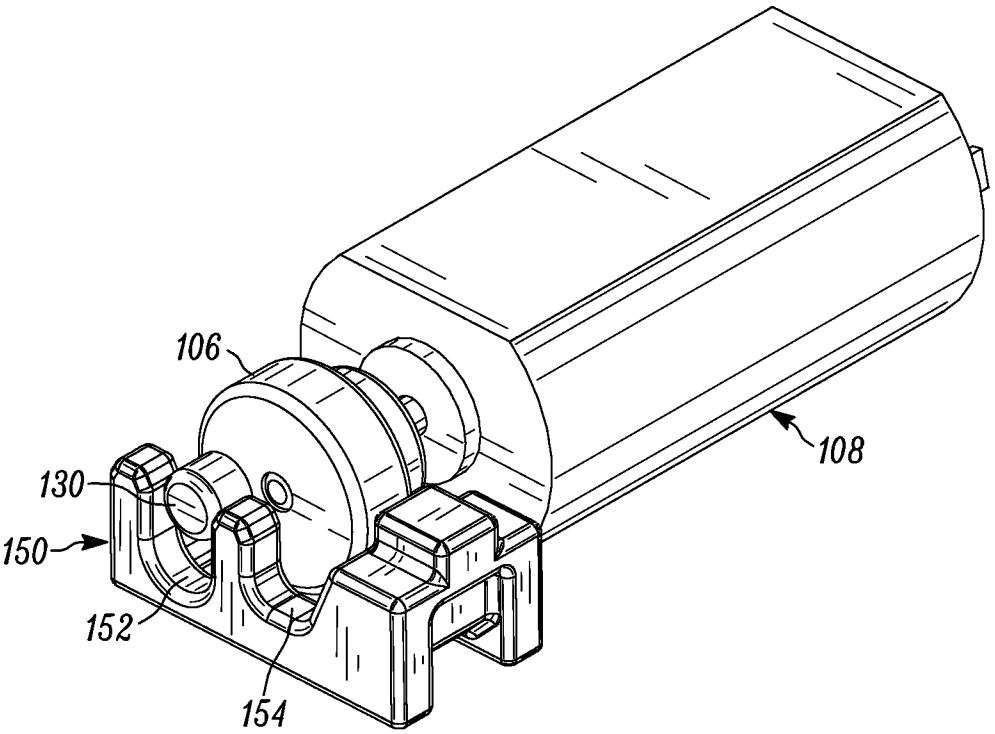

When the motor is actuated in a first direction, the cam 106 rotates in a first direction disengaging the first follower 130 from the first slot 150 (FIGS. 19A and 19B), the motor continues to rotate, and the first follower 130 eventually enters into the second slot 152 (FIG. 19B). Eventually, the continued rotation of the cam 106 with the first follower 130 positioned in the second slot 152 begins to translate the blocker 104 along the blocker channel 42 (FIGS. 19C and 19D). It will be understood that, advantageously, the cam 106 rotates through an arcuate distance prior to engaging the first cam profile with force being directed upon the blocker in a translating direction. In the embodiment shown, the cam 106 rotates through about a half turn prior to initiating the translation of the blocker. Advantageously, the motor is allowed to initiate rotation without load, such that momentum can be built up, which momentum is sufficient to initiate translation of the blocker. Such a momentum building, relatively load free, initiating step removes the need to utilize a gear train to reduce the speed of the cam or to increase the torque applied by the cam. Rather, a direct drive of the cam by the motor (which greatly simplifies the construction) can be utilized.

Figure 19E:
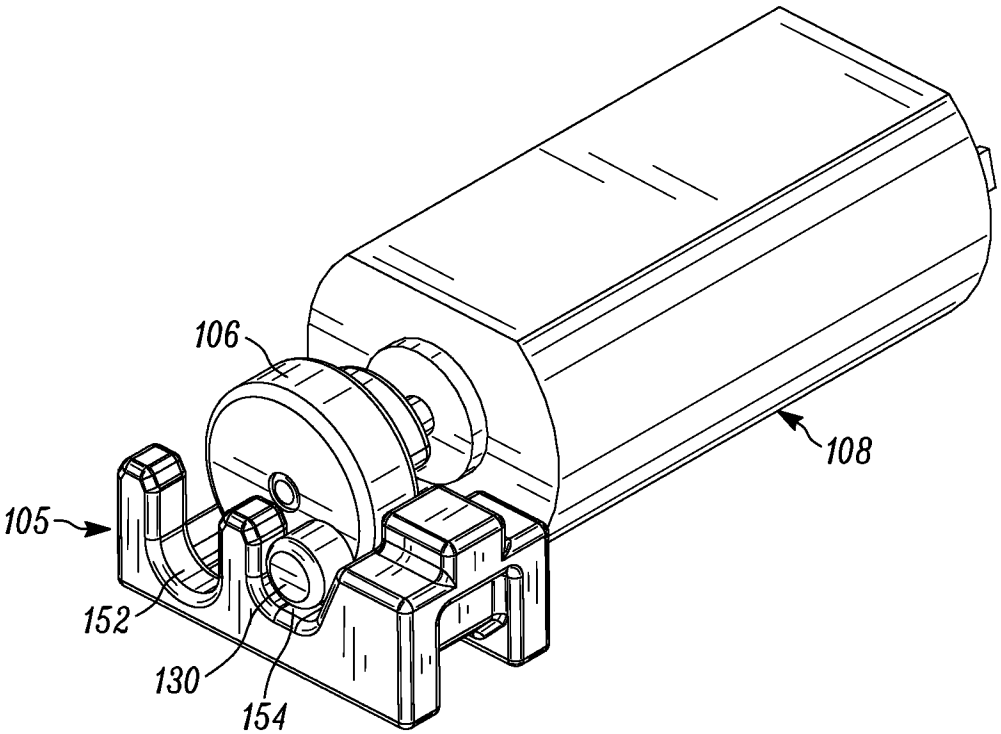

As the rotation of the cam 106 continues, eventually, the blocker continues to translate due to the interaction of the first follower 130 within the second slot 152 of the first cam profile. Eventually, the first follower 130 reaches a point, as does the blocker 104 wherein the first follower 130 no longer exerts a force on the blocker 104 to translate further (FIG. 19D). Shortly thereafter, the first follower 130 exits from the second slot 152 and continued rotation directs the first follower 130 into the second slot. When the first follower 130 is fully inserted into the second slot, further movement is precluded (FIG. 19E). The PC board senses that the first follower is in such a position (i.e., through a sensing of the draw of the motor, or through other means, such as a sensor or the like). The PC board then directs the motor to cease rotation. In another embodiment, a timer can trigger the motor circuit to de-energize the motor. It will also be understood that the cam follower 132 interacts with the second cam profile, and the ramps in order to retain the blocker in proper alignment with slots 152, 154, when the follower is outside of the slots 152, 154, and also prior to entry into these slots.

The blocker is now in the unlocked orientation shown in FIGS. 13A and 13B. That is, the blocker is moved out of the path of the latch channel, and the latch can be slidably moved within the latch channel. The engagement of the cam 106 with the third slot 154 and the interaction of the second follower 132 with the second cam profile, maintains the blocker in the unlocked configuration.

In such a configuration, and with reference to FIG. 13A, the user can initiate rotation of the knob 70 to move the locking flange into an unlocked position. As the user initiates rotation of the knob 70, the first surface 83 or the second surface 85 (depending on the direction of rotation being clockwise or counterclockwise) imparts a force on the distal end 112 of the latch 102. The two surfaces are angled such that the imparting of force includes a force component in the longitudinal direction of the latch 102. In turn, the continued rotation of the knob pushes the latch 102 out of the axial notch, overcoming the biasing means. There is no blocker to preclude the slidable movement of the latch, and, as such, the knob can force the latch out of the way so that the latch does not preclude movement of the knob. As the knob is further turned, unimpeded, the locking flange can be moved into an unlocked position.

Due to the biasing member 114, the distal end 112 of the latch 102 is directed toward the knob. In the unlocked condition, the distal end of the latch remains in contact with the dependent skirt 82 of the knob 70. At the same time, the blocker 104 is maintained by the cam 106 in the unlocked position to preclude interference with or impeding of the latch.

To relock the lock, the user turns the knob back so as to direct the lock flange 76 into the locked position. Eventually, the knob is returned to an orientation wherein the axial notch 84 of the knob aligns with the latch 102, and the distal end of the latch extends into the axial notch 84. In the embodiment shown, the position sensor 174 (FIG. 24) in cooperation with position flange 115 senses the position of the latch within the axial notch. In such an orientation, the latch has traveled toward the knob such that the distal end thereof is outside of the blocker channel 42.

Next, the motor is activated again, by the electronic control 18, in the opposite direction from the direction of rotation during unlocking. The steps shown in FIGS. 19A through 19E are carried out in reverse. Namely, the cam 106 is rotated by the motor, and the first follower 130 exits the third slot, extends over the second ridge 153 and enters the second slot 152 (FIGS. 19E and 19D). Continued rotation imparts a force upon the blocker having a component in the direction of the locked position and the blocker slidably moves toward the locked position along the blocker channel (FIG. 19C). Eventually, the blocker reaches a translated position wherein the cam 106 no longer slidably moves the blocker (FIG. 19B). In such a position, further rotation of the cam 106 directs the first follower 130 to exit the second slot, traverse over the first ridge 153 and returns to first slot 150 (FIG. 19A).

Similar to that which was explained above with respect to the unlocking procedure, during the locking procedure, the cam 106 rotates an arcuate distance without the first follower 130 imparting a force on the first cam profile of the blocker. As such, the cam can gather speed, and in turn, momentum, such that when the cam enters the second slot 152, the cam has sufficient force to impart onto the blocker to translate the blocker. Such an intermittent contact with the first cam profile, and intermittent application of a translational force allows for the use of a directly driven cam, and a motor smaller than would otherwise be required. Furthermore, the consumption of power from the battery is reduced for each cycle as compared to a rack and pinion with constant engagement and application of force therebetween.

Once in the first slot 150, the cam 106 is precluded from rotation as the blocker has reached the locked position (i.e., the end of travel of the blocker along the blocking channel). Thus, while rotation is precluded, the motor continues to impart a rotational force on the cam 106, thereby increasing the power draw. The electronic control 18 realizes the increased power draw by the motor as a signal that the blocker has returned to the locked position. In turn, the power to the motor ceases.

In this position, the blocker 104 is in a position that precludes slidable movement of the latch sufficient to move the latch out of the axial notch 84 to allow rotation of the knob 70. Any rotation of the knob by the user will translate to translative movement of the latch into contact with the blocker which will stop the movement of the latch while the distal end remains in the axial notch 84.

It will be understood that the electronic control 18 may be programmed in any number of different manners. In addition to the operation above, other operation configurations are contemplated. For example, in a setting such as a locker room, it is desirable for each user of a locker to be able to input his or her own code for each use. As such, while the mechanical locking and unlocking steps are the same as disclosed above, the blocker movement is initiated by differing conditions.

More particularly, initially, the locker may be closed and the lock flange may be in the locked configuration. However, the blocker may be in the unlocked position, thereby allowing the rotation of the knob 70. Once the knob 70 is rotated and the lock flange 76 is in the unlocked position, the latch is driven out of the axial notch and the position sensor 174 senses that the latch has been moved out of the axial notch.

At such time, the operation may direct the user to input a new unlocking key sequence on the keypad of the input device. This input sets the code for the operation of the lock through the next cycle. Once the code is input, the electronic control is programmed to execute the locking procedure the next time that the knob is rotated into a locked position and the latch is biased into the axial notch 84. More specifically, the motor is activated and through the cam 106, the blocker is translated into the locked position.

To re-unlock the lock, the user must provide the authorization through an unlock code (or another code to over-ride the communication to the electronic control). Once the code is provided, the motor is activated in the other direction, translating the blocker to the unlocked position. At the same time, the electronic control is ready for another cycle. That is, the electronic control is ready to receive a new code from the user through the input device. As such, a new code is applied each time the lock cycles between the locked and unlocked configuration.

It may, from time to time, be necessary to service the lock. To service the lock the knob is first removed from the housing assembly. As explained above, a set screw or multiple set screws, maintain the engagement of the knob 70 and the lock driver 72. The set screw is accessible through the opening on the second end of the housing, but only when the knob 70 is in a particular rotative position to line up the set screw with the opening. It will be understood that, to preclude access to the set screw, except when the blocker is in the unlocked position, the opening and the set screw are not in alignment when the knob is in the locked condition.

As can be seen in the figures, the lock is configured to extend through a bushing (also referred to as a shell) held by a cabinet or enclosure (not shown). The actuatable lock assembly is configured can be connected and disconnected from the bushing. Advantageously, a portion of the actuatable lock assembly is within the cabinet or enclosure with a portion of the actuatable lock assembly outside of the cabinet or enclosure, when coupled to the bushing. The latching assembly as discussed above is positioned within a housing assembly. The housing assembly extends along the outside of the cabinet or enclosure.

The actuatable lock assembly includes a longitudinal axis that generally corresponds to the axis of rotation thereof (although not required). The housing assembly likewise includes a longitudinal axis. The longitudinal axis of the actuatable lock assembly is substantially perpendicular to the longitudinal axis of the housing assembly.

Figure 23:
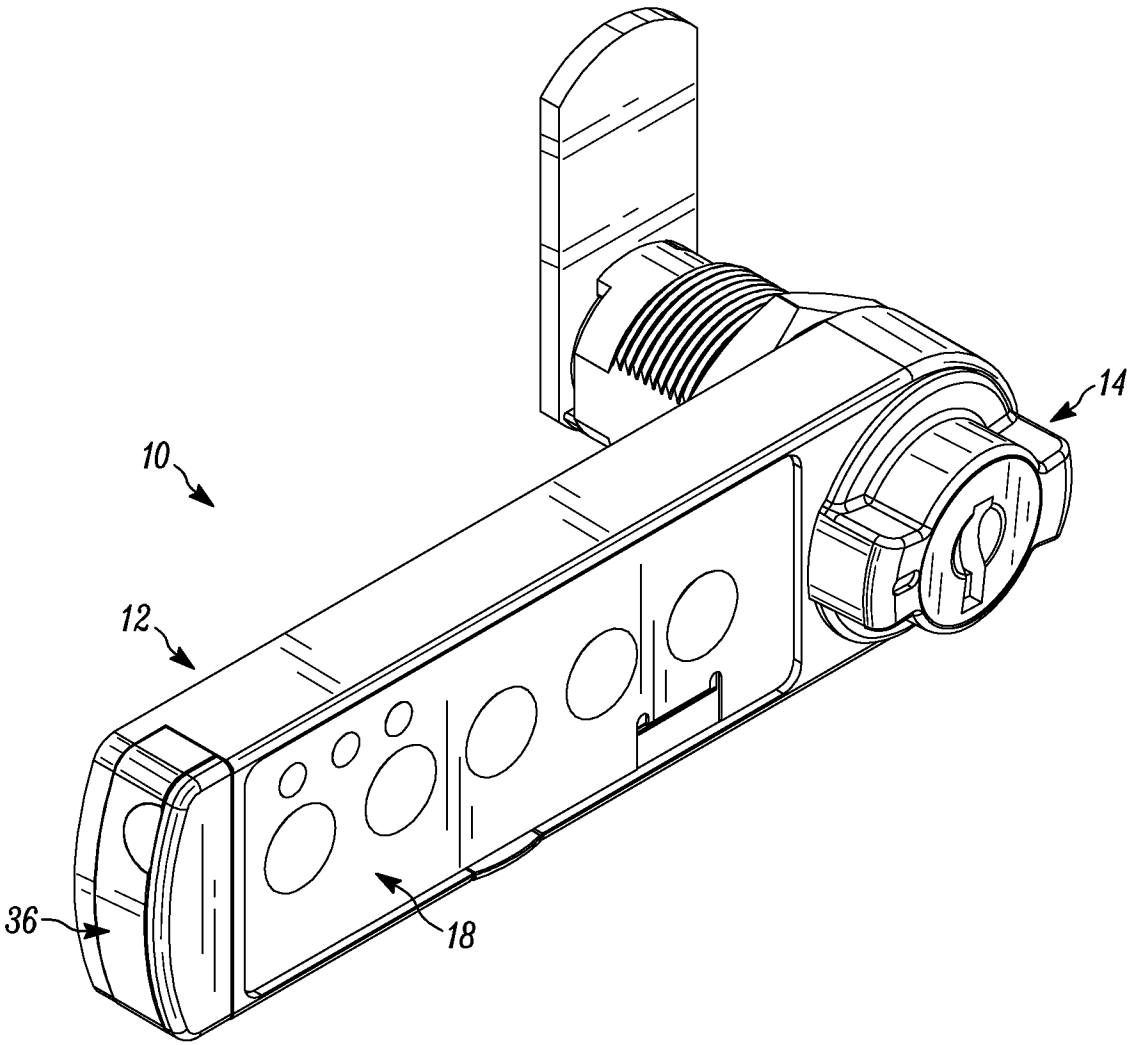
FIG. 23 of the drawings is a perspective view of an alternate embodiment of the lock, showing, in particular, an actuatable lock member having a mechanical key over-ride.
Figure 24:
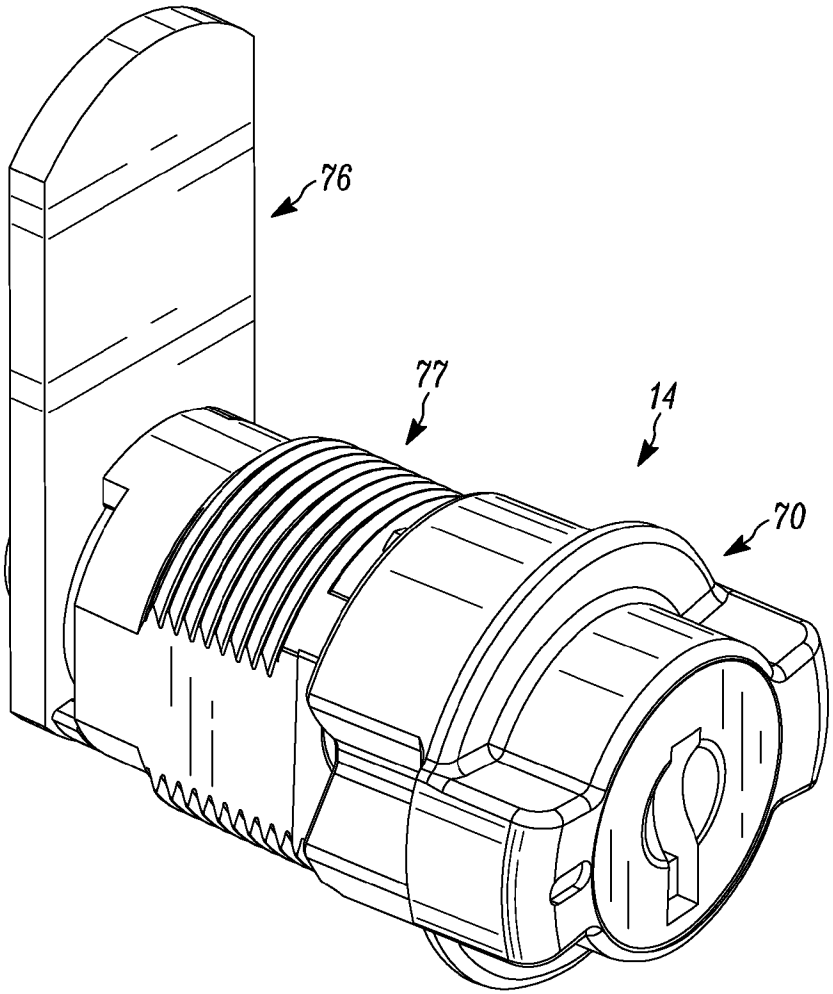
FIG. 24 of the drawings is a perspective view of an alternate embodiment of the actuatable lock member of the type shown in FIG. 27A with a key inserted therein.

In the embodiment shown in FIGS. 23 and 24, a key override can be provided to over-ride the electronic locking function. In such an embodiment, a lock core controlled by a mechanical key can be integrated into the actuatable lock assembly 14. Such a configuration allows the lock to be unlocked even if the blocker is in the locked position, precluding slidable movement of the latch along the latch channel. Insertion and turning of the mechanical key in the lock core allows the tumblers in the lock core to retract and allow the core to rotate. The lock flange rotates with the key while the knob remains in its locked configuration, due to the latch and blocker position. In a related embodiment, the rotating of the lock core causes movement to the blocker so that the latch can be freely moved out of the axial notch of the knob to allow functional rotation of the knob. It is also contemplated that a mechanical key over-ride mechanism could be rotated in order to move the latch relative to the channel, and/or out of engagement with the knob, or to move the blocker out of the channel of the latch.

Figure 25:
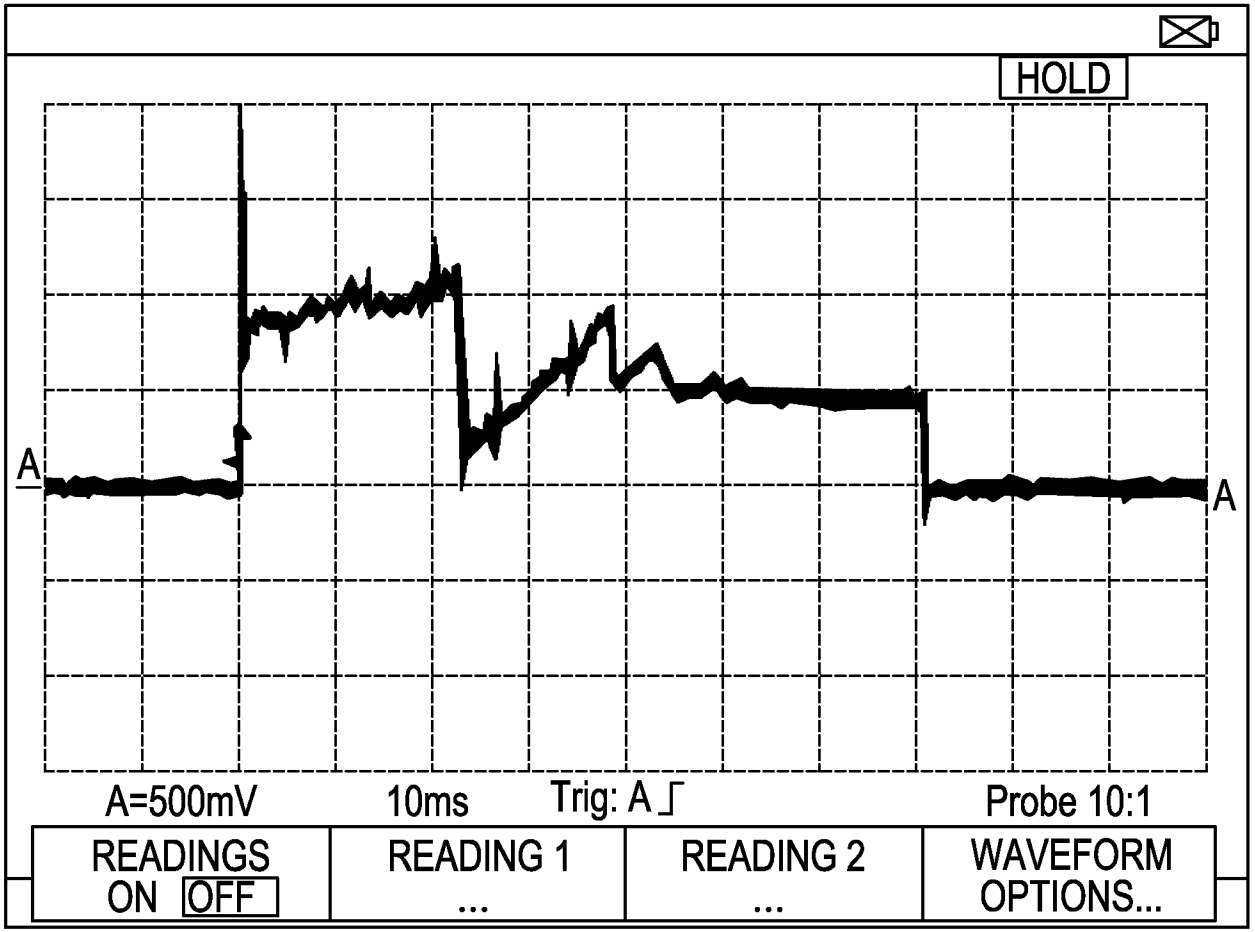
FIG. 25 of the drawings is a graphical representation of the current by the motor as measured through the unlocking cycle.
Figure 26:
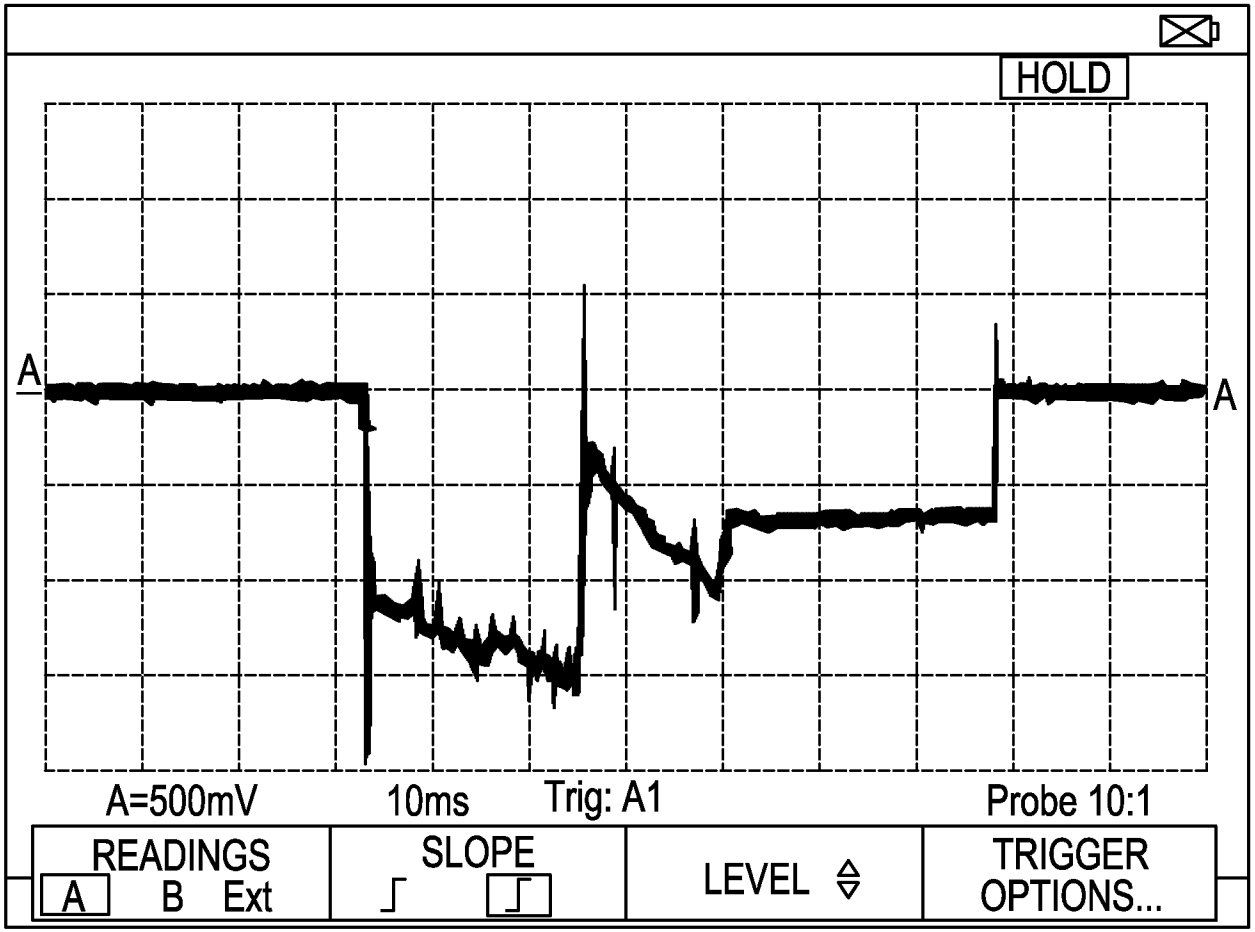
FIG. 26 of the drawings is a graphical representation of the current draw by the motor as measured through the locking cycle.

Referring now to FIGS. 25 and 26, a graph is shown of the current waveform of the motor 108 during operation. In particular, FIG. 25 shows the current waveform to accomplish the translation of the blocker from the locked position to the unlocked position. The current waveform has multiple slopes of increasing and decreasing current through the translation of the blocker. First, when the motor is initiated, there is an inrush of current, to overcome the inertia and to begin rotation. Next, the current decreases as the cam 106 continues to rotate and accelerate from a resting position to a position where the first follower reaches the second slot 152. As the continued rotation initiates translation of the blocker, the current decreases abruptly. The current begins another increasing slope as the blocker translates across to the unlocked position. As the rotation of the cam continues, the first follower 130 exits the second ramp, causing a quick drop in current draw, with the current draw entering another increasing slope as the speed of the cam increases without resistance toward and into the third slot 154. Finally, as the first follower reaches the end of the third slot 154, the current drops to a to a steady draw in an effort to cause further rotation (i.e., substantially flatlines). It is the sensing of this relatively steady current draw that signals to the electronic control assembly that the blocker has reached the unlocked configuration.

The opposite is shown in FIG. 26, wherein a waveform for the motor is shown for a locking operation. In particular, the waveform is inverted, and transitions through the same regions (although, as the motor operates in the opposite direction, the current is in the opposite direction). Again, when the end of travel is reached, the current reaches a substantially steady draw which triggers the electronic control assembly to cease rotation of the motor, as the blocker has reached the locked configuration. The two FIGS. 25 and 26 show the intermittent nature of the contact between the blocker and the cam, thereby showing how the overall use of power is not continuous, but that it varies throughout the cycle. While variations in the actual current draw will be seen depending on a number of variables, the general configuration of a spike when movement of the cam is initiated, followed by a sloped change of increased current draw during rotation of the cam without coacting with the blocker to effectuate translation of the blocker, followed by a drop in current draw when contact is made with the blocker and force is imparted upon the blocker to translate across the blocker channel, followed by another drop in current draw when the blocker reaches the end of translation, and the first follower is free to rotate without imparting force upon the blocker, followed by an increase in current draw as the cam accelerates, finally followed by a drop and a flatline when the end of rotation of the cam is reached with the first follower positioned at the end of the final slot (slot 150 when reaching the locked orientation and slot 154 when reaching the unlocked configuration).

Figure 27A:
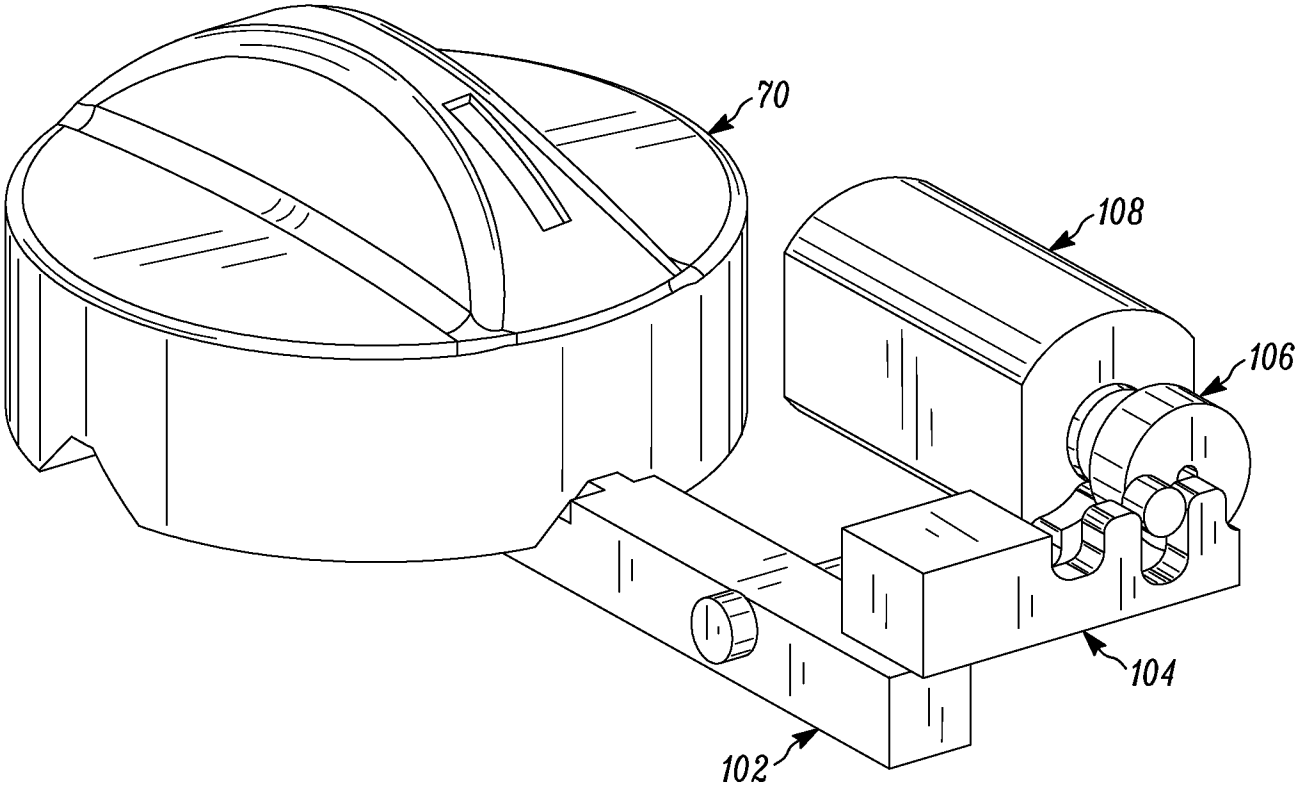
FIG. 27A of the drawings is an alternate embodiment of the latch assembly and the knob of the actuatable lock assembly of the present disclosure, in the locked position.
Figure 27B:
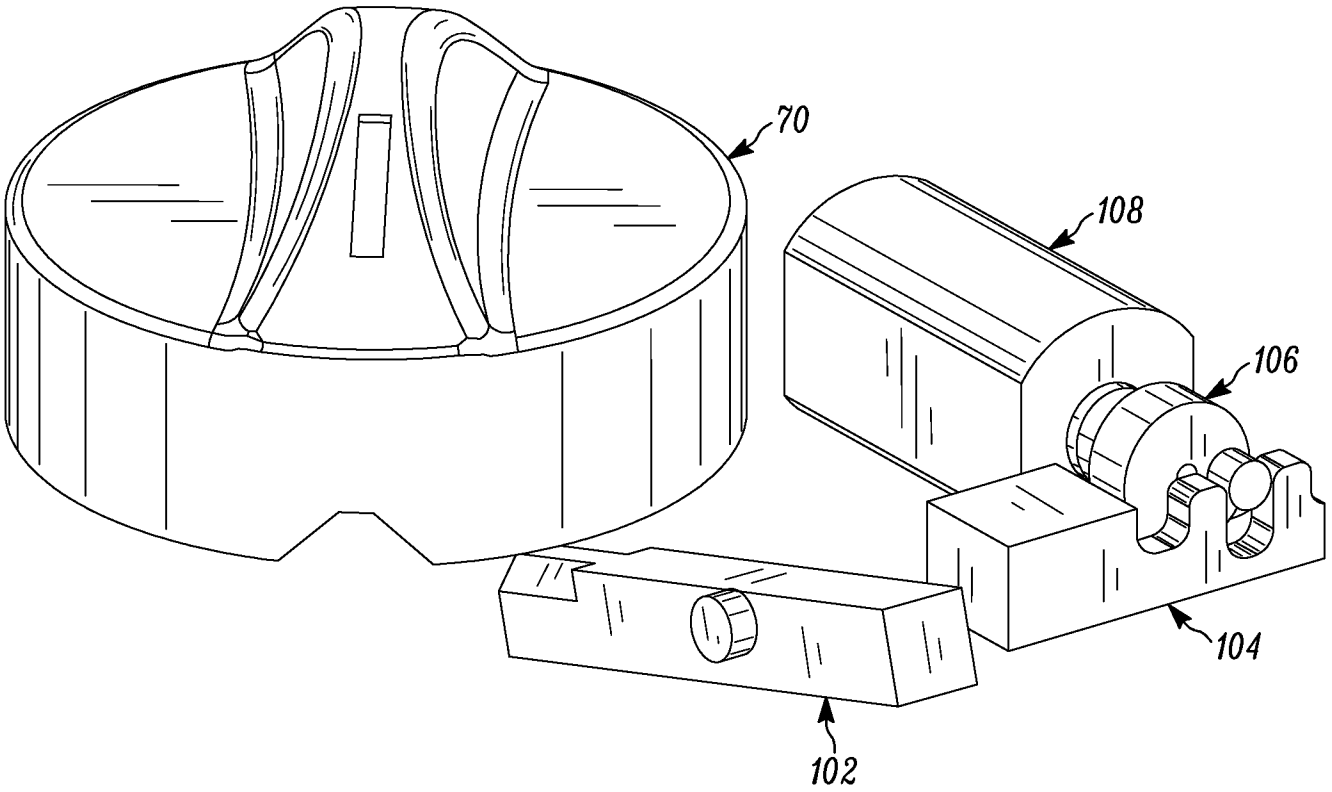
FIG. 27B of the drawings is an alternate embodiment of the latch assembly and the knob of the actuatable lock assembly of the present disclosure, that is shown in FIG. 27A, in the unlocked position.

It will be understood that variations to the structure of the latching assembly are contemplated. For example, and with reference to FIGS. 27A and 27B, a variation is contemplated wherein the operation of the blocker remains the same in that the blocker translates within a blocker channel. However, the latch rotates about an axis of rotation that is positioned between the proximal and distal ends. The axis of rotation is further substantially parallel to the blocker channel, and spaced apart therefrom. The knob in such an embodiment has a downwardly opening notch in the dependent skirt which interfaces with the distal end of the latch.

In the locked configuration, the latch is biased so that the distal end is rotated about the axis of rotation into the downwardly opening notch. The blocker extends over the proximal end of the latch precluding rotation about the axis of rotation, thereby maintaining the latch in the downwardly opening notch. When the blocker is moved to an unlocked position, the blocker is spaced apart from the latch, and the latch is free to be rotated about the axis of rotation. Thus, when the knob is rotated, the shape of the downwardly opening notch imparts a downward force upon the latch driving the latch out of the notch and allowing free rotation of the knob. The opposite sequence is performed to again return the blocker to the locked position.

Figure 28A:
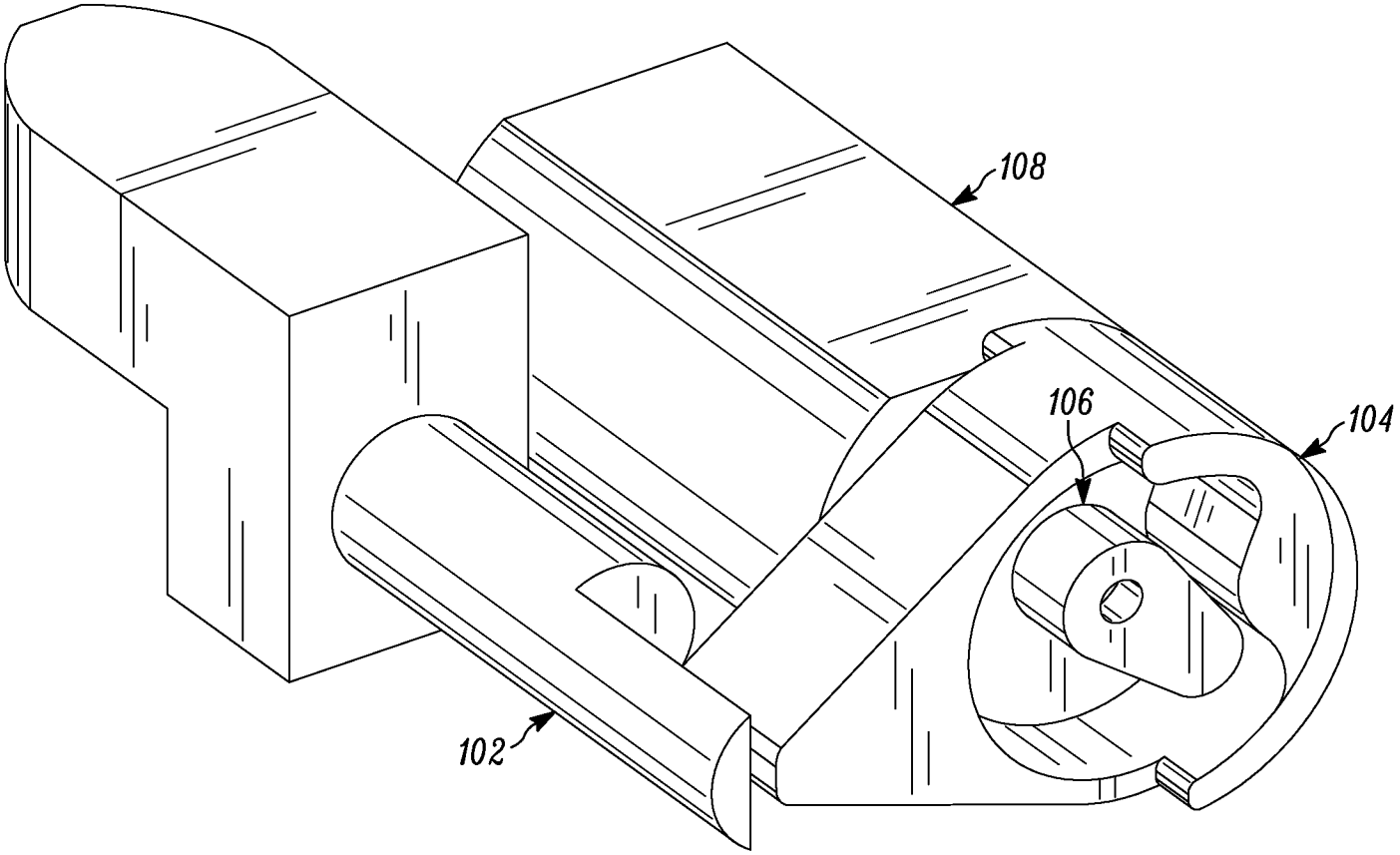
FIG. 28A of the drawings is an alternate embodiment of the latch assembly of the present disclosure, in the locked position.
Figure 28B:
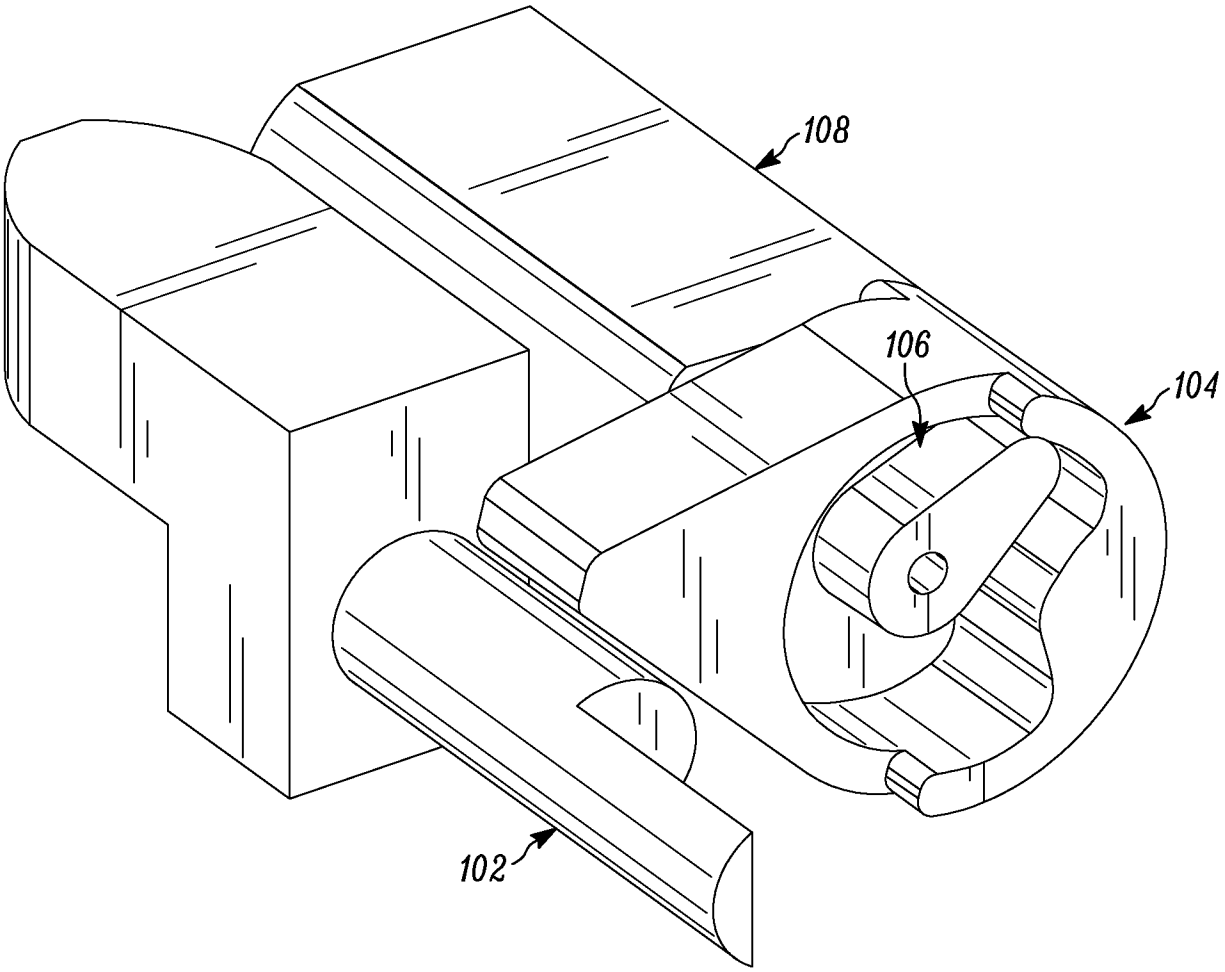
FIG. 28B of the drawings is an alternate embodiment of the latch assembly of the present disclosure, that is shown in FIG. 28A, in the unlocked position.

With the embodiment of FIGS. 28A and 28B, a rotationally movable blocker is contemplated. In such an embodiment, the rotational blocker includes a first cam profile within a cavity of the blocker, and a lobe extending on an outer surface thereof. The lobe interfaces with the proximal end of the latch. The cam 106 is positioned within the cavity of the blocker so that rotation of the motor interfaces the first follower of the cam with the first cam profile of the blocker. As such, when rotated in a first direction, the first cam follower freely rotates relative to the blocker until the first stop is reached. At such time, continued rotation of the first cam follower rotates the blocker, as shown in FIG. 28B. The rotation of the blocker, eventually moves the blocker out of the way of the latch. The latch is then free to slidably move within a latch channel.

To return the device to the locked orientation, the cam 106 is rotated in the opposite direction relative to the blocker until the second stop is reached. When the second stop is reached, the continued rotation of the cam by the motor rotates the blocker, returning the blocker into a position that interfaces with the proximal end of the latch. As such, the blocker precludes slidable movement, which, in turn, precludes rotation of the knob that interfaces with the distal end of the latch.

Figure 29A:
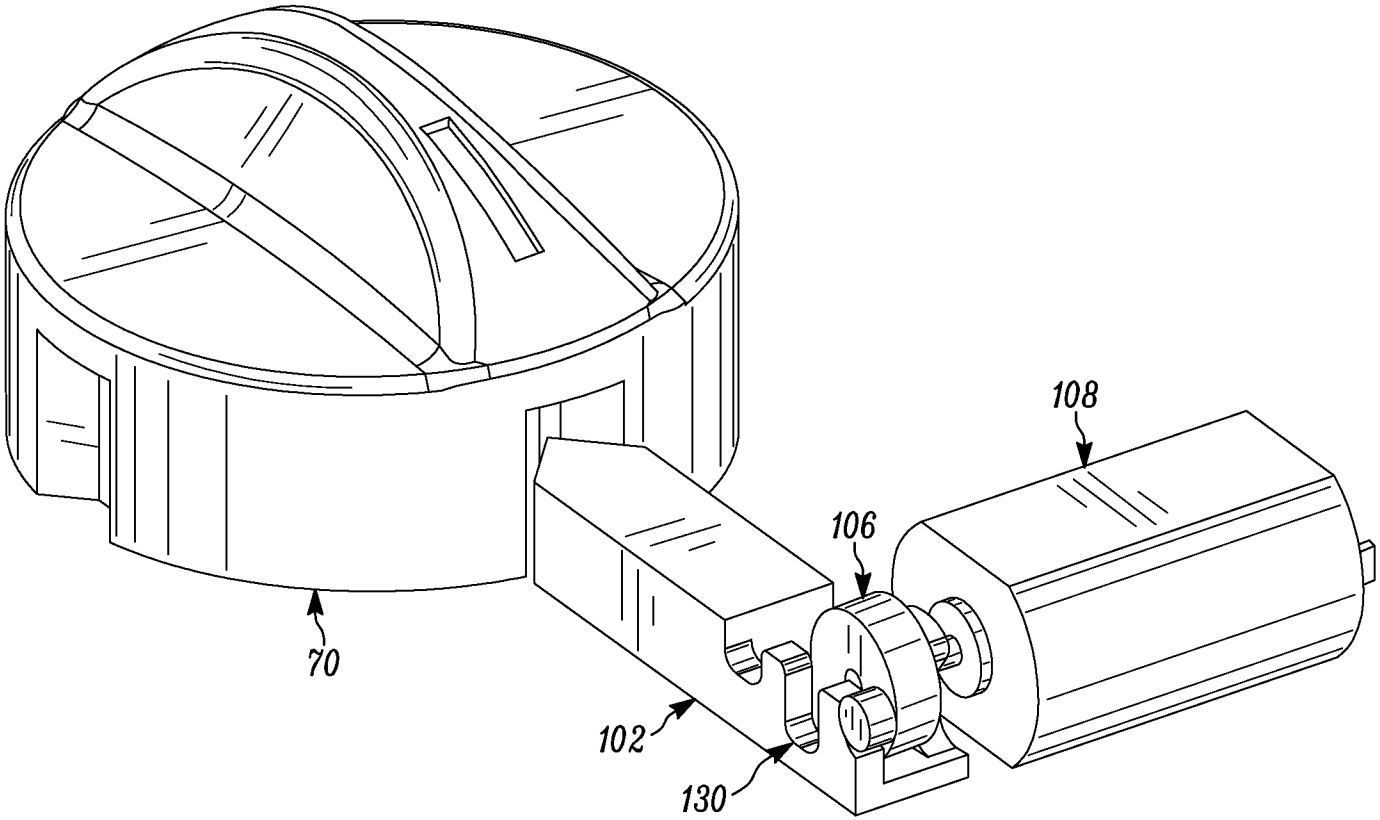
FIG. 29A of the drawings is an alternate embodiment of the latch assembly of the present disclosure, in the locked position.
Figure 29B:
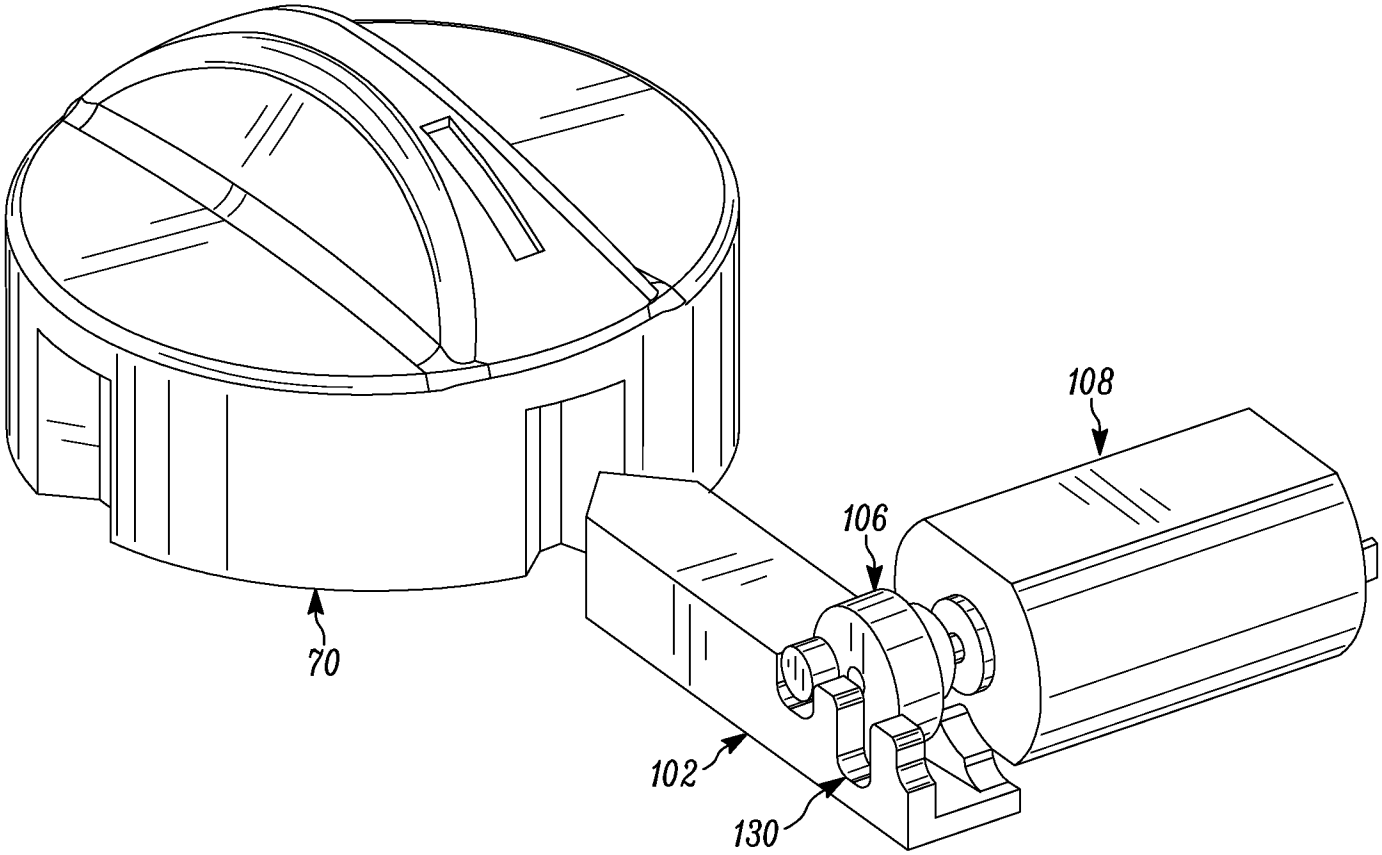
FIG. 29B of the drawings is an alternate embodiment of the latch assembly of the present disclosure, that is shown in FIG. 29A, in the unlocked position.
Figure 29C:
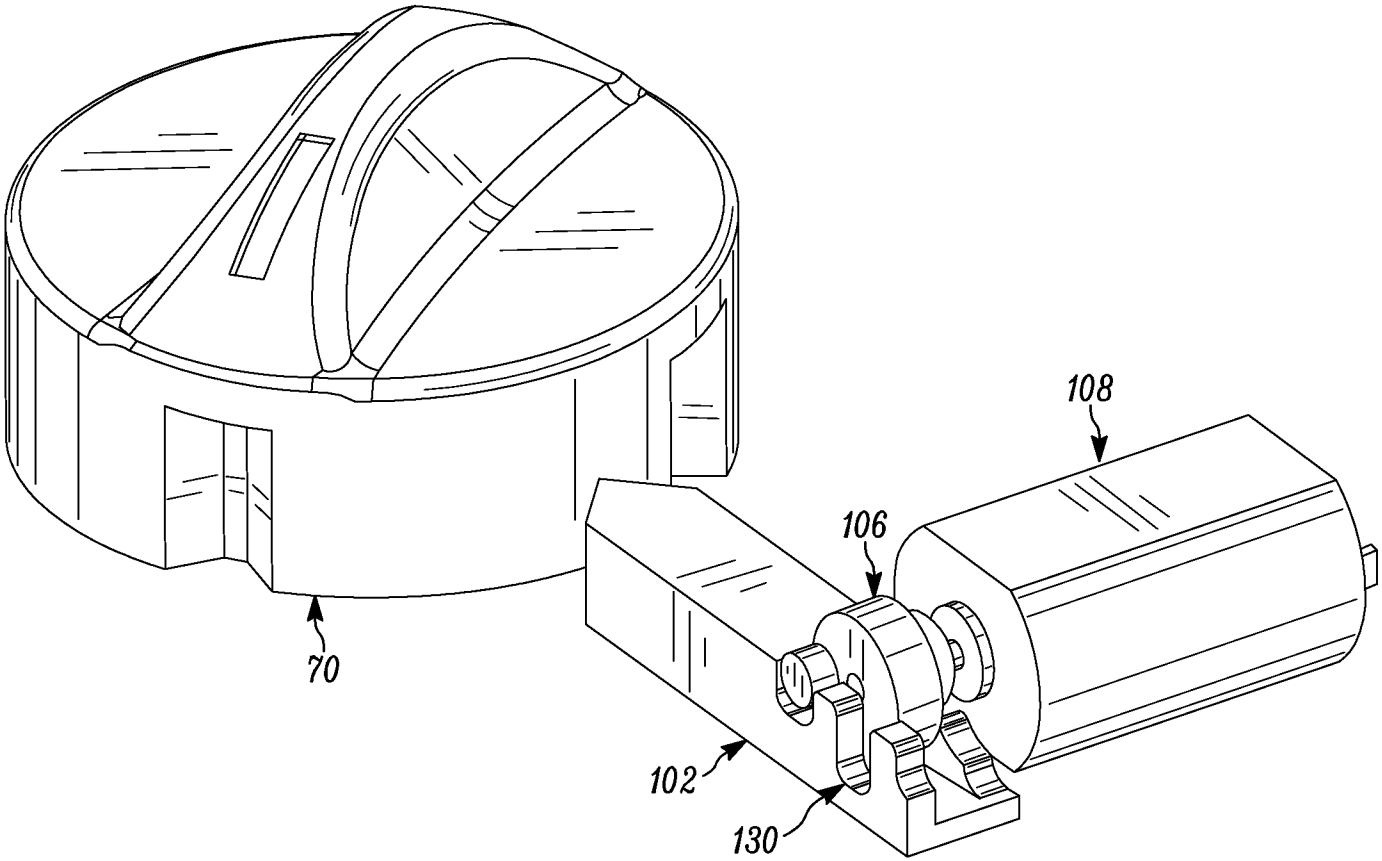
FIG. 29C of the drawings is an alternate embodiment of the latch assembly of the present disclosure, that is shown in FIG. 29A, in the unlocked position, with the knob rotated relative to the knob position in FIG. 29B.
Figure 30:
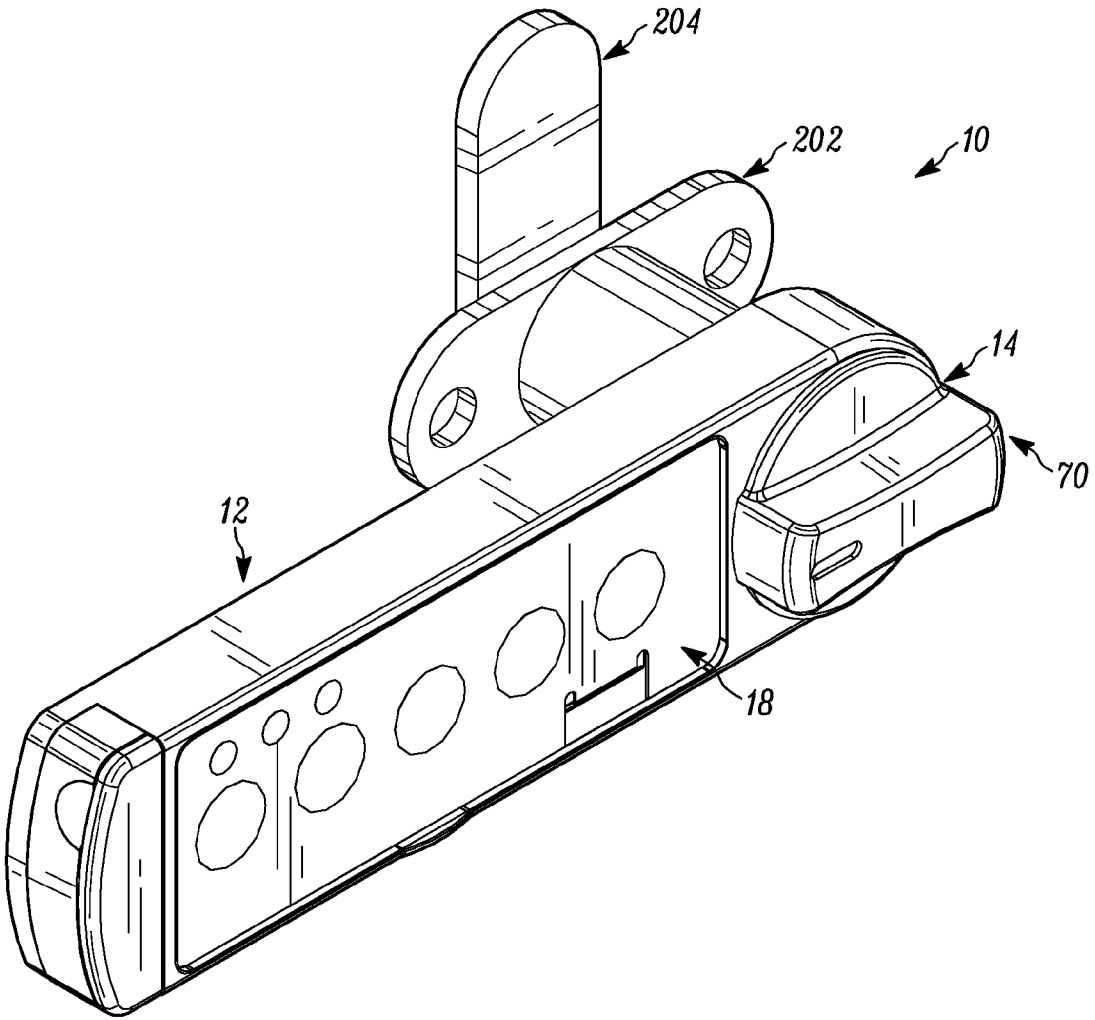
FIG. 30 is a front perspective view of a configuration of the lock of the present disclosure, which configuration includes a configuration of the actuatable lock assembly.
Figure 31:
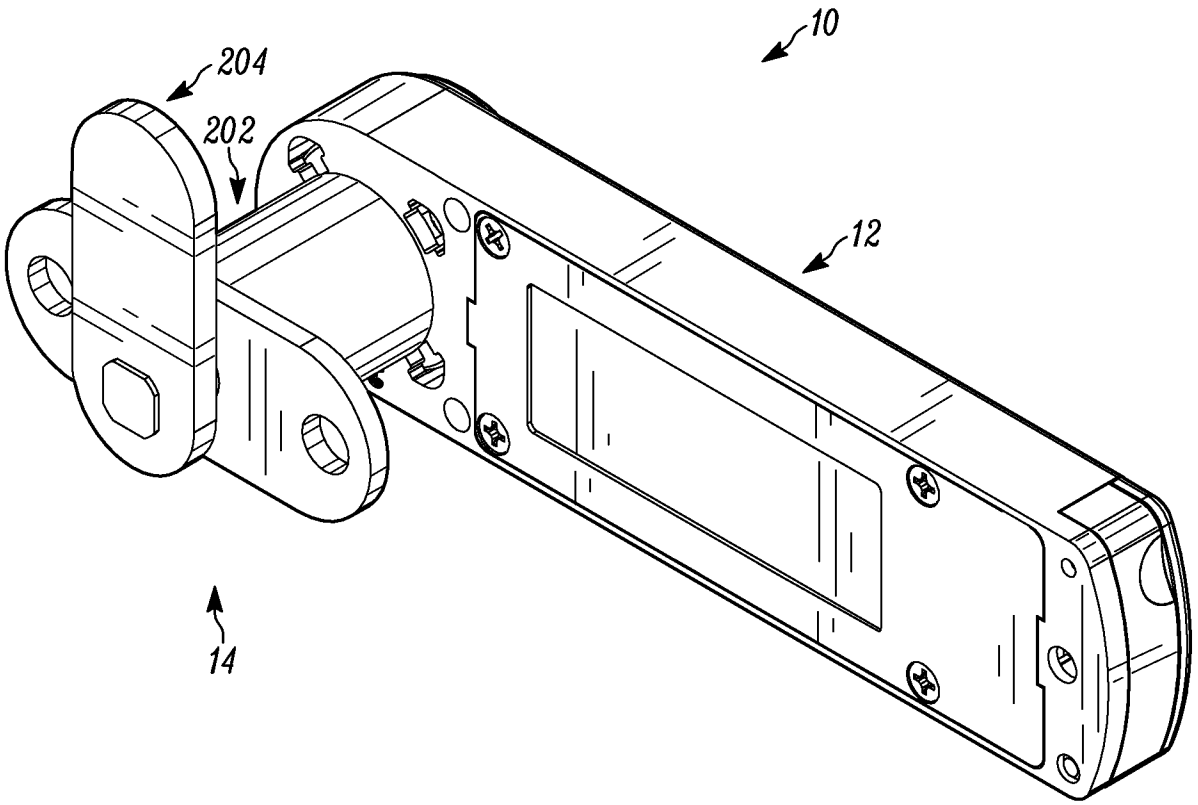
FIG. 31 is a back perspective view of the configuration of the lock of the present disclosure.

In yet another embodiment, shown in FIGS. 29A through 29C, the blocker function and the latch function can be integrated into a single element. That is, the distal end of the latch can be configured to include the first cam profile and the second cam profile that was on the blocker. The cam profiles are in the direction of translation of the latch, as opposed to being perpendicular thereto in the other embodiments. The cam and the motor are rotated so that the cam can interface with the first and second cam profiles. In turn, actuation of the motor directly moves the latch.

In another configuration, the lock is shown in FIGS. 30 through 44. In such a configuration, the actuatable lock assembly, in place of lock driver 72 includes spindle member 200. The spindle member is positionable within a typically existing bushing 202 with a typically existing coupling 204. In essence, the spindle member 200 allows for the drop-in coupling and replacement of existing locks having a bushing 202 and coupling 204 with an electronic lock of the present disclosure. Such a lock is typically coupled to a selectively movable member having an exposed outside surface and an inside surface opposing the outside surface, the inside surface defines a portion of a volume to which the lock is providing selective access. For example, the selectively movable member may comprise a cabinet door, a drawer or the like which can be moved (i.e., rotated, slid, removed, etc.), to expose a volume (such as the drawer contents, the cabinet, etc.) to which the lock is designed to allow or preclude access. Of course, where reference below is made to a cabinet or a drawer, it will be understood that the same may be applied to any number of different configurations and movable members, including but not limited to the same. Additionally, it is contemplated that such a configuration is utilized in other applications beyond those specifically identified herein.

Figure 33:
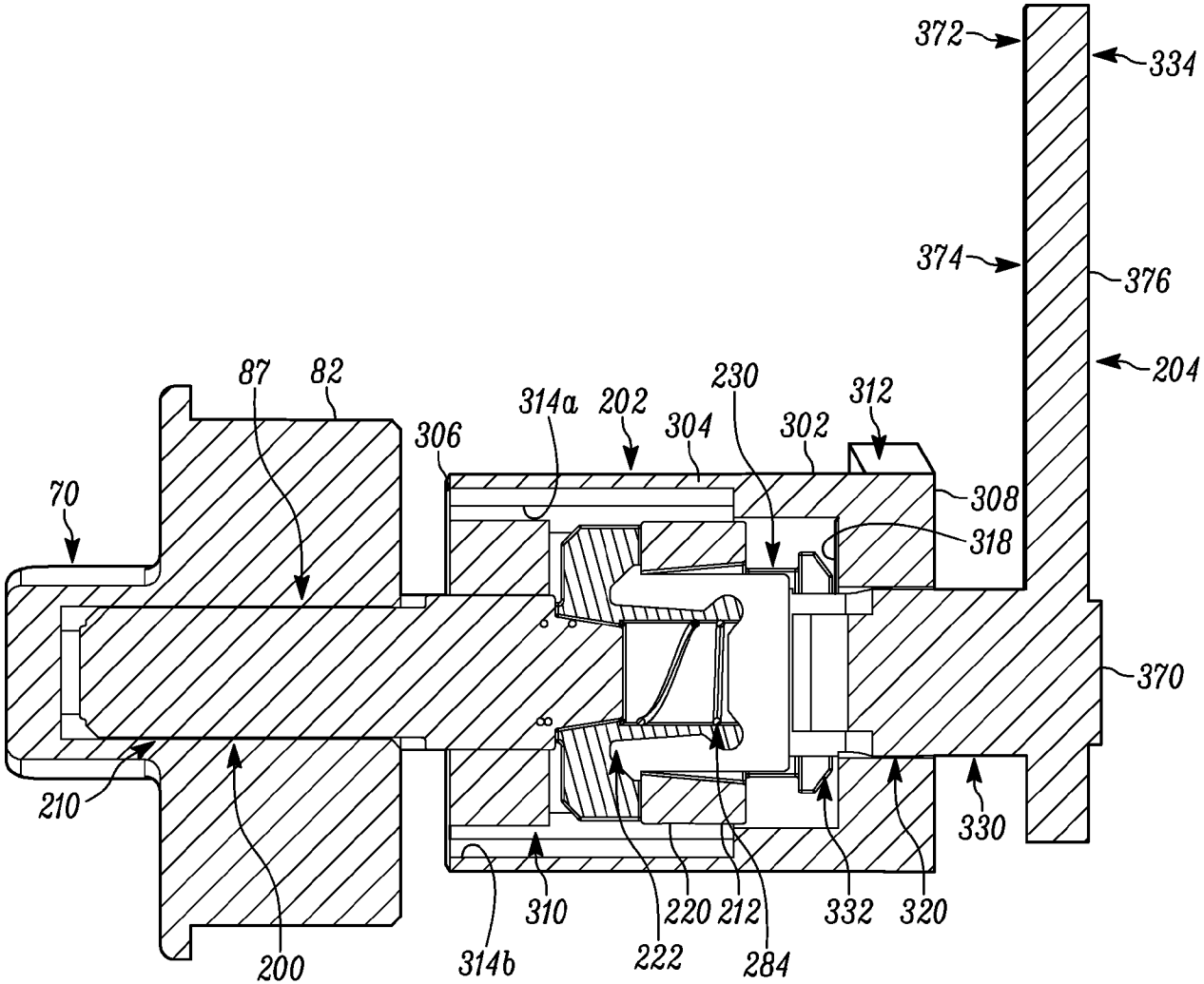
FIG. 33 of the drawings is a cross-sectional view of portions of the actuatable lock assembly, showing, in particular, the knob coupled to the spindle member, and the coupling member, all positioned within a bushing.
Figure 34:
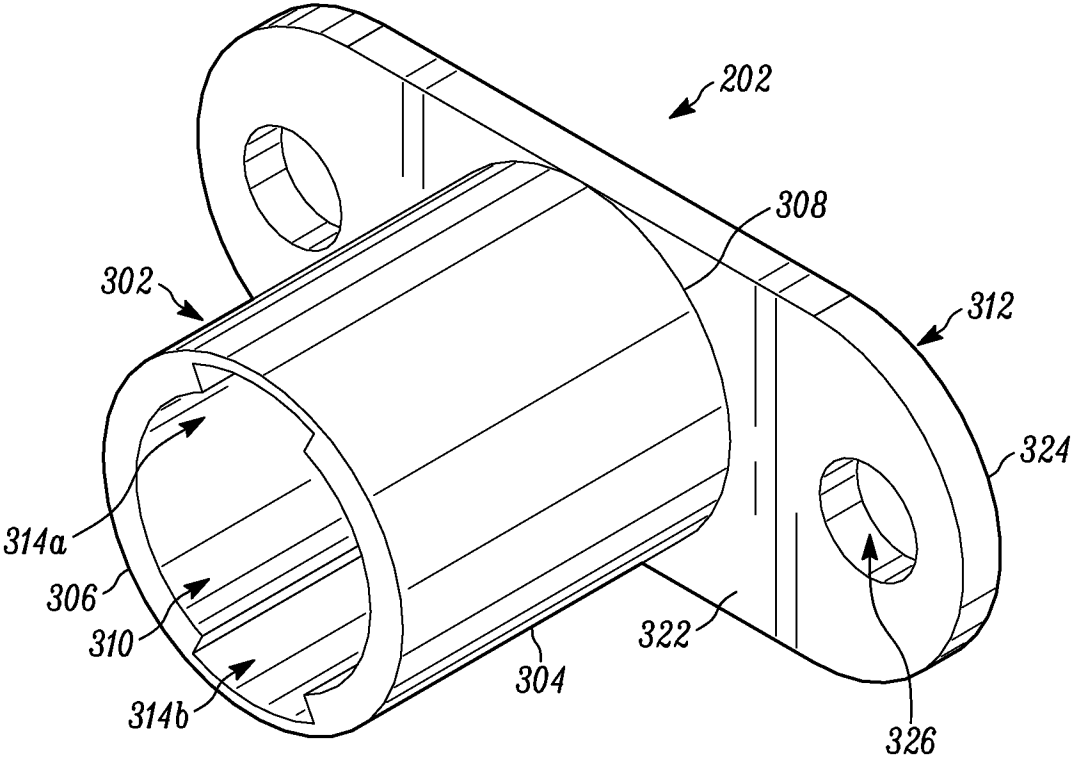
FIG. 34 of the drawings is a front perspective view of a bushing associated with the configuration of the actuatable lock assembly of the present disclosure.
Figure 35:
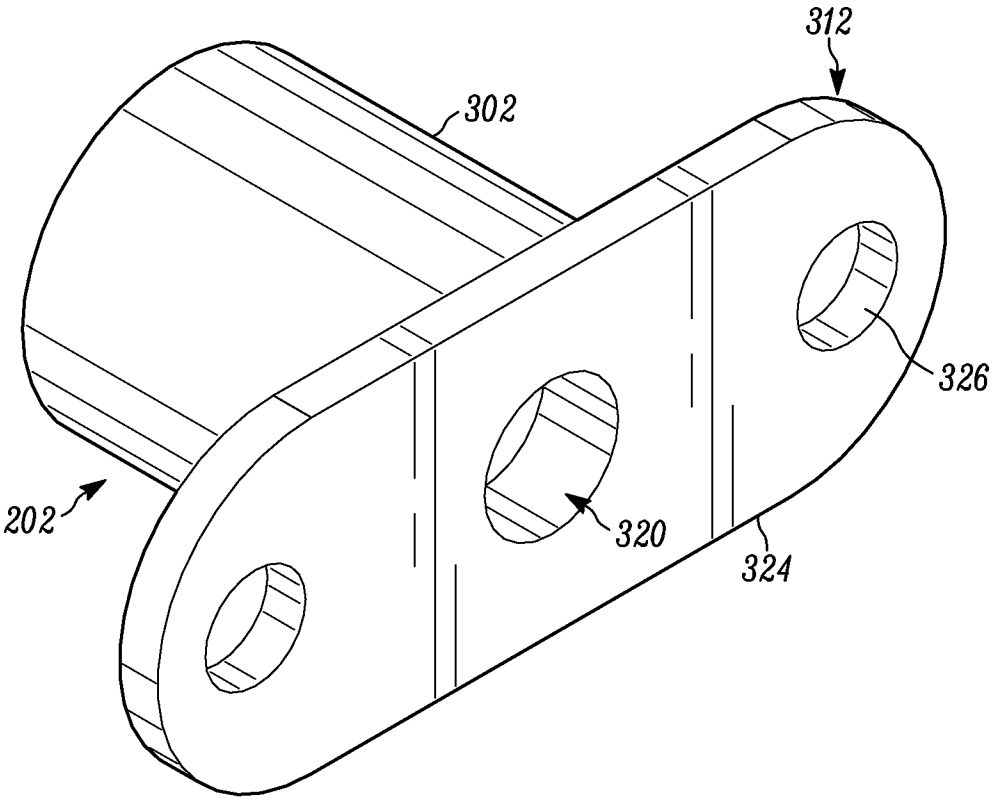
FIG. 35 of the drawings is a back perspective view of the bushing of the configuration of the actuatable lock assembly of the present disclosure.
Figure 36:
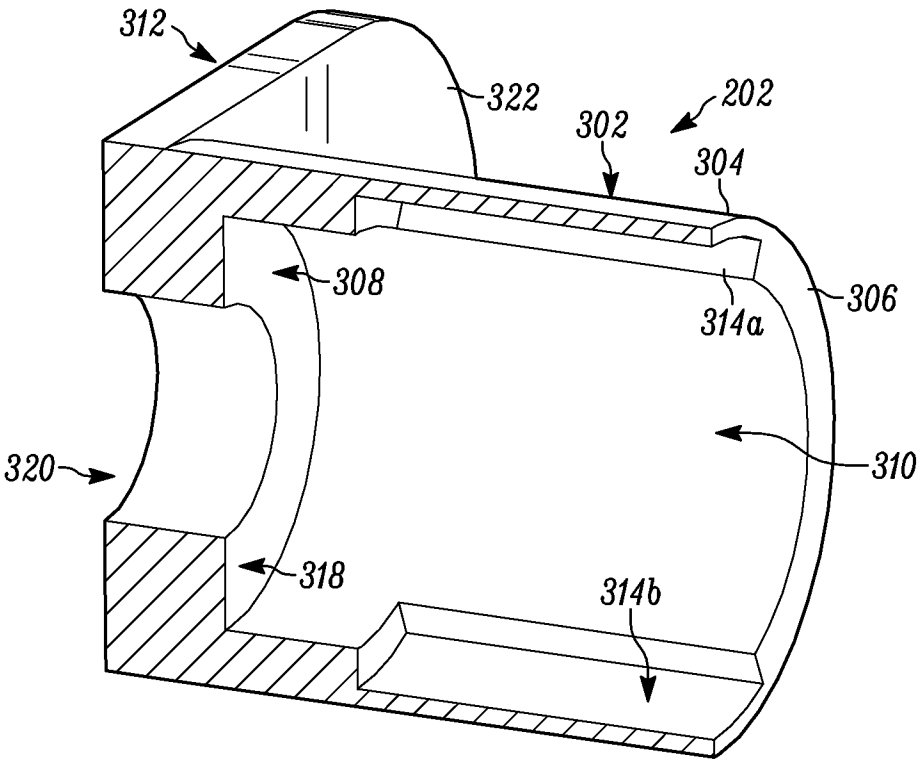
FIG. 36 of the drawings is a perspective cross-sectional view of the bushing of the configuration of the actuatable lock assembly of the present disclosure.
Figure 39:
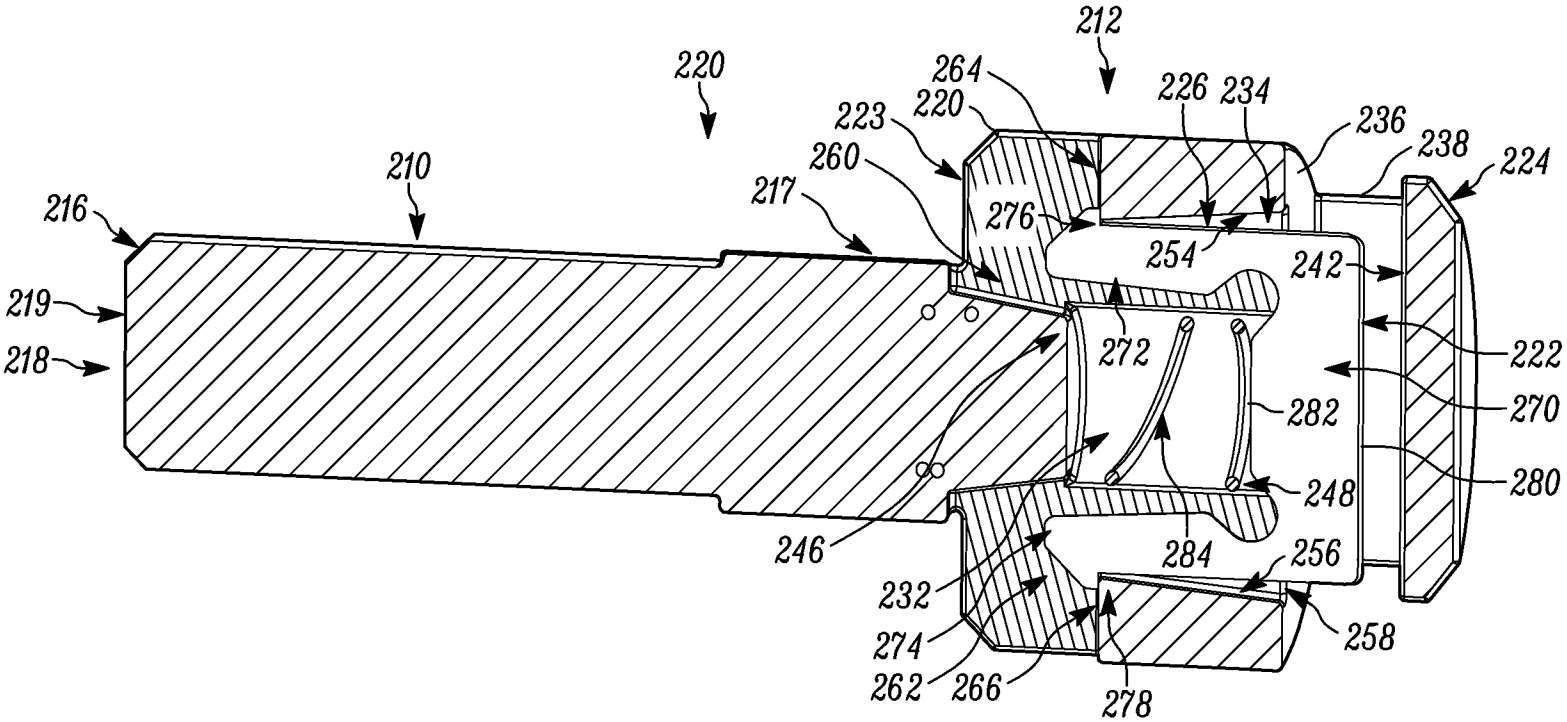
FIG. 39 of the drawings is a cross-sectional view of a configuration of the spindle member of the actuatable lock assembly of the present disclosure.
Figure 40:
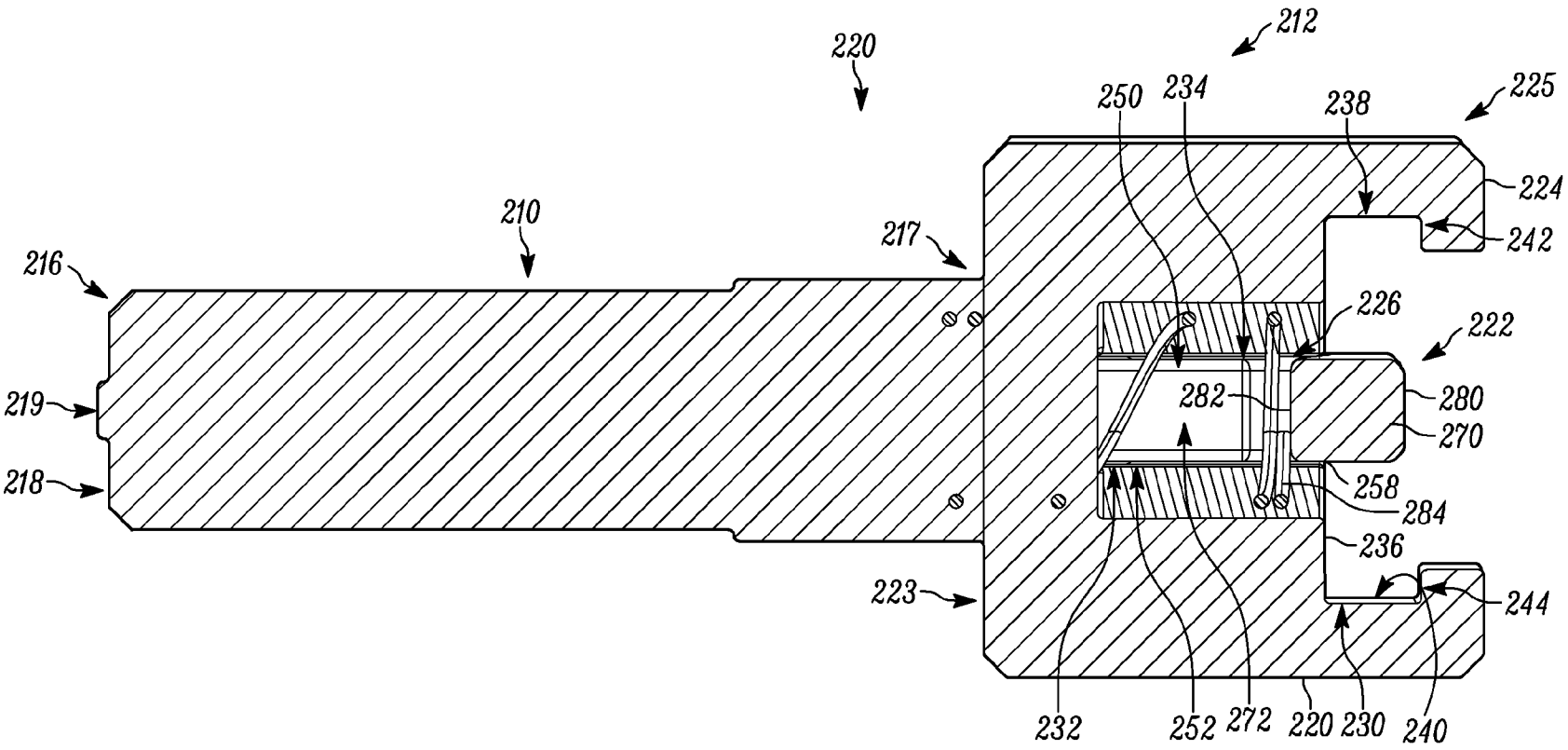
FIG. 40 of the drawings is a cross-sectional view of a configuration of the spindle member of the actuatable lock assembly of the present disclosure.

In such a configuration, the spindle member is shown in greater detail in FIGS. 33 and 39-40 as comprising knob attachment portion 210 and coupling attachment portion 212. The knob attachment portion generally comprises a shaft having a substantially square cross-sectional configuration (with rounded corners), although variations in cross-section, along with variations along the length thereof are contemplated. It will be understood that as with the lock driver 72, the knob is selectively attachable thereto, in the manner set forth above. The knob attachment portion 210 includes first end 216, second end 217 and front face 218. The front face may include an indicator 219 that provides the orientation of the spindle member (so that the user can instantly tell the orientation of the coupling attachment portion 212).

The coupling attachment portion includes body 220 and coupling member latching portion 222. The body 220, in the configuration shown, is integrally formed with the knob attachment portion 210. The body 220 includes first end 223 and second end 224, with the first end 223 generally meeting the second end 217 of the knob attachment portion 210. As will be understood from the figures, the coupling attachment portion and the knob attachment portion are generally positioned with a corresponding symmetrical axis of rotation, with the coupling attachment portion having a larger body than the knob attachment portion, thereby forming a flange where the two portions meet. The body 220 further includes retention coupling portion 225 and internal cavity portion 226. The retention coupling portion includes transverse slot 230 that includes base 236, first upstanding wall 238, second upstanding wall 240, first inward flange 242 and second inward flange 244. The first and second upstanding walls 238, 240 are generally parallel to each other and generally perpendicular to the base 236. The first inward flange 242 and the second inward flange 244 are generally perpendicular to the first and second upstanding wall 238 and are generally spaced apart from the base 236 a distance that substantially corresponds to the thickness of the retaining flange 356, 366 of the first and second legs of the spindle attachment portion of the coupling 204.

The first upstanding wall 238 is spaced apart from the second upstanding wall 240 a distance defined as the major width. The first inward flange 242 and the second inward flange 244 are spaced apart a distance defined as the minor width. It will be understood that the major width is greater than the minor width. It will further be understood that an upstanding wall may extend between the first and second upstanding walls 236, 238 in a spaced apart fashion, wherein the distance between these transverse upstanding walls is greater than the major dimension of the spindle attachment portion 332 of the coupling 204. In the configuration shown, no such upstanding walls are presented.

Internal cavity 226 includes inner bore portion 232 and a slot portion 234. The inner bore portion 232 includes first end 246 and second end 248. The internal cavity is generally configured to retain the coupling latching portion and to facilitate movement thereof. In the configuration shown, the inner bore portion 232 is substantially cylindrical and configured to receive spring 284 therein. Of course, the bore is not limited to such a configuration, and it is contemplated that a biasing member, other than the spring 284 having a different shape is contemplated for use.

The slot portion 234 includes first sidewall 250 and second sidewall 252, with first end wall 254 and second end wall 256 extending therebetween. The sidewalls and end walls generally form a rectangular configuration (although others are contemplated) which defines upper opening 258. The upper opening and the inner bore portion overlap at the base 236. A lower ledge 264 is defined at a lower end of the first end wall 254 as is first lower opening 260. A lower ledge 266 is defined at a lower end of the second end wall 256 as is second lower opening 262. The two end walls are spaced apart from each other and generally inwardly canting toward each other in a direction away from the upper opening (to facilitate the assembly of the coupling member latching portion 222).

The coupling member latching portion 222 is configured to slidably move within the inner cavity portion 236 with a portion thereof extending through the upper opening 258, beyond the base 236 of the retention coupling portion. The coupling member latching portion 222 includes upper end 270, first lower leg 272 and second lower leg 274. The upper end 270 includes upper engagement surface 280 and spring engagement surface 282 opposite of the upper engagement surface 280. The first lower leg 272 extends from the upper end 270 to one side thereof, and includes first outward flange 276. The second lower leg 274 is generally a mirror image of the first lower leg taken along an axis that bisects the upper end 270 transversely. The second lower leg 274 includes second outward flange 278.

To assemble the coupling member latch portion to the coupling attachment portion, the biasing member, in this case, spring 284 is positioned within the inner bore portion 246. Once positioned, the coupling member latching portion is directed through the upper opening 258. Through an application of force, the first and second lower legs 272, 274 are directed inwardly by the interface between the first and second outward flanges 276, 278 and the first and second end walls 254, 256, respectively. Eventually, the first and second lower legs 272, 274 reach the lower ledge 264, 266 of the first and second end walls and extend therebeyond. The first and second lower legs extend outwardly to return to their original configuration, interfacing the first outward flange 276 with the lower ledge 264 and the second outward flange 278 with the lower ledge 266.

As the first and second lower legs extend beyond the lower ledge, the spring engagement surface 282 engages the spring 284. It will be understood that the spring 284 biases the coupling member latching portion 222 to direct the same toward and out of the upper opening 258. As the spring forces the movement of the coupling member latching portion, the interface between the lower ledges 264, 266 and the respective one of the first and second outward flanges 272, 274 limits further movement of the coupling member latching portion. It will be understood that further insertive movement of the coupling member latching portion is generally limited by the spring (once fully collapsed). Additionally, in some configurations, the first and second lower legs 272, 274 can contact the second end 217 of the knob attachment portion, or a stop proximate the first end 223 of the coupling attachment portion. Thus, in the resting position, the ledges interface with the outward flanges of the lower legs, with the upper end 270 extending out of the upper opening and into the transverse slot 230. The coupling member latching portion can be pushed into the internal cavity portion so as to be fully out of the transverse slot, through overcoming the biasing force of the spring 284.

With reference to FIGS. 33 through 36, bushing 202 is typically coupled to a desk drawer, a cabinet door or to another movable member and extended through a bore defined therethrough between the exposed outside surface and the inside surface that opposes the outside surface. Typically such a structure is three quarters of an inch thick, although variations are contemplated, and such a structure thickness is provided for illustrative purposes solely. The bushing 202 includes body 302 and coupling flange 312. The body 302 includes outer surface 304, outer end 306, inner end 308 and central bore 310. The central bore 310 includes tumbler slots 314*a*, 314*b* on opposing ends thereof, locking tumbler slot (not shown), and end wall 318. End wall 318 includes latch opening 320. It will be understood that the slots, while not utilized or necessary for the operation, are often present due to the use of a bushing, such as bushing 202 with conventional tumbler/key based locks which may be positioned therein.

Figure 37:
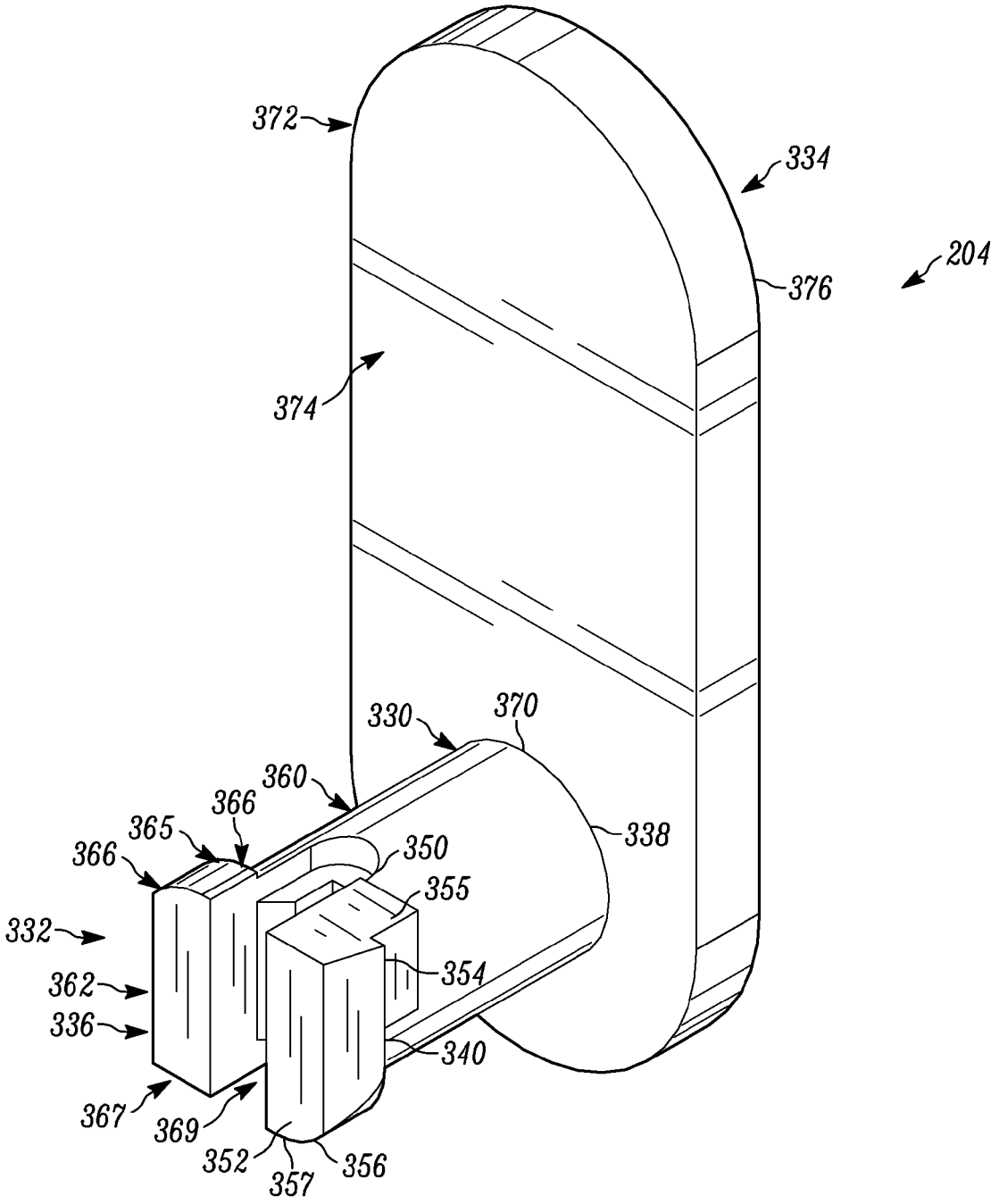
FIG. 37 of the drawings is a front perspective view of the coupling of the configuration of the actuatable lock assembly of the present disclosure.
Figure 38:
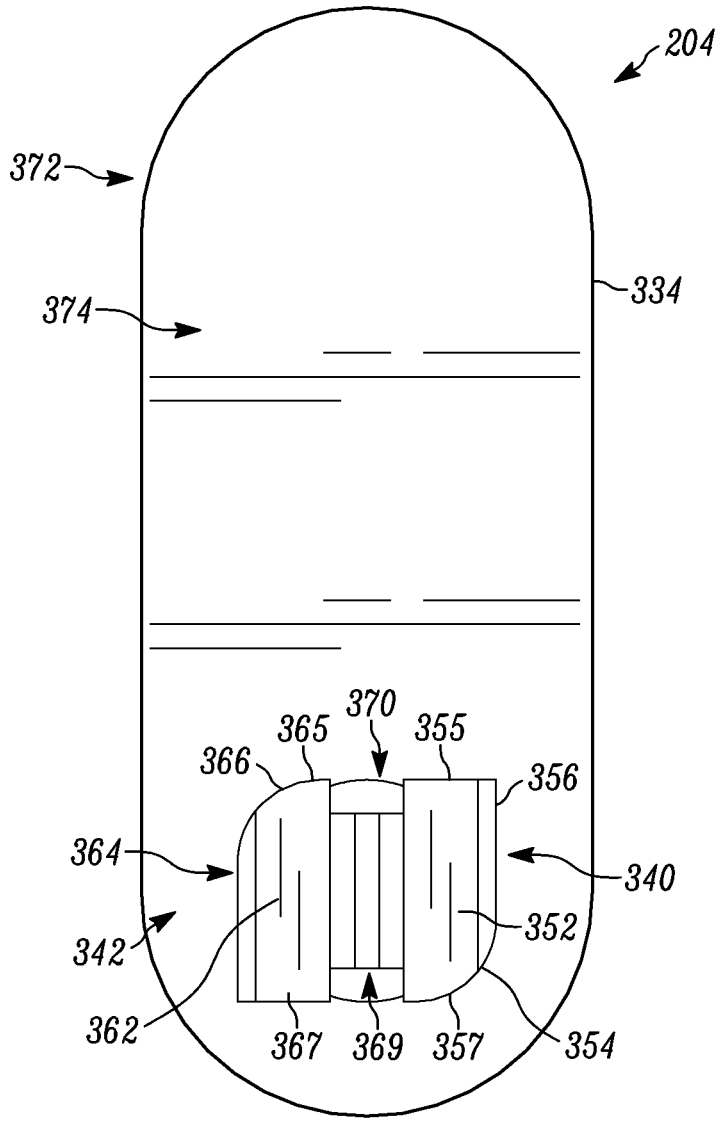
FIG. 38 of the drawings is a front elevational view of the coupling of the configuration of the actuatable lock assembly of the present disclosure.

With reference to FIGS. 33, 37 and 38, coupling 204 is likewise provided for use in association with conventional tumbler/key based locks. That is, the tumbler is configured to engage with the coupling 204. The coupling 204 includes body 330, spindle attachment portion 332, and locking flange 334. The body includes first end 336 and second end 338 and is of a generally cylindrical configuration that extends through the latch opening 320 and provides the axis of rotation of the coupling 204. The spindle attachment portion 332 includes first leg 340 and second leg 342. The first and second legs cooperate to define slot 369 therebetween. It will be understood that the slot 369 is larger than the upper end of the coupling member latching portion, so that the upper end of the coupling member latching portion may extend into the slot 369. Opposing inclined surfaces may be positioned within the slot so as to provide a centering of the coupling member latching portion, and so as to preclude relative movement of the coupling member latching portion relative to the coupling 204.

The first leg 340 includes proximal end 350, distal end 352, retaining flange 354 and rounded corner 356. The retaining flange 354 extends in an outward direction away from the slot 369 at the distal end of the first leg 340. The retaining flange includes an outer surface that tapers toward the distal end. Additionally, the first leg includes a first side 355 and a second side 357, with the rounded corner positioned proximate the first side thereof. The second leg includes proximal end 360, distal end 362, retaining flange 364 and rounded corner 366. The retaining flange 364 extends in an outward direction away from the slot 369 at the distal end of the second leg 342. The retaining flange includes an outer surface that tapers toward the distal end. The second leg includes a first side 365 and a second side 367, with the rounded corner positioned proximate the second side thereof. As the first and second legs are generally the same width (although not required), the first and second sides thereof substantially correspond, dimensionally. The two flanges are generally substantially dimensionally similar in configuration.

The first and second legs along with the slot therebetween define a major dimension that corresponds to the distance between the retaining flanges 356, 366 at their widest dimension that is generally positioned so as to be spaced apart from the distal end and the proximal end. Additionally, the structures define a minor dimension that corresponds to the distance between the first side and the second side of the first and second legs. Additionally, a corner dimension is defined between the rounded corner 356 and the rounded corner 366. It will be explained that the major dimension is greater than the minor width and smaller than the major width (most preferably closely matching the major width). In addition, the minor dimension is smaller than the minor width (and most preferably closely matching the minor width). In addition, the corner dimension is smaller than the major width.

The coupling 204 further includes locking flange 334. The locking flange 334 includes rotation axis 370, distal end 372, lock facing surface 374 and opposing surface 376. The locking flange 334 is fixed to the body 330 so as to rotate together therewith. It will be understood that the locking flange 334 can be oriented to interface with a structure (such as a frame of a desk or cabinet, for example) to preclude outward movement of a drawer or door to which the locking flange is associated. Typically, the locking flange is one of press-fit, welded, fastened or otherwise attached to the body 330.

With the lock, in some configurations, coupled to a selectively movable member having an exposed outside surface and an inside surface opposing the outside surface, with the inside surface defining a portion of a volume to which the lock is providing selective access, a bore is provided through the selectively movable member. The selectively movable member may comprise a drawer front, a cabinet door or another structure (and the disclosure is not limited to any particular structure or to any particular selectively movable member, or to a selectively movable member). Typically, such an installation includes the bushing 202 mounted through the bore, with the coupling 204 coupled thereto.

The coupling flange is typically positioned on the inside of the drawer, door or other structure, with the facing surface 322 overlying the structure. Fasteners or the like can maintain the bushing in the desired orientation. Typically, the bushing extends through a hole or bore in the drawer, door or other structure. It will be understood that the environment is disclosed with the understanding that a number of different particular configurations are contemplated, and that the configuration disclosed is exemplary of the configurations.

Figure 32:
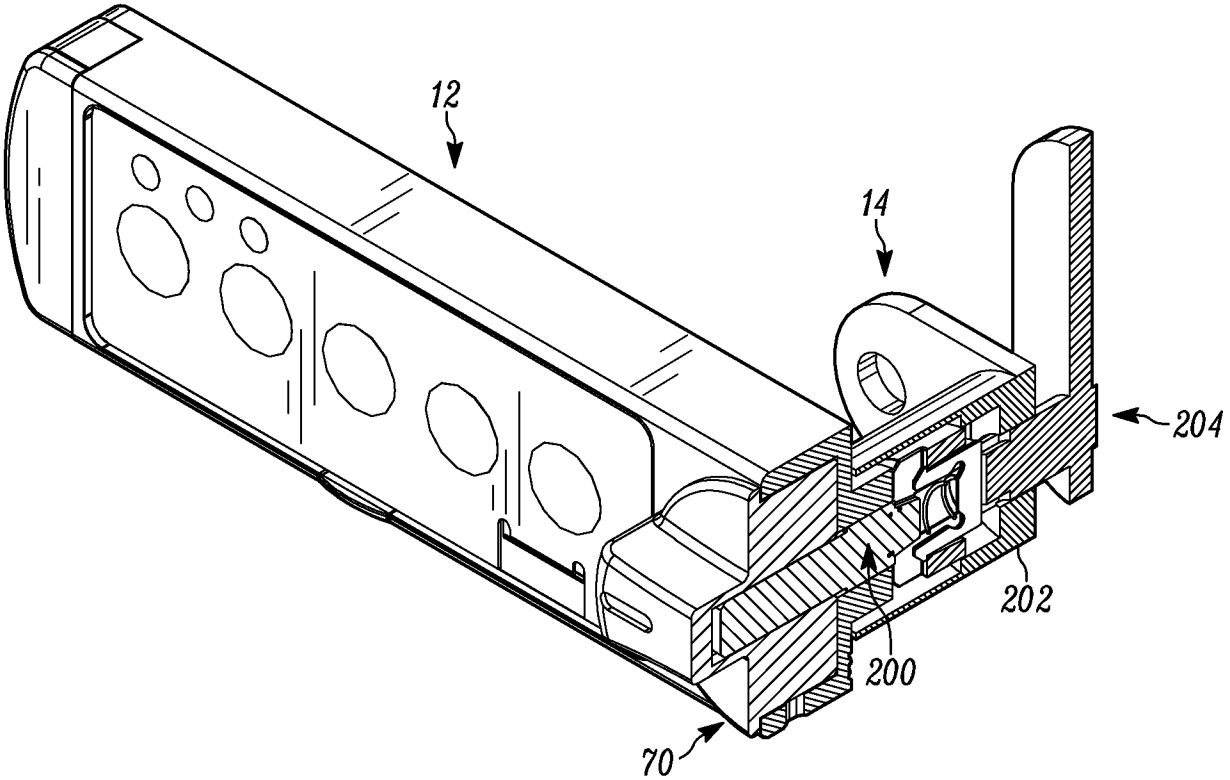
FIG. 32 of the drawings is a perspective cross-sectional view of the configuration of the lock of the present disclosure, showing, in particular, the actuatable lock assembly configuration.

With reference to FIGS. 32 and 33, the coupling is attached by extending the body of the coupling 330 into the central bore 310 of the body of the bushing 202. The first end of the body extends through the latch opening 320 of the end wall 318. The locking flange 334 is coupled to the second end through any number of different members. It will be understood that generally, a quarter turn of the locking flange directs the lock from a locked configuration to an unlocked configuration. In other embodiments, a greater or lesser amount of rotation directs the lock between a locked and an unlocked configuration.

With reference to FIGS. 32 and 33, the spindle attachment portion 332 is generally maintained within the central bore 310 of the bushing and generally rotatable therewithin at least the rotational distance necessary to position the locking flange between a locked and an unlocked configuration.

With particular reference to FIGS. 33, 41A through 41D (which show sequential coupling) and 42, to attach the spindle member 200 to the coupling 204, the position of the spindle attachment portion is first determined. In particular, the coupling 204 may be oriented so that the first and second legs are positioned primarily vertically, with the slot 369 being substantially vertical. At the same time, the user can grasp the spindle member and view the indicator 219. The indicator comprises a line that corresponds to the orientation of the coupling member latching portion. The user would in the example herein position the indicator in a substantially horizontal direction.

Figure 41A:
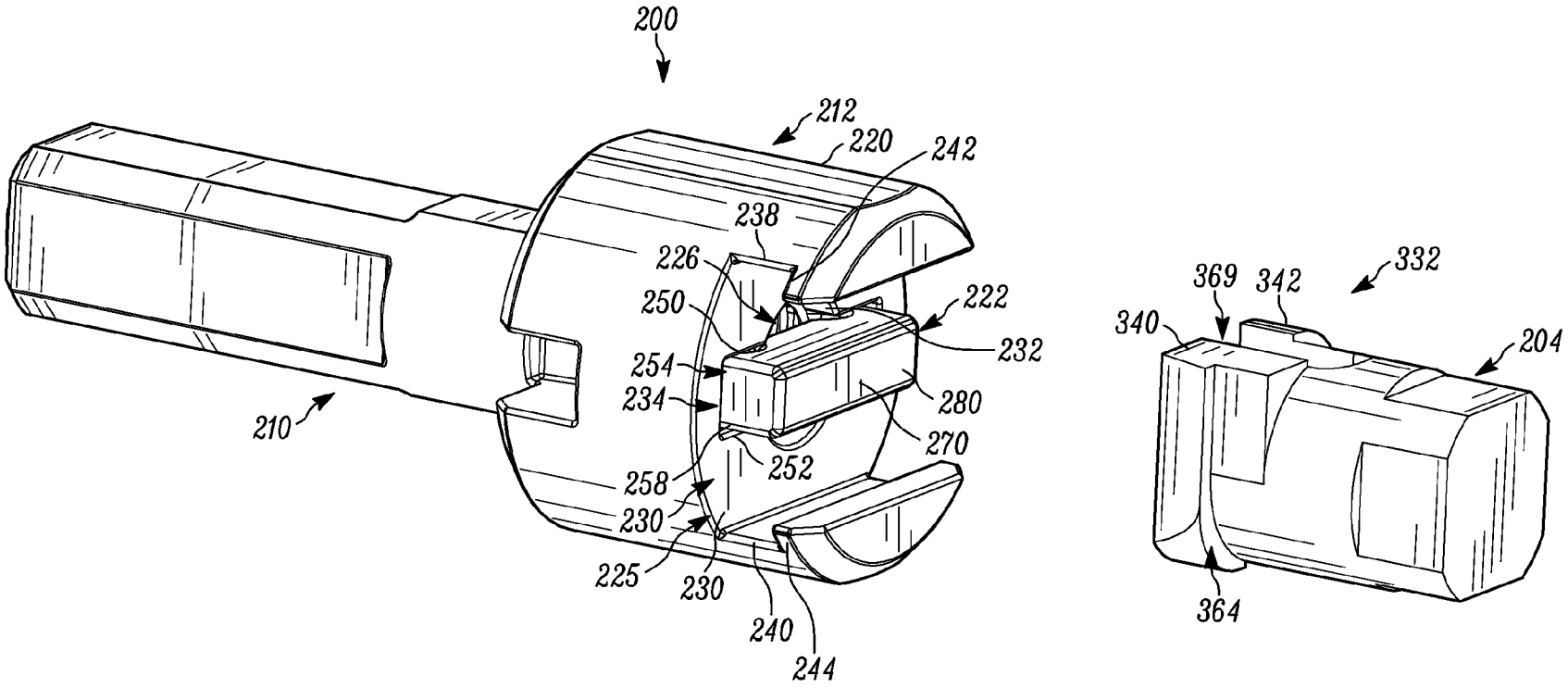
FIGS. 41A through 41D of the drawings are each a perspective view of a portion of the coupling and the spindle member in sequential order depicting the introduction and coupling of the two structures together so as to be substantially rotationally fixed relative to each other (and generally substantially axially fixed relative to each other)
Figure 41B:
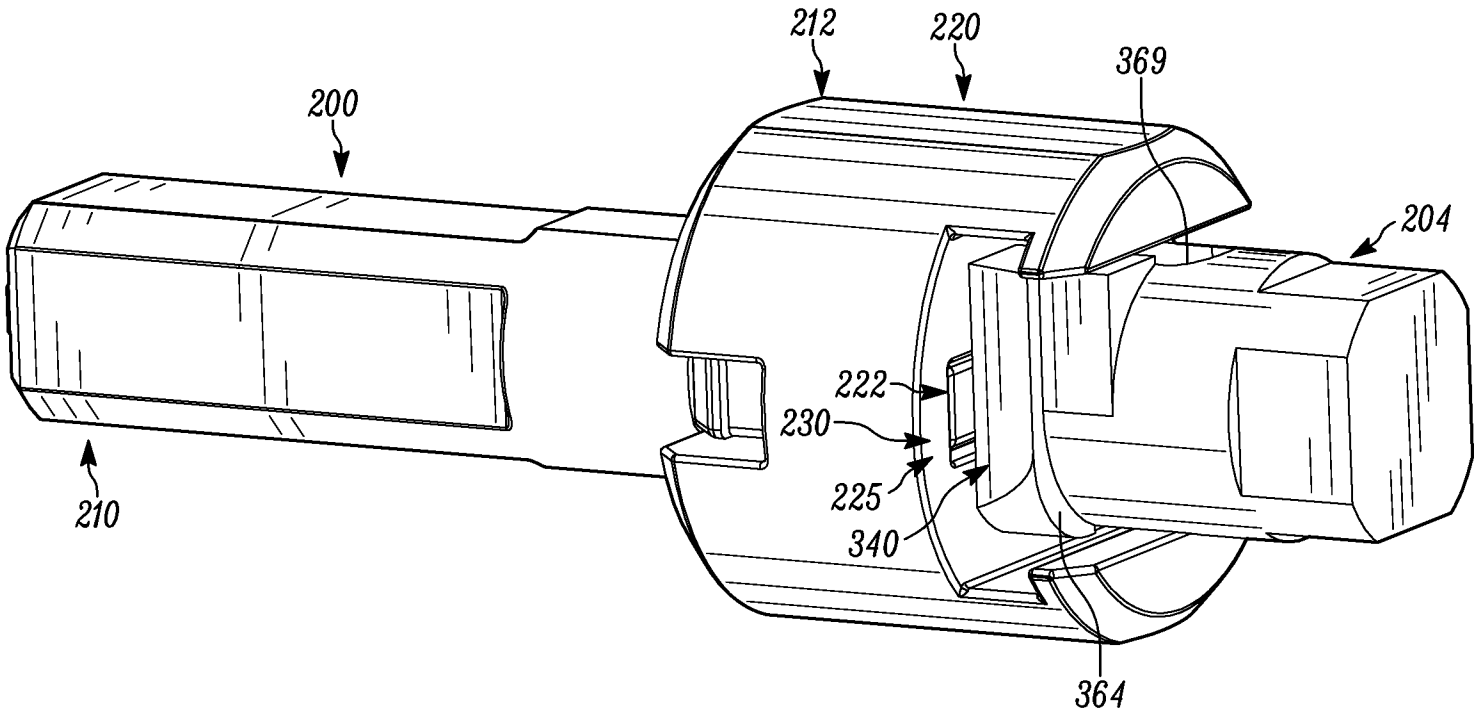

With particular reference to FIG. 41B, once positioned in the desired relative orientations, the spindle member is inserted into the central bore 310 (FIG. 36) of the bushing 202. With the coupling in a configuration that has the slot substantially horizontally, the spindle attachment portion 332 will extend into the transverse slot 230 as the minor distance (the distance between the sides of the first and second legs of the spindle attachment portion 332, or essentially the width of the first and second legs) is smaller than the minor width (the width between the inward flanges 242, 244 of the transverse slot). Further insertion overcomes the spring 284 of the latching portion and the latching portion is directed into the internal cavity portion. Eventually, the retaining flanges 354, 364 of the first and second legs of the spindle attachment portion 332 extend beyond the inward flanges 242, 244.

Figure 41C:
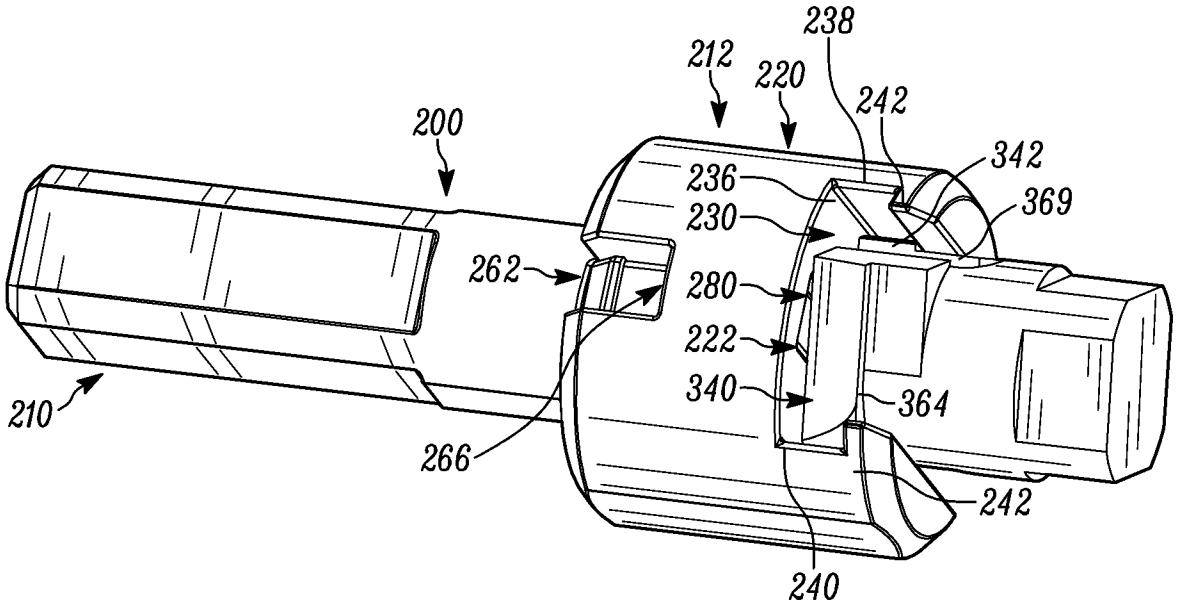
Figure 41D:
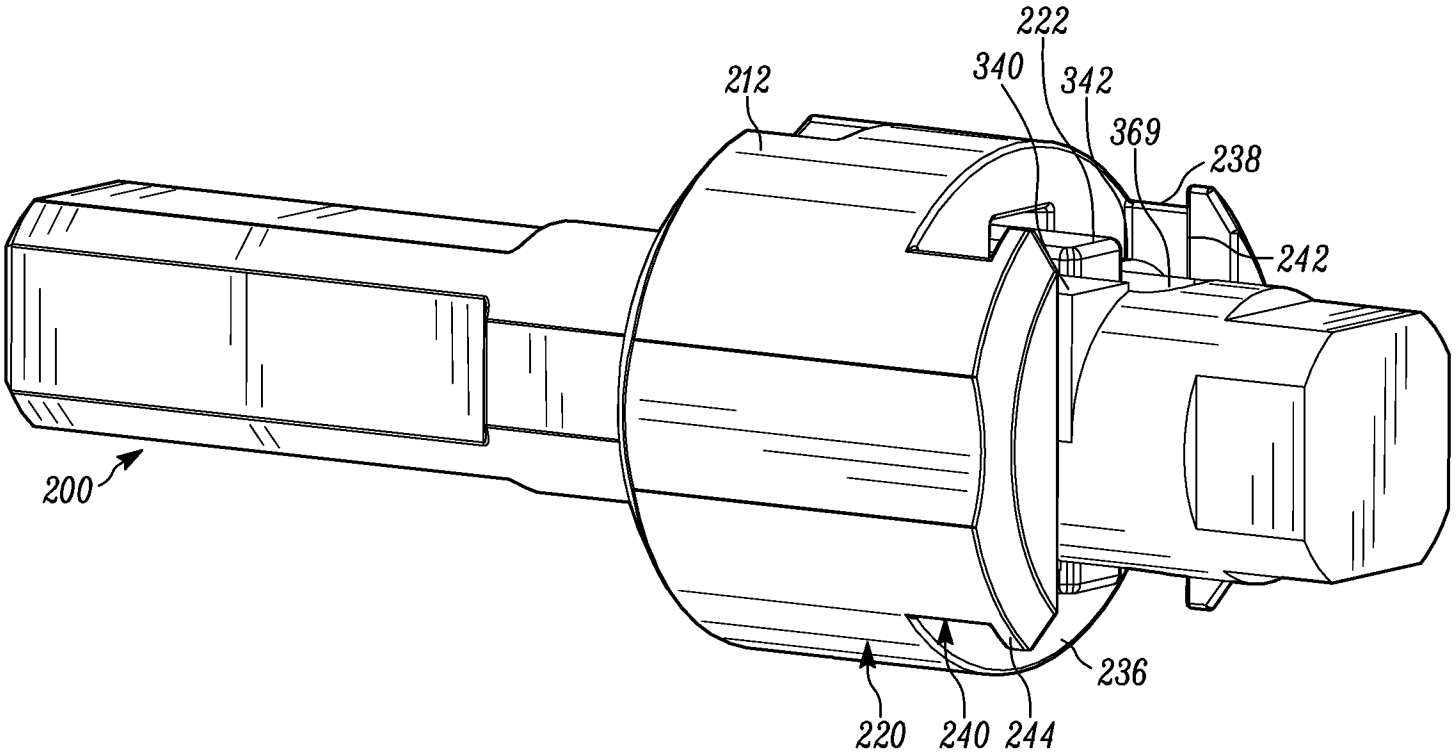
Figure 42:
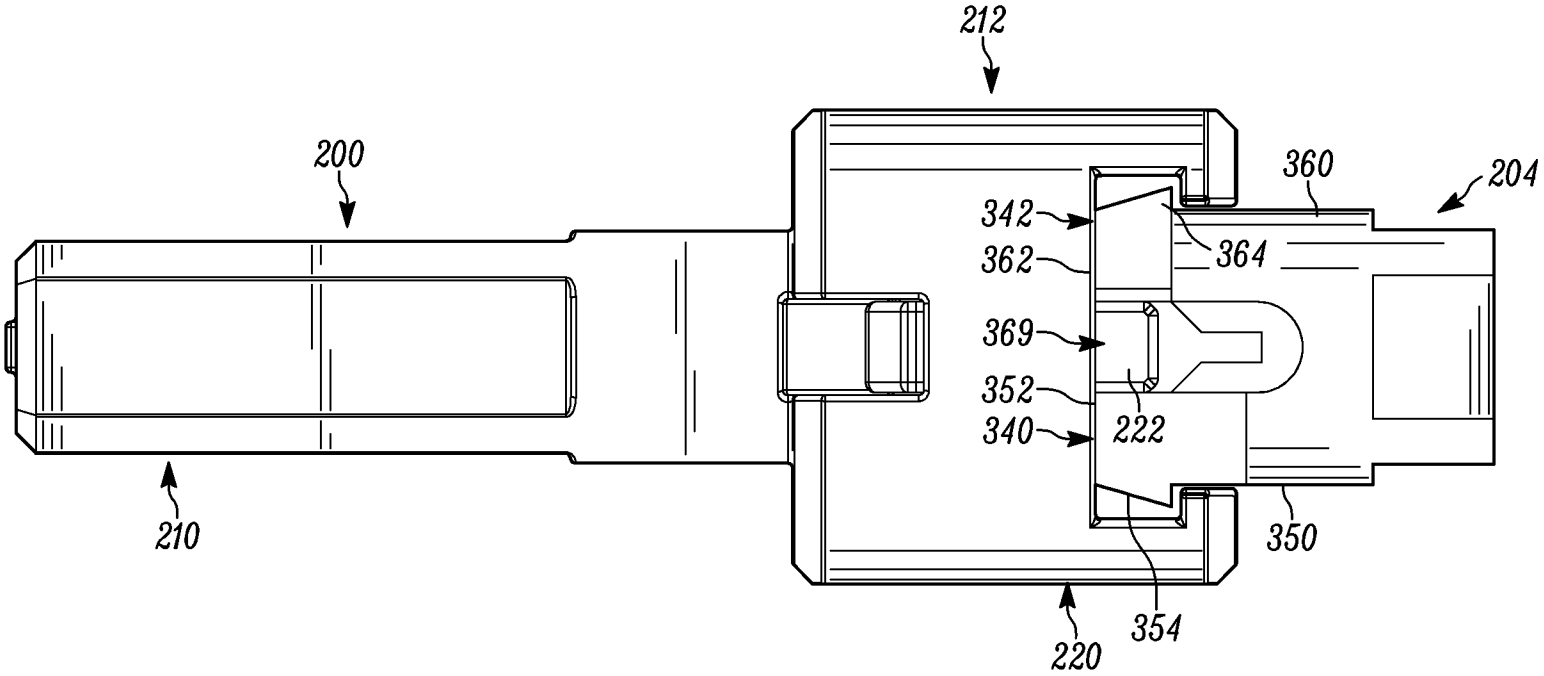
FIG. 42 of the drawings is a side elevational view of the coupling and the spindle member after joining together.

With particular reference to FIG. 41C, once in such a position, the spindle member can be rotated while maintaining the coupling in place, or through relative rotation of both in opposing directions. As the spindle member is rotated relative to the coupling, the corner dimensions allow for continued rotation, as the corner dimension is smaller than the major width. With particular reference to FIG. 41D, continued rotation through a relative distance of a quarter turn positions the slot 369 in the same orientation as the coupling member latching portion, thereby releasing contact by the coupling therewith. The upper end 270 of the coupling member latching portion extends into the slot 369 thereby locking the two structures to each other, and precluding relative rotation of one relative to the other. Additionally, due to the configuration of the retaining flanges 356, 366, the flanges interact with the first and second inward flanges 242, 244 of the transverse slot, thereby precluding relative axial movement. The two structures are both rotationally and axially fixed to each other.

Once the spindle member 200 is attached to the coupling 204, and in turn, substantially axially fixed within the bushing 202, the remainder of the lock can be coupled to the drawer, cabinet door or other structure. As set forth above, the housing assembly is coupled to the outside of a selectively movable member (or other structure). As set forth above, the housing assembly may be glued, adhered, fastened with fasteners or otherwise attached to the outside surface thereof. Upon positioning, a portion of the housing (protruding cylindrical structure corresponding to the bore through the drawer, cabinet door or other structure) surrounding the central opening 37 can be directed into position.

With reference to FIGS. 30 through 33, as the same is positioned, the first end 216 of the knob attachment portion of the spindle member 200 extends through the central opening (generally centered therethrough). As set forth above, the knob 70 may be coupled to the first end 216 of the knob attachment portion of the spindle member through an interference fit, coupled with a set screw. In particular, the knob 70 includes an axially centered cavity 87 which is configured to engagingly receive the first end of the knob attachment portion of the spindle member. In the embodiment shown, the cavity has a square cross-sectional configuration, such that when the correspondingly shaped first end of the spindle member is inserted, the two structures rotate together. A set screw, or pair of set screws can be extended through the dependent skirt 82 and into the cavity to engage the lock driver and to lock the lock driver in the installed position. Advantageously, access to the set screw is provided by way of a corresponding opening 89 on the second end of the housing assembly. It will be understood that the opening of the housing assembly lines up with each one of the set screws on the dependent skirt 82 of the knob 70 when the knob is in a position other than the locked position (that is, the opening can be moved along the second end as long as when locked, the set screw does not match up with the opening). Additionally, also as set forth above, when in the locked position, each of the set screw is offset relative to the opening such that the set screw remains inaccessible.

Advantageously, the present disclosure provides for a manner by which to provide a spindle member that can interface with a coupling 204 typically intended for use in association with tumbler/key arrangement of the prior art and that can interface with an electronic lock (among other configurations, of the configuration of the lock of the present disclosure) wherein the locking mechanism is electronic and positioned on an outside surface of the associated drawer, cabinet door or other structure (as opposed to being within the bushing or within the volume that is to be protected).

Figure 43:
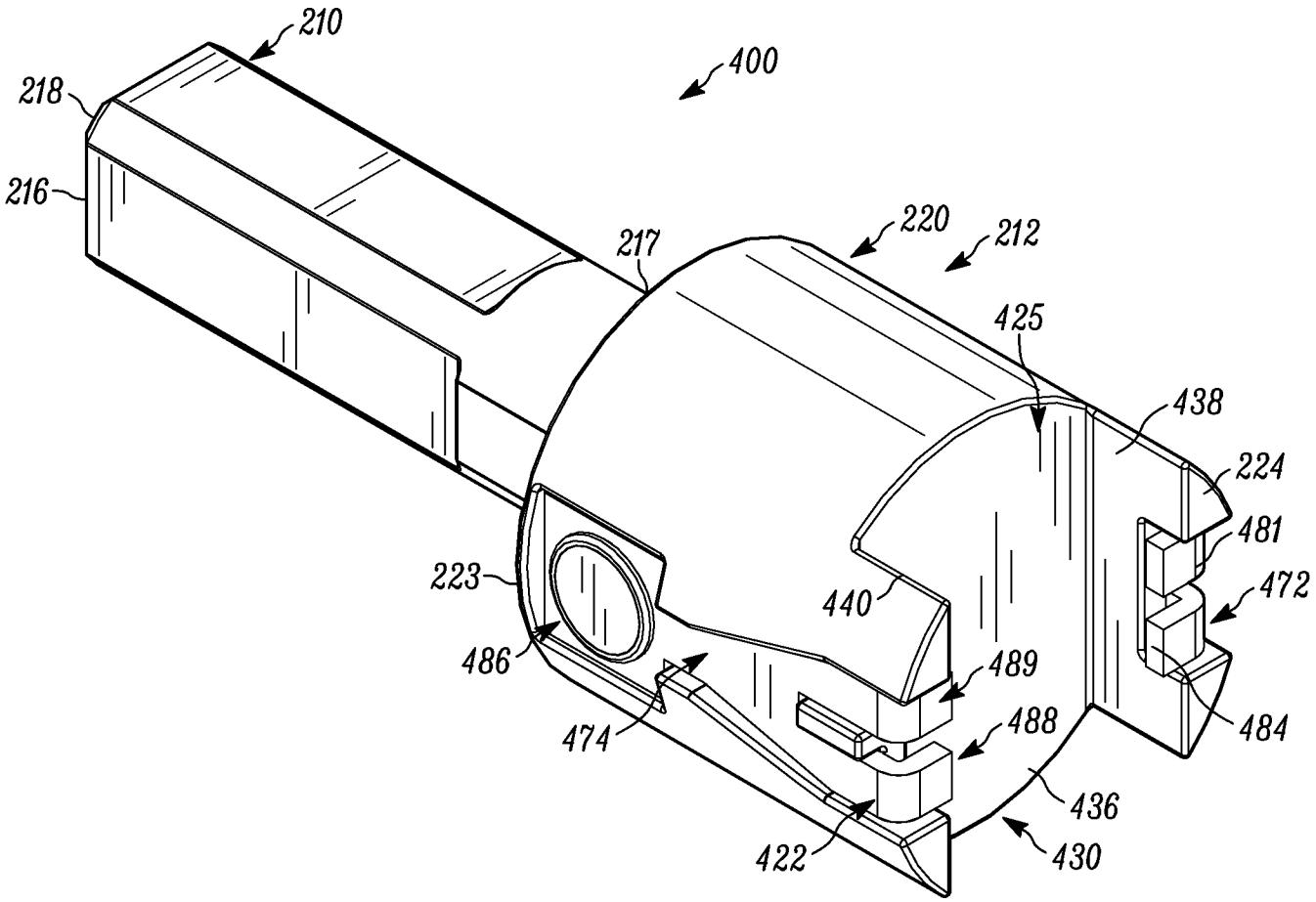
FIG. 43 of the drawings is a perspective view of another configuration of a spindle member configured for attachment to the coupling member of the configuration of the actuatable lock assembly of the present disclosure.
Figure 44:
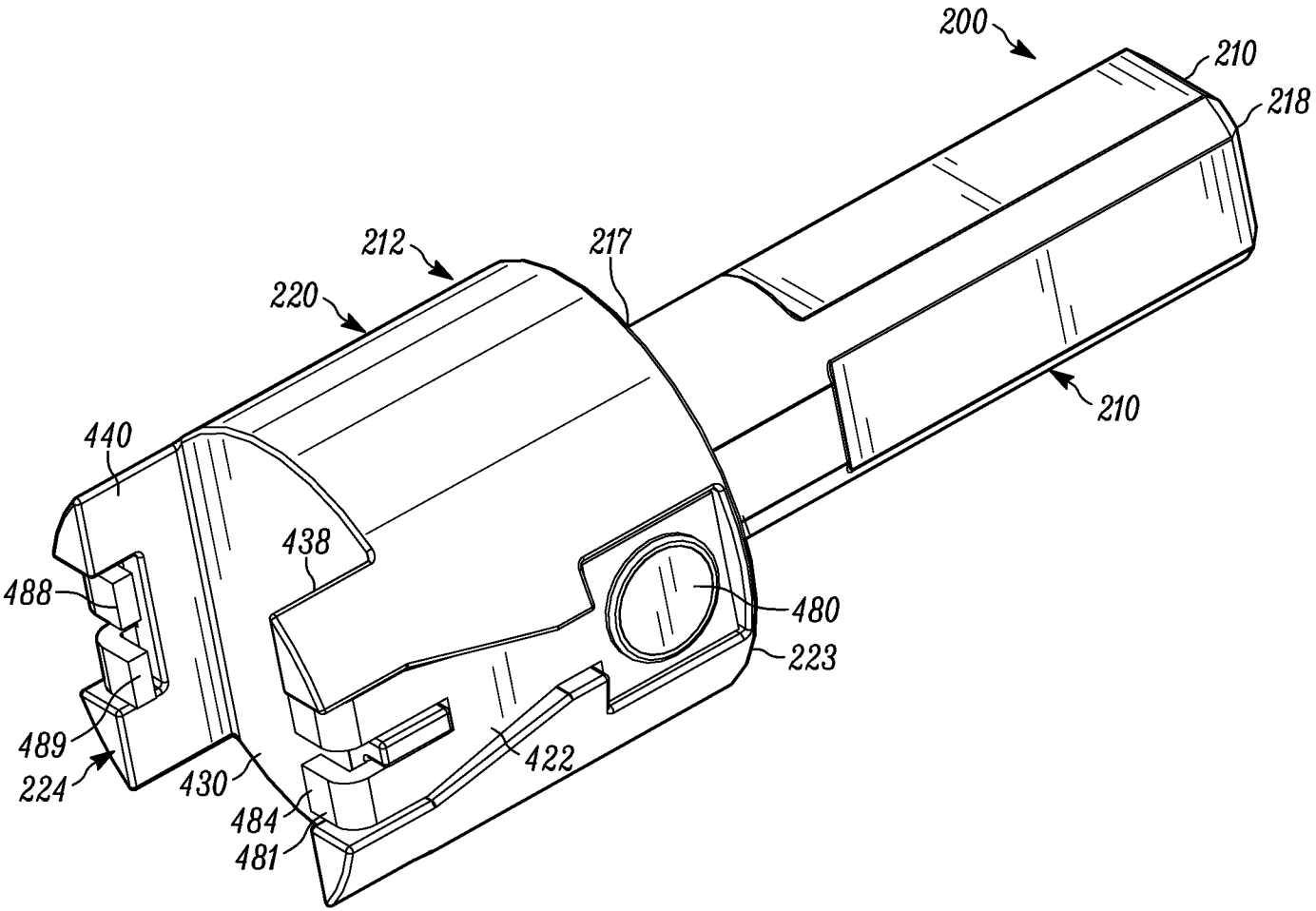
FIG. 44 of the drawings is a perspective view of another configuration of a spindle member configured for attachment to the coupling member of the configuration of the actuatable lock assembly of the present disclosure.

In another configuration, and with reference to FIGS. 43 and 44, the spindle member 400 may be utilized. Such a spindle member includes knob attachment portion 210 and coupling attachment portion 212. The knob attachment portion is substantially identical in configuration to that of spindle member 200, including first end 216, second end 217 and front face 218.

In such a configuration, the coupling attachment portion 212 includes body 220 having retention coupling portion 425 and coupling member latching portion 422. The body 220 includes first end 223 and second end 224. The retention coupling portion 425 includes transverse slot 430. The transverse slot 430 includes base 436, first upstanding wall 438, second upstanding wall 440. The first and second upstanding walls are generally spaced apart from each other and substantially parallel to each other. The first and second upstanding walls are spaced apart a distance that is defined as the major width.

The coupling member latching portion 422 comprises first flexible gripper arm 472 and second flexible gripper arm 474. The first flexible gripper arm 472 extends along the side of the body of the coupling attachment portion from the first end thereof over the first upstanding wall 438. The first flexible gripper arm 472 includes fixed end 480 and distal end 481. An inward flange 484 is positioned at the distal end thereof, the inward flange is configured to extend inward of the first upstanding wall 438 to overlie a portion of the base 436. The inward flange may have an inclined surface such that, upon direction of, a force against the inward flange directs the inward flange in an outward direction. It will be understood that the first flexible gripper arm 472 is configured so as to be, in a resting position, overlying a portion of the base 436 with the inward flange.

Similarly, the second flexible gripper arm 474 extends along the side of the body of the coupling attachment portion from the first end thereof over the second upstanding wall 440. The second flexible gripper arm 474 is generally a mirror image of the first flexible gripper arm 472, and includes fixed end 486 and distal end 488. Inward flange 489 is positioned at the distal end 488.

In use, to couple the spindle member 400 to the coupling 204, the spindle member is directed into the central bore 310 of the bushing 202. The spindle is configured so that the coupling generally has the slot 369 in a generally horizontal configuration, and with the transverse slot 430 in a generally horizontal configuration. As the spindle attachment portion extends into the transverse slot 430, continued movement directs retaining flanges 354, 364 of the spindle attachment portion of the coupling 204 into the flexible gripper arms 472, 474, moving the inward flanges outwardly. Eventually, the inward flanges are moved sufficiently so that the retaining flanges 354, 364 of the coupling 204 extend therebeyond. Once they pass, the inward flanges of the flexible gripper arms return to the initial orientation, sandwiching the spindle attachment portion between the base 436 and the inward flanges. Due to the relative sizing, the first and second upstanding walls 438, 440 preclude rotative movement of the spindle member relative to the coupling. Thus, the coupling and the spindle member are captured so as to have minimal relative rotation or axial movement.

Once the spindle member is coupled to the coupling, the attachment of the remainder of the lock can proceed as described above. It will be understood that while in the embodiments described, the spindle member and the coupling are attachable so as to minimize relative axial and relative rotational movement, it is contemplated that, some axial relative movement would not be precluded, but that other mechanisms set the relative position of the spindle member and the coupling so that the axial movement is limited (just not by the actual interface between the spindle member and the coupling). For example, the relative positions of the knob/lock housing assembly and the relative position of the bushing can define the space for the spindle member and the coupling thereby precluding axial movement of either one, as well as relative axial movement.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A lock coupled to a selectively movable member having an exposed outside surface and an inside surface opposing the outside surface, the inside surface defining a portion of a volume to which the lock is providing selective access, comprising:

a housing assembly defining a cavity, the housing assembly positioned on an exposed outside surface of the selectively movable member;

an actuatable lock assembly associated with the housing, the actuatable lock assembly being rotatable relative to the housing assembly in at least a closed orientation and an open orientation, the actuatable lock assembly further comprising:

a bushing positioned outside of the cavity of the housing assembly and configured to extend through a bore in a selectively movable member, the bushing defining a central bore, and having an end wall with a latch opening extending therethrough;

a knob rotatably positionable relative to the housing assembly and overlying the bushing and on a side of the housing assembly opposite the bushing;

a coupling having a body positionable within the central bore of the bushing with a second end extending through the latch opening, the coupling configured to be rotatable within the central bore about an axis defined by the second end extending through the latch opening, the coupling having a spindle attachment portion positioned within the central bore; and a spindle member having a knob attachment portion and a coupling attachment portion, the knob attachment portion attachable to the knob, so as to rotate therewith, with the coupling attachment portion extending outside of the cavity of the housing assembly and into the central bore and attachable to the spindle attachment portion of the coupling, so as to be fixed rotationally thereto, whereupon attachment, relative rotation of the spindle member and the coupling is substantially precluded, and, wherein axial separation of the spindle member and the coupling is substantially precluded; and a latching assembly positionable in one of a locked position and an unlocked position, the latching assembly being positioned within the cavity of the housing assembly, the latching assembly further including an actuator, upon actuation thereof, is configured to position the latching assembly in one of the locked position and the unlocked position, wherein positioning in the unlocked position allows direction of the actuatable lock assembly from a closed orientation to the open orientation, and wherein positioning in the locked position precludes direction of the actuatable lock assembly into the open orientation.

2. The lock of claim 1 whereupon attachment of the spindle attachment portion of the coupling and the coupling attachment portion of the spindle member, relative axial movement is substantially precluded therebetween.

3. The lock of claim 1 further comprising an electronic control assembly electrically coupled to the actuator and positioned within the housing assembly, the electronic control assembly configured to control the same, and an input device positioned on a top of the housing assembly, the input device allowing a user to provide an authorizing signal to the electronic control assembly to direct the actuator to initiate rotation thereof.

4. The lock of claim 3 wherein the input device comprises a keypad.

5. The lock of claim 1 wherein the knob is positionable on a surface of the housing assembly, with the spindle member extending through an opening therein.

6. The lock of claim 1 wherein:

the coupling attachment portion includes a body and a coupling member latching portion, the body further including:

a retention coupling portion that defines a transverse slot having a base, a first upstanding wall and a second upstanding wall positioned in a spaced apart orientation extending from the base, a first inward flange extending from the first upstanding wall spaced apart from the base, a second inward flange extending from the second upstanding wall spaced apart from the base; and an internal cavity portion defining an upper opening in the base spaced apart from the first upstanding wall and the second upstanding wall; and the coupling member latching portion slidably movable through the upper opening from within the internal cavity so as to be within the transverse slot;

the spindle attachment portion of the coupling further comprises:

a first leg having a retaining flange at a distal end thereof; and a second leg having a retaining flange at a distal end thereof;

the first and second legs spaced apart so as to define a slot therebetween;

wherein, the distal end of the first leg and the distal end of the second leg are positionable into the transverse slot in a first orientation and directable against the coupling member latching portion directing the coupling member latching portion out of the transverse slot through the upper opening, and whereupon rotation of the spindle member relative to the coupling through a predetermined relative rotation, the retaining flange of the first leg becomes captured between the base and the first inward flange, and the retaining flange of the second leg becomes captured between the base and the second inward flange, with the coupling member latching portion slidably positionable within the slot therebetween, thereby substantially precluding relative rotation of the spindle member relative to the coupling.

7. The lock of claim 6 wherein a biasing member is positioned between the body of the coupling attachment portion and the coupling member latching portion, the biasing member biasing the coupling member latching portion to extend into the transverse slot.

8. The lock of claim 7 wherein the biasing member comprises a spring positionable within the internal cavity.

9. The lock of claim 6 wherein the coupling member latching portion includes an upper end configured to extend through the upper opening, a first lower leg and a second lower leg extending therefrom, the first lower leg including a first outward flange and the second lower leg including a second outward flange, the outward flanges interfacing with opposing lower ledges defined in the internal cavity portion to preclude removal of the coupling member latching portion through the upper opening.

10. The lock of claim 9 wherein a biasing member is positioned between the body of the coupling member attachment portion and the coupling member latching portion, the biasing member biasing the first outward flange against one of the opposing lower ledges and the second outward flange against the other of the opposing lower ledges, to, in turn, direct a portion of the upper end to extend through the upper opening.

11. The lock of claim 10 wherein the biasing member comprises a spring positioned within the internal cavity portion and between the first lower leg and the second lower leg, and positioned against the upper end thereof.

12. The lock of claim 1 wherein:

the coupling attachment portion includes a body and a coupling member latching portion, the body further including:

a retention coupling portion that defines a transverse slot having a base, a first upstanding wall and a second upstanding wall positioned in a spaced apart orientation extending from the base, a coupling member latching portion further including a first flexible gripper arm extending along the body and the first upstanding wall, and having an inward flange positioned to extend inwardly beyond the first upstanding wall so as to overlie the base, the first flexible gripper arm being elastically movable in an outward direction so as to direct the inward flange beyond the first upstanding wall, and a second flexible gripper arm extending along the body and the second upstanding wall, and having an inward flange positioned to extend inwardly beyond the second upstanding wall so as to overlie the base, the second flexible gripper arm being elastically movable in an outward direction so as to direct the inward flange beyond the second upstanding wall;

the spindle attachment portion of the coupling further comprises:

a first leg having a retaining flange at a distal end thereof; and a second leg having a retaining flange at a distal end thereof;

wherein, the distal end of the first leg and the distal end of the second leg are directable into the first and second flexible gripper arms, elastically moving the first and second flexible gripper arms outwardly, so as to position the retaining flange of the first leg and the retaining flange of the second leg beyond the first and second gripper arms and into the transverse slot, whereupon, the returned first and second flexible gripper arms sandwich the first and second legs therebetween, to, in turn, substantially preclude relative rotation of the spindle member relative to the coupling.

13. The lock of claim 12 wherein:

the first and second flexible gripper arms and the transverse slot captures the first and second leg so as to substantially preclude relative axial movement therebetween.

14. The lock of claim 1 wherein a latch flange is coupled to the second end outside of the central bore.

15. The lock of claim 1 wherein the latching assembly further comprises:

a latch movable relative to the housing, the latch having a proximal end and a distal end, the distal end configured to interface with the actuatable lock assembly wherein movement of the actuatable lock assembly between the closed orientation and the open orientation imparts movement of the latch relative to the housing;

a blocker slidably movable between a locked position and an unlocked position, wherein, in the locked position, the blocker precludes movement of the latch to thereby preclude the direction of the actuatable lock assembly from a closed orientation to an open orientation, and wherein, in the unlocked position, the blocker is slidably moved relative to the latch so as to allow the latch to move relative to the blocker, to, in turn, allow the actuatable lock assembly to move between the closed orientation and the open orientation, the blocker having a cam profile disposed thereon;

a cam rotatably mounted within the cavity of the housing assembly, the cam having a first follower configured to intermittently coact with the cam profile of the blocker, to, in turn, move the blocker to allow the latch to move between a locked position to the unlocked position;

wherein the actuator is coupled to the cam, and whereupon actuation of the actuator caused rotation of the cam, and, in turn, movement of the latch between the locked and unlocked position.

16. The lock of claim 15 wherein upon actuation of the actuator, from either the locked or the unlocked position, the cam rotates through an initial arcuate distance prior to imparting a force upon the blocker to slidably move the same into the other of the locked or unlocked position.

17. The lock of claim 16 wherein the initial arcuate distance comprises approximately half of a revolution.

18. The lock of claim 15 wherein the arcuate distance of rotation of the cam between the locked position and the unlocked position comprises approximately a revolution and a half.

19. The lock of claim 15 wherein the blocker further includes a second cam profile disposed thereon, the cam profile and the second cam profile being substantially parallel to each other defining an longitudinal channel therebetween, the cam further includes a body and a second follower, the first follower extending from a first side of the body and a second follower extending from a second side of the body, wherein the cam follower interfaces with the cam profile and the second cam follower interfaces with the second cam profile, with the body of the cam positioned at least partially within the longitudinal channel.

20. The lock of claim 15 wherein the cam profile includes a first slot, a second slot and a third slot, with a first ridge defined between the first slot and the second slot, and a second ridge defined between the second slot and the third slot, the width of the second slot is at least as wide as the follower, such that when the follower engages the second slot, further rotation slidably moves the blocker.

21. The lock of claim 1 wherein the knob is precluded from movement in the locked position.

22. A lock configured to be attachable to a coupling with a first end positioned within a central bore of a bushing configured to be attachable to an outside structure, and a second end configured to be extending out of the bushing and having a locking flange, the lock comprising:

a housing assembly defining a cavity, the housing assembly configured to be positionable on the outside structure;

an actuatable lock assembly associated with the housing, the actuatable lock assembly being rotatable relative to the housing assembly in at least a closed orientation and an open orientation, the actuatable lock assembly further comprising:

a spindle member having a knob attachment portion and a coupling attachment portion, with a knob coupled to the knob attachment portion, the spindle member and the knob configured to rotate relative to the housing assembly, the coupling attachment portion extending outside the cavity of the housing on a side opposite the knob and configured to be extendable into the central bore and configured to be attachable to the coupling positioned therein, so as to be fixed rotationally thereto, whereupon attachment, relative rotation of the spindle member and the coupling is substantially precluded, and, wherein axial separation of the spindle member and the coupling is substantially precluded; and a latching assembly positionable in one of a locked position and an unlocked position, the latching assembly being positioned within the cavity of the housing assembly, the latching assembly further including an actuator, upon actuation thereof, is configured to position the latching assembly in one of the locked position and the unlocked position, wherein positioning in the unlocked position allows rotation of the knob, and, in turn, direction of the actuatable lock assembly from a closed orientation to the open orientation, and wherein positioning in the locked position precludes direction of the actuatable lock assembly into the open orientation.

23. The lock of claim 22, wherein the coupling attachment portion further includes a body and a coupling member latching portion, the body further including:

a retention coupling portion that defines a transverse slot having a base, a first upstanding wall and a second upstanding wall positioned in a spaced apart orientation extending from the base, a first inward flange extending from the first upstanding wall spaced apart from the base, a second inward flange extending from the second upstanding wall spaced apart from the base; and an internal cavity portion defining an upper opening in the base spaced apart from the first upstanding wall and the second upstanding wall; and the coupling member latching portion slidably movable through the upper opening from within the internal cavity so as to be within the transverse slot, wherein, a portion of a coupling is retained between the base and the first and second inward flanges, and substantially precluded from rotation at least partially by the coupling member latching portion extending beyond the base.

24. The lock of claim 23 wherein the knob is precluded from movement in the locked position.

25. The lock of claim 22 wherein the coupling attachment portion includes a body and a coupling member latching portion, the body further including:

a retention coupling portion that defines a transverse slot having a base, a first upstanding wall and a second upstanding wall positioned in a spaced apart orientation extending from the base; and the coupling member latching portion further including a first flexible gripper arm extending along the body and the first upstanding wall, and having an inward flange positioned to extend inwardly beyond the first upstanding wall so as to overlie the base, the first flexible gripper arm being elastically movable in an outward direction so as to direct the inward flange beyond the first upstanding wall, and a second flexible gripper arm extending along the body and the second upstanding wall, and having an inward flange positioned to extend inwardly beyond the second upstanding wall so as to overlie the base, the second flexible gripper arm being elastically movable in an outward direction so as to direct the inward flange beyond the second upstanding wall, wherein, the first and second flexible gripper arms sandwich a portion of a coupling member therebetween, to, in turn, substantially preclude relative rotation of the spindle member relative to a coupling.

* * * * *